US005808247A

United States Patent [19]

Thangavelu

[11] Patent Number: 5,808,247

[45] **Date of Patent: *Sep. 15, 1998**

[54] SCHEDULE WINDOWS FOR AN ELEVATOR DISPATCHER

[75] Inventor: Kandasamy Thangavelu, Avon, Conn.

[73] Assignee: Otis Elevator Company, Farmington, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 568,894

[22] Filed: Nov. 30, 1995

[51] Int. Cl.[6] ..... B66B 1/18

[52] U.S. Cl. ..... 187/386; 187/382

[58] Field of Search ..... 187/385, 387, 187/382, 380, 386

[56] References Cited

U.S. PATENT DOCUMENTS

| | | | |
|---|---|---|---|
| 3,422,928 | 1/1969 | Bruns | 187/386 |
| 4,305,479 | 12/1981 | Bittar et al. | 187/386 |
| 4,355,705 | 10/1982 | Schröder et al. | 187/29 |
| 4,411,337 | 10/1983 | Schröder et al. | 187/29 |
| 4,492,288 | 1/1985 | Schröder | 187/29 |
| 4,711,324 | 12/1987 | Schröder | 187/121 |
| 4,735,294 | 4/1988 | Schröder | 187/121 |
| 4,760,896 | 8/1988 | Yamaguchi | 187/124 |
| 4,869,348 | 9/1989 | Schröder | 187/127 |
| 4,878,562 | 11/1989 | Schröder | 187/127 |
| 4,901,822 | 2/1990 | Tsuji | 187/127 |
| 4,926,976 | 5/1990 | Schröder | 187/125 |
| 4,939,634 | 7/1990 | Schröder | 364/141 |
| 4,947,965 | 8/1990 | Kuzunuki et al. | 187/127 |
| 5,022,498 | 6/1991 | Sasaki et al. | 187/127 |

(List continued on next page.)

FOREIGN PATENT DOCUMENTS

| | | | |
|---|---|---|---|
| 0030163 | 6/1981 | European Pat. Off. . | |
| 0321657 | 6/1989 | European Pat. Off. . | |
| 2286468 | 8/1995 | United Kingdom | B66B 1/20 |

OTHER PUBLICATIONS

"FI–320", Sales Release of Unique Intelligeny Group Control Elevator—Realization of Multiobjective Group Control System, Hitachi News Release 88–184, Dec. 15, 1988.

"Application of the Expert System to Elevator Group Control", Mitsubishi Electric Corporation, Japan, a presentation at Lerch/Bates seminar at Littleton, Colorado, Jun. 14, 1989.

"Fuzzy Theory and Intelligent Applications", Y. Umeda et al, Mitsubishi Electric Corp, Elevator World, Jul. 1989.

"Fuzzy Control System for Elevator Group and its Simulation System", T. Yamaguchi et al, Toshiba Corp, received from Togai InfraLogic, 1989.

"Group Control System Assisted by Artificial Intelligence", H. Aoki et al, Fujitec Company, Elevator World, Feb. 1990.

"An On–line Tuning Method for Multi–objective Control of Elevator Group", A. Fujino et al, Hitachi Ltd, a paper in IEEE., 1992.

"Elevator Group Control System Tuned by a Fuzzy Neural Network Applied Method", N. Imasaki et al, Toshiba Corp, IEEE, Jul. 1995.

"A Fuzzy Approach to Elevator Group Control System", C.B. Kim et al, IEEE Transactions on System, Man and Cybernatics, vol. 25, No. 6, Jun. 1995.

PCT International Search Report dated Mar. 12, 1997, PCT International Application No. PCT/US96/17983.

*Primary Examiner*—Robert Nappi

[57] ABSTRACT

A system for controlling elevator cars in a building having a plurality of floors includes a group controller for controlling operation of the elevator cars. The group controller predicts lobby single source traffic for determined periods. When the predicted traffic is below certain limit, cars are assigned to a lobby hall call on demand after hall call registration. When the predicted traffic is above certain limit, cars are assigned to the lobby hall call at intervals. Accordingly, car assignment is scheduled at those intervals. The schedule interval is varied based on predicted traffic and predicted round trip time of the cars. The cars are assigned to hall calls if they arrive within a schedule window. The schedule window comprises a lower and an upper tolerance that are selected around a scheduled time.

35 Claims, 46 Drawing Sheets

U.S. PATENT DOCUMENTS

| | | | |
|---|---|---|---|
| 5,054,585 | 10/1991 | Amano | 187/124 |
| 5,065,846 | 11/1991 | Schröder | 187/127 |
| 5,092,431 | 3/1992 | Schröder | 187/127 |
| 5,192,836 | 3/1993 | Schröder | 187/126 |
| 5,219,042 | 6/1993 | Sattar et al. | 187/127 |
| 5,243,155 | 9/1993 | Sirag, Jr. | 187/127 |
| 5,248,860 | 9/1993 | Sirag, Jr. et al. | 187/124 |
| 5,258,587 | 11/1993 | Kezer et al. | 181/131 |
| 5,260,526 | 11/1993 | Sirag, Jr. | 187/127 |
| 5,260,527 | 11/1993 | Sirag, Jr. | 187/131 |
| 5,274,202 | 12/1993 | Kezer et al. | 187/386 |
| 5,305,198 | 4/1994 | Schröder | 364/402 |
| 5,338,904 | 8/1994 | Powell et al. | 187/137 |
| 5,347,093 | 9/1994 | Kezer et al. | 187/131 |
| 5,714,725 | 2/1998 | Thangavelu . | |
| 8,264,393 | 6/1994 | Powell et al. . | |
| 8,264,652 | 6/1994 | Powell et al. . | |

JOINT LOBBY TRAFFIC AND TRAFFIC RATE

SCHEDULE WINDOWS FOR AN ELEVATOR DISPATCHER

BACKGROUND OF THE INVENTION

1. Technical Field

This invention relates to the dispatching of elevator cars in an elevator system during single source traffic conditions.

2. Background Art

Traffic originating at a building entrance lobby varies with the time of day. For example, during an up peak period a majority of traffic originates at a building entrance lobby and terminates at upper floors. In other words, during up peak there is significant up traffic. The volume of up traffic during up peak initially increases with time until it reaches some peak value and then decreases. Accordingly, the traffic originating at the building entrance lobby is significant and heavy for most of the up peak period. Significant up traffic may also occur at other times during the day. For example, during noon time the traffic changes direction several times and the up traffic is often significant.

During up peak and other periods having significant up traffic conditions, a variable interval dispatcher as explained in U.S. Pat. No. 4,305,479 of Bittar et al entitled "Variable Elevator Up Peak Dispatching Interval" assigned to Otis Elevator Company is generally used. In this patent, the interval between successive cars leaving the building entrance lobby is varied as a function of estimated average round trip time of the cars and the number of cars in operation. The cars arrive at the building entrance lobby stochastically and are assigned to the lobby hall call on demand.

Accordingly, the variable interval dispatcher assigns the cars to the lobby hall call after the hall call is registered. This is a reactive mode and uses minimal planning. During up traffic conditions, all available cars at upper floors are sent to the building entrance lobby. Thus, bunching may occur at the building entrance lobby. Additionally, registration times and passenger waiting times may be high as a result of decreased availability of cars for up and down hall calls above the building entrance lobby. The above lobby hall calls may be repeatedly reassigned. At the building entrance lobby, cars may leave with small number of passengers. At other times, the interval between car arrivals at the building entrance lobby is long which causes the formation of a large lobby queue. When the lobby queue exceeds a limit, say 12 passengers, it is defined as a crowd. The size of the crowd and the duration of the crowd may be very large during up peak. The average and maximum passenger waiting time at the building entrance lobby may also be large. Thus, handling capacity of the elevator group is limited during up peak conditions.

As an alternative to the variable interval dispatcher, a channeling method as explained in U.S. Pat. No. 4,804,069 of Bittar et al entitled, "Contiguous Floor Channeling Elevator Dispatching" and U.S. Pat. No. 4,792,019 of Bittar et al entitled, "Contiguous Floor Channeling with Up Hall Call Elevator Dispatching" may be used. Channeling may be further improved by using artificial intelligence based predicted traffic to form traffic volume equalized dynamic sectors as explained in U.S. Pat. No. 4,846,311 of Kandasamy Thangavelu entitled "Optimized Up Peak Elevator Channeling System with Predicted Traffic Volume Equalized Sector Assignment" assigned to Otis Elevator Company.

A further improvement of channeling using artificial intelligence based predicted traffic provides preferential service to high intensity traffic floors as explained in U.S. Pat. No. 5,183,981 of Kandasamy Thangavelu entitled, "Up Peak Elevator Channeling system with Optimized Preferential Service to High Intensity Traffic Floors" assigned to Otis Elevator Company.

The channeling system divides the building into sectors comprising contiguous floors. Successive cars arriving at the building entrance lobby are assigned to successive sectors in a round robin fashion. The channeling system requires electroluminescent displays ("ELD") to display the floors served by the cars and advanced dispatcher system ("ADS") to collect historic and real time traffic data and predict the traffic for a next short interval. The channeling system increases the handling capacity and decreases lobby passenger waiting time and passenger service time. The car assignment to sectors is preplanned.

Channeling provides a solution to some of the problems of variable interval dispatcher and provides improved dispatching performance. By using sectors, channeling reduces the number of stops made per trip and the average round trip time of the cars. By assigning the cars to sectors using the round robin method or the frequency of service method, channeling provides service to destination floors. However, the passenger waiting time may still be large, although the lobby crowd and duration of crowd are reduced. The car arrival at the building entrance lobby is not controlled and cars arrive at the building entrance lobby stochastically. All available cars at upper floors are sent to the building entrance lobby possibly resulting in lobby bunching and reduced service to above lobby up and down hall calls.

Accordingly, it is desirable to reduce lobby bunching, hall call registration time, hall call reassignments, passenger waiting time, lobby crowds and duration of crowds.

DISCLOSURE OF INVENTION

It is an object of the present invention to provide an improved elevator dispatching system and method.

It is another object of the present invention to provide an elevator dispatching system that provides a car arrival rate at the lobby that matches a passenger arrival rate at the lobby.

It is a further object of the present invention is to minimize the variance of car loads of successive cars leaving the lobby and to minimize the maximum passenger waiting time.

It is still another object of the present invention to improve car availability for all hall calls, including hall calls made at floors other than the lobby.

It is yet another object of the present invention to reduce lobby bunching, hall call registration time, hall call reassignments, passenger waiting time, lobby crowds and duration of crowds.

According to the present invention, a system for controlling elevator cars in a building having a plurality of floors includes a group controller for controlling operation of the elevator cars. The group controller assigns at least one of the elevator cars to be available for passenger boarding within a schedule window.

In one embodiment, the schedule window includes upper and lower tolerances. The group controller assigns an elevator car to a hall call if the elevator car can arrive at a floor associated with the hall call within the upper and lower tolerances such that the variation in successive cars loads is minimized.

BRIEF DESCRIPTION OF THE DRAWINGS

The foregoing and other objects, features and advantages of the present invention will become more apparent in light of the following detailed description and accompanying drawings where.

BEST MODE OF CARRYING OUT THE INVENTION

Elevator Control System

In a building having a plurality of floors, each floor typically has a set of buttons located near an elevator in a hallway. The buttons, commonly referred to as hall call buttons, enable a user to request elevator car service in a predetermined direction, e.g., up or down. In addition, an interior of an elevator car is generally equipped with a plurality of buttons, commonly referred to as car call buttons, which enable users to request service to specific floors.

An elevator control system, also referred to as either an elevator dispatching system or a dispatcher, monitors the status of the hall call buttons at the floors and dispatches an elevator car to the floors in response to hall call and/or car call button registration as is well known in the art.

Figure 1:
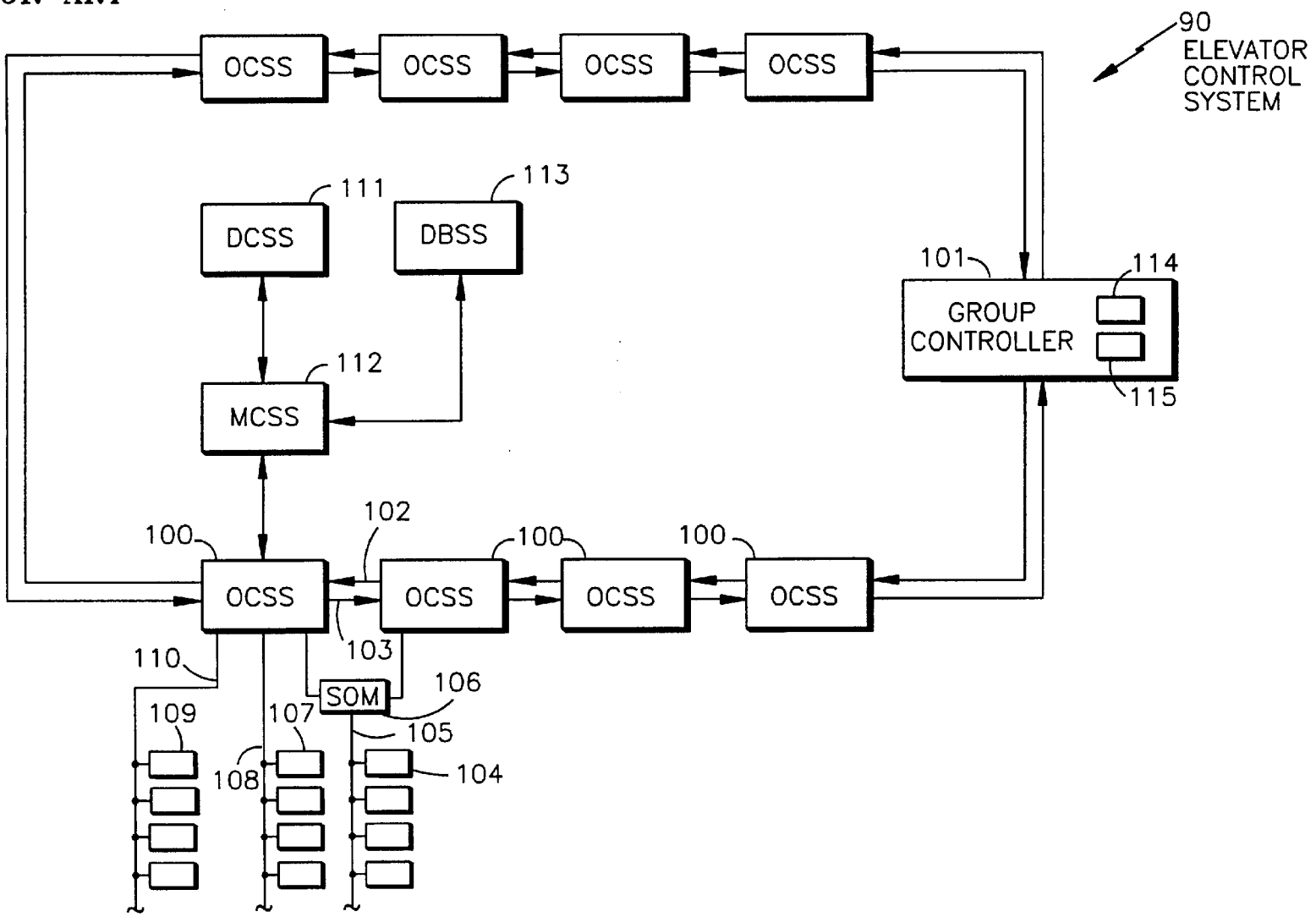
FIG. 1 PRIOR ART
FIG. 1 is a simplified block diagram of an elevator control system in which a group controller is included in a ring communication system.

Referring to FIG. 1, an exemplary elevator control system is shown. Each elevator car has an operational control subsystem ("OCSS") 100 which communicates with every other OCSS 100 in a ring communication system via lines 102, 103. It is to be understood that each OCSS 100 has various circuitry connected thereto. However, for the sake of simplicity, the circuitry associated with only one OCSS 100 will be described.

Hall call buttons and their associated lights and circuitry (not shown) are connected to the OCSS 100 via a remote station 104, a remote serial communication link 105 and a switch-over module 106. Car buttons and their associated lights and circuitry (not shown) are connected to the OCSS 100 via a remote station 107 and a remote serial communication link 108. Hall fixtures for indicating the direction of travel of the elevator car and/or for indicating which set of doors will be opened to accommodate the elevator car are connected to an OCSS 100 via a remote station 109 and a remote serial communication link 110.

The operation of an elevator car door is controlled by a door control subsystem ("DCSS") 111. The movement of the elevator car is controlled by a motion control subsystem ("MCSS") 112, which operates in conjunction with a drive and brake subsystem ("DBSS") 113. Dispatching is determined by a group control subsystem ("GCSS") 101, and executed by the OCSS 100 under the supervisory control of the GCSS 101. The GCSS 101, also defined as a group controller, comprises a memory 114 and a processor unit 115, both of which are well known in the art.

In a preferred embodiment, the DCSS 111 also receives the load data of the elevator car from load sensing devices and sends this data to the MCSS 112 such that the load data is converted into passenger boarding and/or deboarding counts by the MCSS 112. This information is sent to the OCSS 100 and from there to the GCSS 101 for recordation and prediction of traffic flow in order to increase the efficiency of elevator service as is explained hereinbelow.

Figure 2:
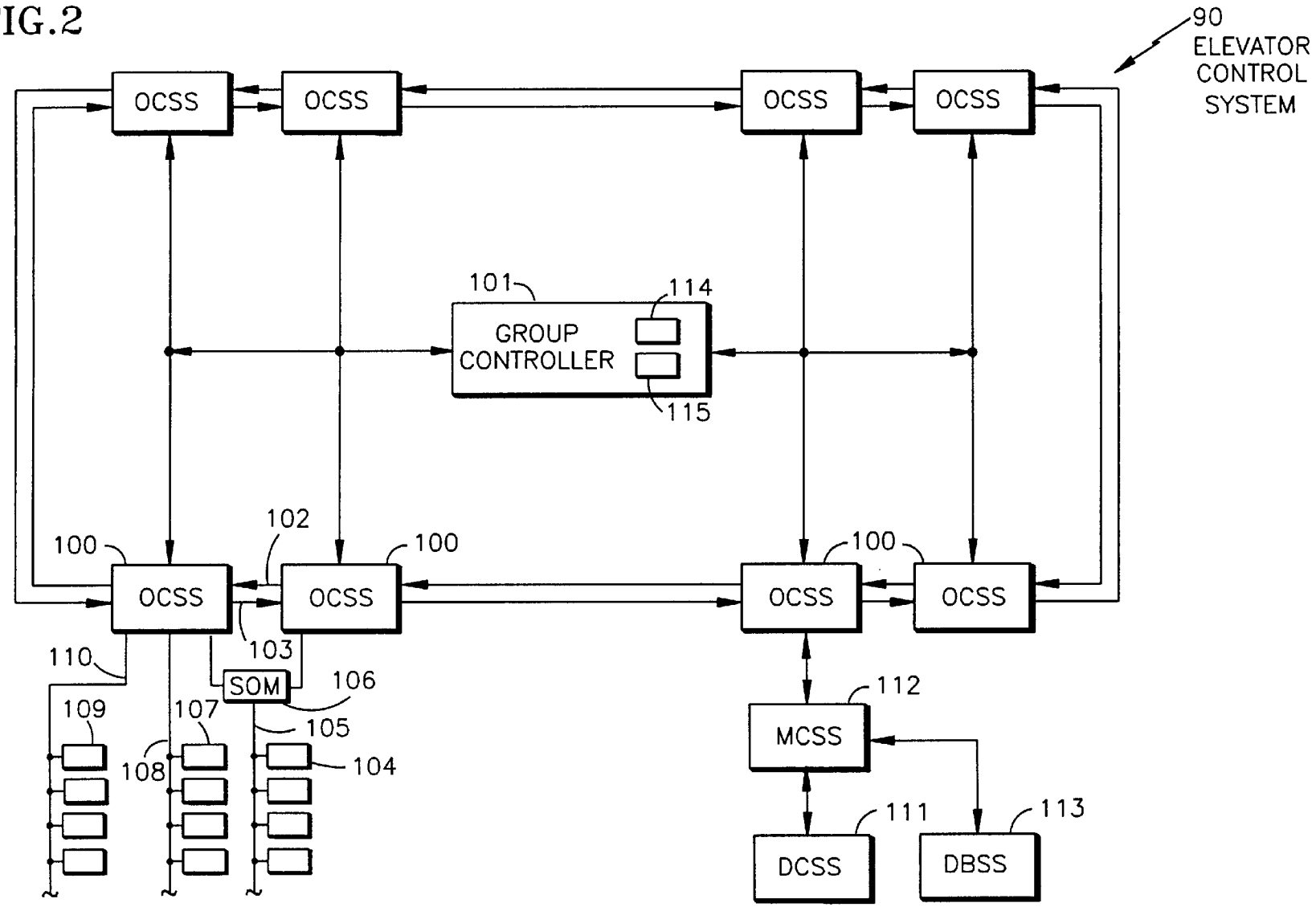
FIG. 2 is a simplified block diagram of an elevator control system in which the group controller is connected to an operational control subsystem through a network bus.

Accordingly, FIG. 1 shows an exemplary elevator control system where the GCSS 101 is connected to the OCSS 100 via serial ring communication. However, it should be understood by one skilled in the art that the present invention can be implemented with other elevator control systems, such as the elevator control system shown in FIG. 2. The elevator control system of FIG. 2 shows the GCSS 101 connected to the OCSS 100 via a network bus so that a significantly large volume of data can be transmitted from OCSS 100 to GCSS 101 and vice versa.

In a preferred embodiment, a dynamic scheduling elevator dispatcher is embodied in the GCSS 101. Programming to implement the dynamic scheduling elevator dispatcher is embedded in the memory 114 of the GCSS 101 for causing the processor unit 115 of the GCSS 101 to execute instructions of the programming. The processor unit 115 may comprise, in one embodiment a commercially available Intel '486 processor. Of course, other suitable processors may be used for implementing the present invention. The programming causes the dynamic scheduling elevator dispatcher to operate as described hereinbelow.

It should be understood by one skilled in the art, however, that the dynamic scheduling elevator dispatcher can be embodied in any suitable group controller. The group controller can be any elevator controller that controls a group of elevators based on system inputs. The group controller can be implemented with one elevator controller or more than one elevator controller. Similarly, the group controller can be embodied in one processor or more than one processor.

Additionally, the present invention can be used in a variety of elevator control systems. For example, the present invention can be implemented with an elevator control system which uses one elevator car controller, as opposed to a separate OCSS, MCSS and DBSS for each car, that is electrically connected via a communication bus to the group controller. Moreover, the present invention may be practiced in a wide variety of elevator systems, utilizing known technology, in the light of the teachings of the invention, which are discussed in further detail hereafter.

Dynamic Scheduling Elevator Dispatcher

The dynamic scheduling elevator dispatcher is predicated in part on the concepts of proactive planning in real time, assigning cars to the lobby to match passenger arrival rate and assigning cars at determined intervals when anticipated lobby traffic is above a limit. The dynamic scheduling elevator dispatcher is also predicated in part on the principle that an average queue length and a waiting time are reduced significantly in a queuing system if the variance in "service time" is reduced, wherein the service time is the interval between car availability at a floor. If the interval between the car availability is constant, resulting in zero variance in the interval, the average queue length and waiting time are reduced to half of uncontrolled exponential car availability intervals.

The dynamic scheduling elevator dispatcher, also defined as a dynamic scheduler, includes two car assignment modes. A car assignment mode that assigns cars at a schedule interval irrespective of the presence of a hall call at the lobby is defined as a scheduled service mode. The schedule interval is defined as the interval between a scheduled time when a car is made available for passenger boarding at a floor and a scheduled time when the next car is made available for passenger boarding at the floor. Thus, the schedule interval is a controlled parameter as is explained below. A car assignment mode where the cars are assigned to a lobby hall call on demand after the hall call is registered is defined as a demand service mode. The dynamic scheduling elevator dispatcher is an elevator dispatcher that has the capability to change the car assignment mode, a service interval between cars and a number of cars assigned to the lobby based on anticipated traffic in real time.

"Single source traffic" is defined as traffic traveling in the same direction that originates at one floor and terminates at one or more floors. The direction that the single source traffic is traveling is defined as a primary direction. The opposite direction of the primary direction is traveling in a secondary direction. Traffic originating at an entrance floor and terminating at upper floors is one example of "single source traffic." However, single source traffic may originate at a sky lobby and terminate at several accessible floors below or above the sky lobby. Accordingly, a lobby is defined as any floor where significant single source traffic originates. In one embodiment, significant single source traffic is defined as single source traffic that is more than 60% of the total traffic in the building for a determined time period. However, in another embodiment, the specific single source traffic level which is considered significant can range from 50% to 100% of the total traffic for the determined period. Accordingly, if 65% of the total traffic in the building originates on floor ten and travels in the down direction during a determined time period then floor ten is defined as a lobby. The methodology described hereinbelow is also applicable where the building has a secondary lobby and/or several basement floors.

A "single source condition" exists when significant single source traffic exists at a floor, such as a building entrance floor, and terminates at other floor(s). The methodology described in this specification is equally applicable to any single source traffic condition, such as during an up peak period or during a noon time period where a two way traffic condition exists.

In the dynamic scheduling elevator dispatcher, the traffic arriving at the lobby for a next short period is anticipated using real time data as is explained in the implementation section of the specification. When traffic demand is low, the dynamic scheduling elevator dispatcher operates in the demand service mode and cars are assigned to the lobby hall calls after the hall calls are registered. When the traffic volume reaches another threshold, the service mode changes to the scheduled service mode. The cars are assigned to the lobby at regular, determined intervals, e.g., once every 20 sec or 25 sec. Thus, a car will open its doors for passenger boarding every interval, e.g., once every 20 sec or 25 sec. The car will close its doors when a determined load has been reached or a determined dwell time has elapsed as is done in known up peak dispatchers.

The schedule interval is a function of traffic intensity. The anticipated volume of traffic for the next short period, e.g., three minutes, is used to compute the schedule interval such that the passengers arriving during the schedule interval is less than a predetermined volume e.g., 50% or 60% of the car's capacity. Thus, the schedule interval is changed as traffic volume changes and stochastic passenger arrival is accommodated.

The schedule interval is limited to a maximum, such as 40 or 50 seconds, so that the passengers do not have to wait for a long time at the lobby and to ensure that the lobby crowd remains small. The schedule interval is also limited to a minimum determined by the average round trip time and number of cars in operation in the group.

When the anticipated traffic for the short period reaches a threshold, some of the cars in a group of cars are assigned and sent to the lobby while the remaining cars are available for assignment to hall calls made at floors other than the lobby. The number of cars assigned to the lobby varies with traffic intensity, but all cars are never assigned to the lobby. As a result of assigning only some of the cars to the lobby, cars that are not assigned to the lobby are available for service to other floors; thus providing improved elevator service to the entire building. The number of cars assigned to the lobby depends on the number of cars available in the group and the anticipated traffic volume as is explained below in the implementation section of the specification.

When a car closes its doors and leaves the lobby, it is available for assignment to hall calls at floors other than the lobby. The car may also be eligible for assignment to hall calls at floors other than the lobby as it completes boarding or during the process of boarding at the lobby. The elevator control system computes the car arrival time at the farthest floor for the primary direction trip. The elevator control system also computes the car arrival time at the lobby. The car arrival time at the lobby is calculated using parameters specific to the elevator group and the building, and by using appropriate motion profiles as is known in the art.

The cars to be assigned to the lobby at any instant are selected based on the arrival time at the lobby. Cars available at the lobby are preferred over cars located at other floors. The cars located at the lobby are selected such that the cars with open doors are first selected, then the cars decelerating to the lobby are selected and then the cars stopped at the lobby with closed doors are selected. After the available cars at the lobby are selected, cars not at the lobby are selected for assignment to the lobby.

If there are several cars available at the lobby and some of the cars are not required for lobby service in the near future, the excess cars will be assigned to above lobby up and down hall calls. This reduces lobby bunching and improves car assignment above lobby.

To further improve the performance of the dynamic scheduling elevator dispatcher, a schedule window is provided for assigning cars to the lobby hall call. The schedule window is defined in terms of a lower tolerance and an upper tolerance around the scheduled time that a car is made available for passenger boarding. If a car arrives at the lobby and can open its door within this schedule window, it can be assigned to the lobby. The schedule window reduces the need for the car to arrive at the lobby before the scheduled time and wait for assignment at a specific time. Thus, using the schedule window decreases car idling time. Additionally, by allowing the car to arrive at the lobby within the schedule window, car assignment at other floors is better accommodated and is not constrained by the lobby car assignment requirement. Using the schedule window improves car availability for assignment at other floors, reducing the registration times and hall call reassignments.

When the traffic volume decreases, the scheduled service mode switches to demand service mode. In order to prevent oscillations between demand and scheduled mode, the dispatcher uses proper delays. The system will go into scheduled mode only if some traffic intensity persists for a determined time, e.g., 60 seconds. The system will switch from scheduled mode to demand mode only if the traffic demand falls below a threshold and remains below the threshold for a second determined time, e.g., 120 seconds. The following section describes in detail the implementation of the dynamic scheduling elevator dispatcher.

Methods of Implementing Dynamic Scheduling Dispatcher for Single Source Traffic The dynamic scheduling dispatcher requires anticipation of future lobby traffic level to select various control parameters and to control the dispatching process. This is achieved using real time traffic prediction based on traffic data collected during the past few minutes as is explained hereinbelow. However, the data may be collected over any suitable period.

Alternately, the loads of successive cars leaving the lobby and the departure intervals between those cars are used to estimate the lobby traffic and traffic rate using fuzzy logic. Accordingly, crisp values of the lobby traffic volume or level (lobby traffic, hereinafter) and time rate of change of lobby traffic volume or level (traffic rate, hereinafter) estimates are obtained within a predetermined range. The crisp values are then used to select control parameters for controlling the dispatching process as is explained hereinbelow.

As a third alternative, the car loads and the departure intervals are used to provide fuzzy estimates of lobby traffic and traffic rates. The fuzzy estimates are then used to select control parameters using fuzzy logic controllers to achieve robustness and adaptability as is also explained hereinbelow.

Accordingly, each of the three above-mentioned traffic forecasting methods involves selecting values for various control parameters and applying these parameters to control dispatching.

The control parameters include:

a. Determining the number of cars to be assigned to the lobby and sent to the lobby;

b. Determining the service mode to be used;

c. Determining the schedule interval for assigning cars at the lobby to be used in scheduled mode service;

d. Determining the schedule tolerances of the schedule window; and e. Determining the scheduled service activation delay and scheduled service cancellation delay to control oscillations.

Each of the three traffic forecasting methods and their associated methods for selecting the control parameters are described below.

I. Dynamic Scheduling Using Lobby Traffic Prediction

Figure 3:
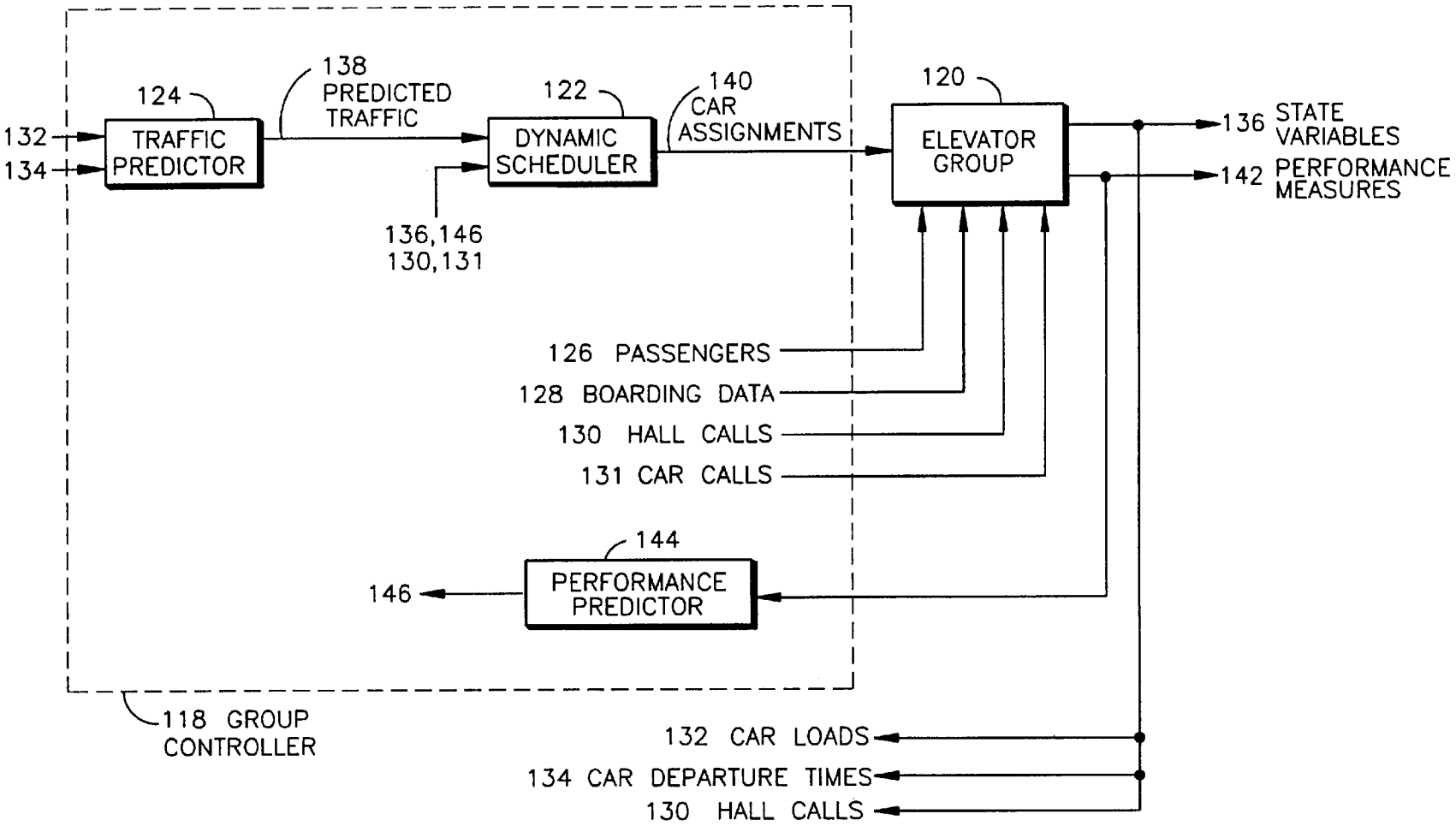
FIG. 3 is a simplified block diagram showing an elevator dispatcher of the group controller for implementing dynamic scheduling with traffic prediction.

FIG. 3 is a simplified block diagram of the group controller 118 resident in the GCSS 101. The group controller 118 comprises a dynamic scheduler 122, a traffic predictor 124 and a performance predictor 144. The passenger arrival 126 causes registration of hall calls 130 at lobby and other floors in up or down directions. The passengers boarding 128 causes car call 131 registration inside the car. As passengers board, car loads 132 change. The car loads 132 and departure times 134 are stored in the GCSS's memory as elevator control system state variables 136. The car loads 132 and the departure time 134 are used by the traffic predictor 124 to predict lobby traffic 138. The predicted lobby traffic 138, the hall calls 130, car calls 131, state variables 136 and the performance predictions 146 are used by the dynamic scheduler 122 as inputs to make the car assignments 140. The elevator group 120 is controlled by the car assignments 140. The operation of the elevator group results in certain group performances which are recorded using certain performance measures 142 in the GCSS's memory.

Figure 4:
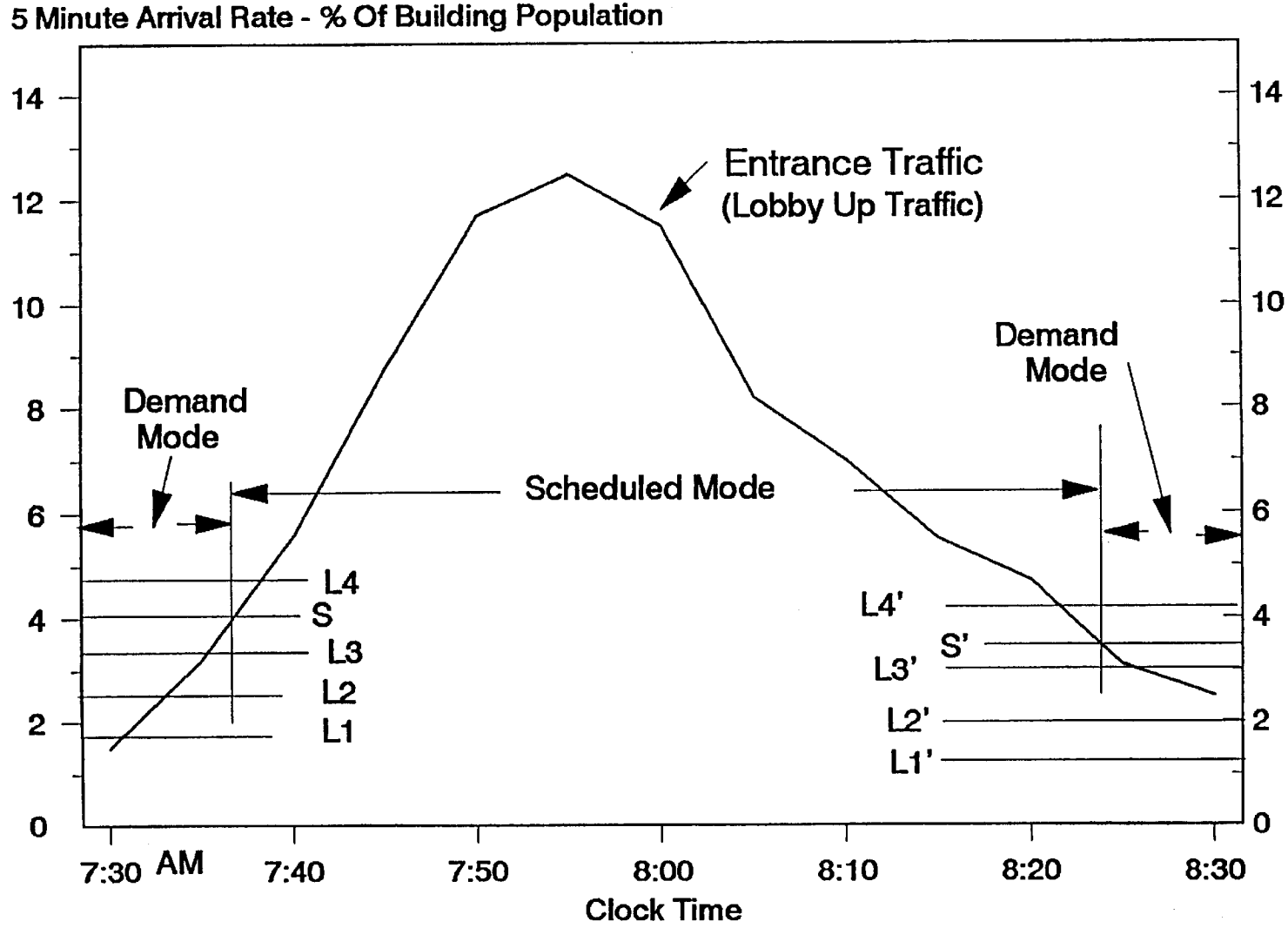
FIG. 4 is a graphical illustration showing up peak period traffic variation with respect to time and traffic thresholds that determine when the type of service and number of cars assigned to lobby are changed.

FIG. 4 shows the variations of single source traffic in terms of lobby passenger five minute arrival rates vs. time. As passengers arrive at the lobby and enter a hall call, the dispatcher assigns a car to answer the hall call. Passengers board the car and the car closes its doors after some preset time or as the car load reaches a preset limit. The car load is recorded and sent by the DCSS to the MCSS as the car closes its doors. The car load is converted to passenger counts and sent by the MCSS to the OCSS and then from the OCSS to the GCSS. The GCSS collects the passenger count data for each three minute period and uses it to predict the boarding counts at the lobby for a next determined period, i.e., the next three minute period. However, another time period may be chosen. The prediction may be done using single exponential smoothing or linear exponential smoothing models as described in U.S. Pat. No. 4,838,384 of Kandasamy Thangavelu entitled Queue Based Elevator Dispatching System Using Peak Period Traffic Prediction assigned to Otis Elevator Company which is incorporated herein by reference. This is known as real time traffic prediction.

a. Selecting Number of Cars Assigned to Lobby and Dispatching Cars to Lobby

Figure 5:
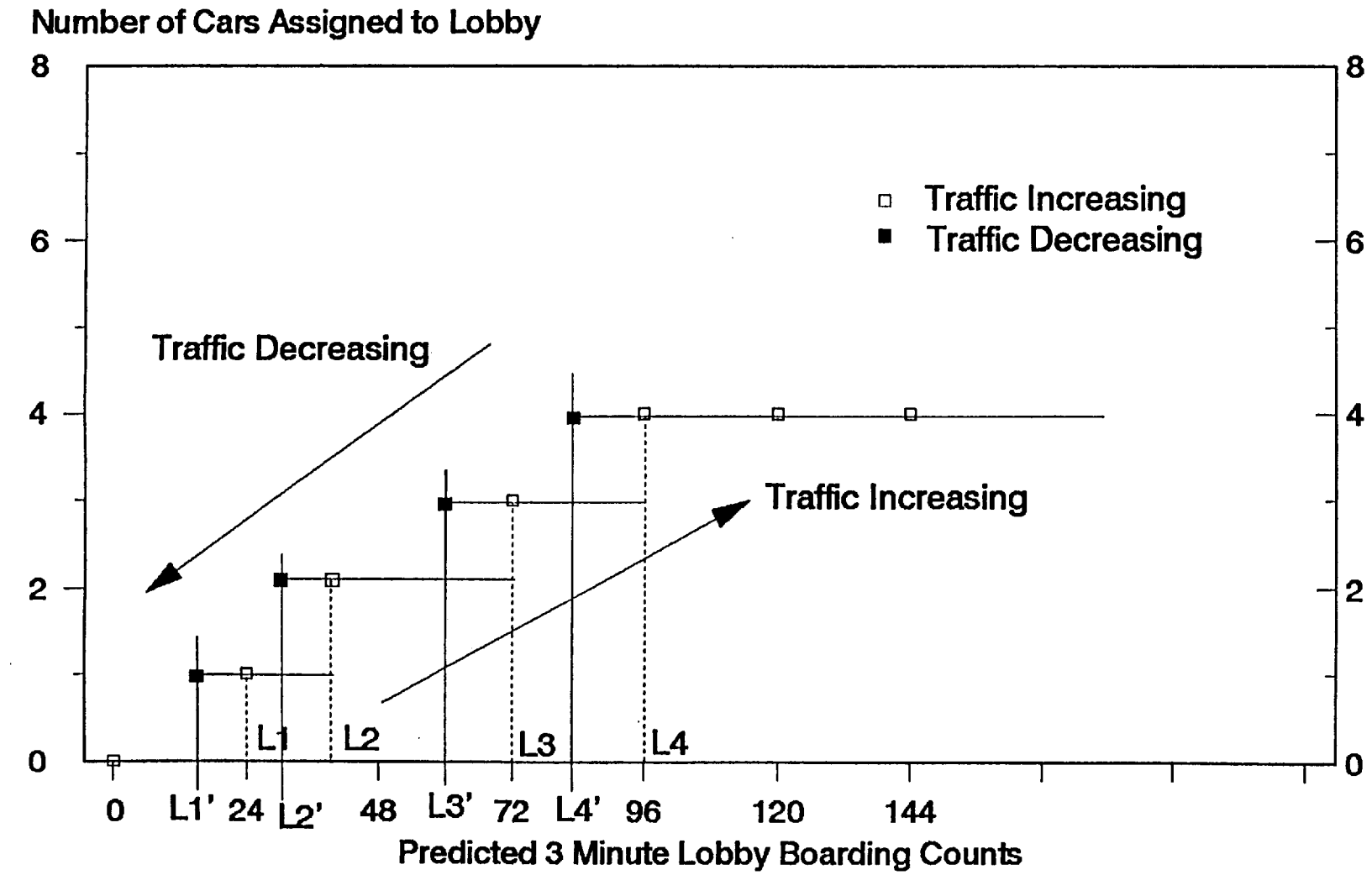
FIG. 5 is a graphical illustration showing a number of cars assigned to the lobby with respect to traffic levels.

Referring to FIGS. 4 and 5, the number of cars assigned to the lobby are dependent upon the predicted traffic. If the predicted traffic for a given period, e.g., three minutes, rises to a traffic threshold L1, L2, L3, L4 then the number of cars assigned to the lobby are increased as is explained below. If the predicted traffic for a given period falls below a traffic threshold L1', L2', L3', L4' then the number of cars assigned to the lobby is decreased as is also explained below.

If an actual traffic for the given period is low and thus the predicted lobby single source traffic is low (<L1), for example, less than 1% of the building population, the dispatcher assigns cars to the lobby only after a hall call is registered at the lobby.

If the predicted traffic is more than L1, e.g., >1% of the building population, but less than L2, e.g., <2% of the building population, and the average car load of the cars leaving the lobby during the period is, for example, at least 25% of car capacity, the dispatcher will assign one car to the lobby. As a car opens its doors at the lobby to answer the primary direction hall call, another car will be dispatched to the lobby. Thus, passengers arriving at the lobby after a boarded car leaves the lobby will not have to wait for a long time.

If the predicted traffic reaches another threshold, L2, e.g., 2% of the building population, but less than L3, e.g., 3% of building population, and at least two cars leave the lobby within the period with an average load, for example, of at least 35% of car capacity, then the dispatcher assigns two cars to the lobby. Accordingly, as a car opens its doors at the lobby to answer a hall call, the dispatcher determines if two other cars are either available at the lobby or traveling to the lobby. If this condition is not met, the dispatcher computes the car travel time from the current car positions to the lobby for each car. The dispatcher then selects one or two cars which could reach the lobby in the shortest time period, as appropriate. These two cars are assigned and sent to the lobby.

If the group contains more than four cars, the predicted traffic exceeds another threshold L3, e.g., 3% of building population, and at least three cars leave the lobby in three minute period with an average load, for example, of 40% of the car capacity, then the dispatcher assigns three cars to the lobby. Accordingly, if a car opens its doors at the lobby to answer a hall call, the dispatcher determines if three other cars are either available at the lobby or traveling to the lobby. If not, one, two, or three cars that could reach the lobby in the shortest time period are identified and sent to the lobby, as needed.

In systems having three or four cars in the group, a maximum of two cars will be assigned to the lobby. If the group contains five or six cars, a maximum of three cars will be assigned to the lobby. If the group contains seven or eight cars, a maximum of four cars will be assigned to the lobby. Accordingly, in systems having seven to eight cars in the group, a predicted traffic threshold of L4 is used to assign four cars to the lobby.

The above-mentioned methodology of assigning multiple cars to the lobby as the predicted traffic increases provides the advantage of assuring a steady supply of cars to the lobby. Thus, as traffic increases, the hall call registration time, passenger waiting time and lobby queue are kept small.

The traffic thresholds L1, L2, L3 and L4 at which the number of cars assigned to the lobby should be increased are learned by the dispatcher. Whenever the dispatcher assigns a car to answer a lobby up hall call, the dispatcher determines and records if a car was then available at the lobby or decelerating to the lobby. In a preferred embodiment, if a car was not available at the lobby or decelerating to the lobby more than once in three car assignments, the dispatcher records and sets the predicted traffic for the next period as the traffic threshold L1, L2, L3 or L4 for increasing the number of cars assigned to the lobby. Therefore, if no cars were previously assigned to the lobby then the traffic threshold L1 is set to the predicted traffic for the next period, and as a result one car is assigned to the lobby. If one car was previously assigned to the lobby then L2 is set to the predicted traffic for the next period, and as a result two cars are assigned to the lobby. If two cars were previously assigned to the lobby then L3 is set to the predicted traffic for the next period . . . etc.

The newly recorded values for L1, L2, L3 and L4 are used with previously recorded or predicted values of these thresholds to get the predictions for subsequent use, using a known exponential smoothing technique.

Decreasing Number of Cars Assigned to Lobby

If the predicted traffic for the next period decreases below some thresholds, the number of cars assigned to the lobby will be decreased. For example, the number of cars assigned to lobby will be set to three at a predicted traffic below L4' of building population; to two at a predicted traffic below L3'; to one at a predicted traffic below L2' and to zero at a predicted traffic below L1'. The values of L1', L2', L3', L4' are lower than L1, L2, L3 and L4 to decrease oscillations in switching the number of cars assigned to lobby.

The traffic thresholds L1', L2', L3', and L4' at which the number of cars assigned to the lobby should be decreased is learned by the system. The dispatcher identifies when two or more cars are stopped at the lobby with doors closed for more than a predetermined time, for example 10 seconds, so that the dispatcher can adjust the traffic threshold to decrease the number of cars assigned to the lobby. Accordingly, if two or more cars are stopped at the lobby with doors closed for more than 10 seconds and thus two cars are idle for more than 10 seconds, the dispatcher records the predicted traffic for the next period and sets the traffic threshold L1', L2', L3' or L4' to the recorded predicted traffic for the next period. If there are four cars assigned to the lobby, the traffic threshold L4' is set to the predicted traffic level for the next period; if three cars assigned to the lobby, the traffic threshold L3' is set to the predicted traffic level for the next period; and if there are two cars assigned to lobby, the traffic threshold L2' is set to the predicted traffic level for the next period. Similarly, the dispatcher records if there is one car parked at the lobby with no hall call registered for more than 60 seconds, thus the car is idle for more than 60 seconds, so that the dispatcher sets the predicted traffic for the next period as the traffic threshold L1'.

The currently recorded values of L1', L2', L3' and L4' are combined with the previously recorded values of L1', L2' L3', and L4' to obtain the predictions for next time, using a known exponential smoothing technique. The number of cars assigned to the lobby is decreased by one when the particular car idle time condition and the traffic condition have both been met.

b. Determining the Service Mode

Selecting Scheduled Service Mode

The dynamic scheduling elevator dispatcher, as described above, has the capability to change between service types; namely, between demand service mode and scheduled service mode. During demand service mode, the dynamic scheduling elevator dispatcher assigns cars to lobby hall calls on demand after a hall call is registered. During scheduled service mode, the dynamic scheduling elevator dispatcher assigns cars at a schedule interval irrespective of the presence of a hall call at the lobby. The type of service is changed, in real time, based on anticipated traffic. For example, the dynamic scheduling elevator dispatcher changes the service mode from demand service mode to scheduled service mode if the predicted lobby traffic for the next period reaches a threshold, e.g., S, as shown in FIG. 4. In one embodiment, S is of the order of 3 to 3.5% of building population.

The traffic threshold S at which the service mode changes to scheduled mode is learned by the dynamic scheduling elevator dispatcher. The dynamic scheduling elevator dispatcher identifies when a car is assigned to a lobby hall call after hall call registration. The dynamic scheduling elevator dispatcher also identifies and records the car load when the car closes its doors and a dwell time for which doors remained open for that car. If the dwell time was more than a limit, e.g., 15 sec., and car load was less than, for example, 35% of capacity, the car is recorded at lightly loaded car. If a car opens its doors and the passengers quickly board the car such that the car reaches a load limit of more than 35% within 15 seconds dwell time, the car is recorded as a significantly loaded car. If two successive cars reach more than 35% load within 15 seconds dwell time, then the corresponding predicted traffic is used as the traffic threshold S at which the service mode is changed to scheduled mode. Alternately, if two out of three cars reach 35% load within 15 seconds of dwell time, the corresponding predicted traffic is used as threshold, S. The corresponding predicted traffic is the currently recorded traffic prediction for the next determined period. The currently recorded value of S is used with the previously recorded or predicted value of S, to predict the next traffic threshold S, using a known exponential smoothing technique.

Switching to Demand Service Mode

When the predicted traffic decreases below a second threshold, S' which is lower than S, the dispatcher deactivates the scheduled service mode of operation. Thus, service is provided to the lobby on demand and a car is assigned to a lobby hall call after the hall call is registered. In one embodiment, S' is of the order of 2% to 3% of building population.

The dynamic scheduling elevator dispatcher has the capacity to learn the traffic threshold S' at which it switches to demand mode. The dynamic scheduler records a car available time at the lobby. The car available time is defined as the time when the car opens the door, if the car is empty. If the car has deboarding passengers when it opens it doors, the car available time is defined as the time when all passengers have deboarded the car. The dynamic scheduling elevator dispatcher also records the time when the first passenger boards the car and registers a car call. The dynamic scheduling elevator dispatcher then calculates the interval between the first car call registration time and the car available time. If this interval is more than 10 seconds and the car load as the car closes its door is less than 25% of capacity, then the dynamic scheduling elevator dispatcher records that a low traffic condition exists. If the low traffic condition occurs for two consecutive cars, the corresponding predicted traffic is recorded as S'. The currently recorded traffic value is used with previously recorded or predicted value of S', to get the next predicted value using a known exponential smoothing technique. The service is switched to demand mode when the predicted traffic has dropped below S'.

c. Selecting the Schedule Interval

Figure 6:
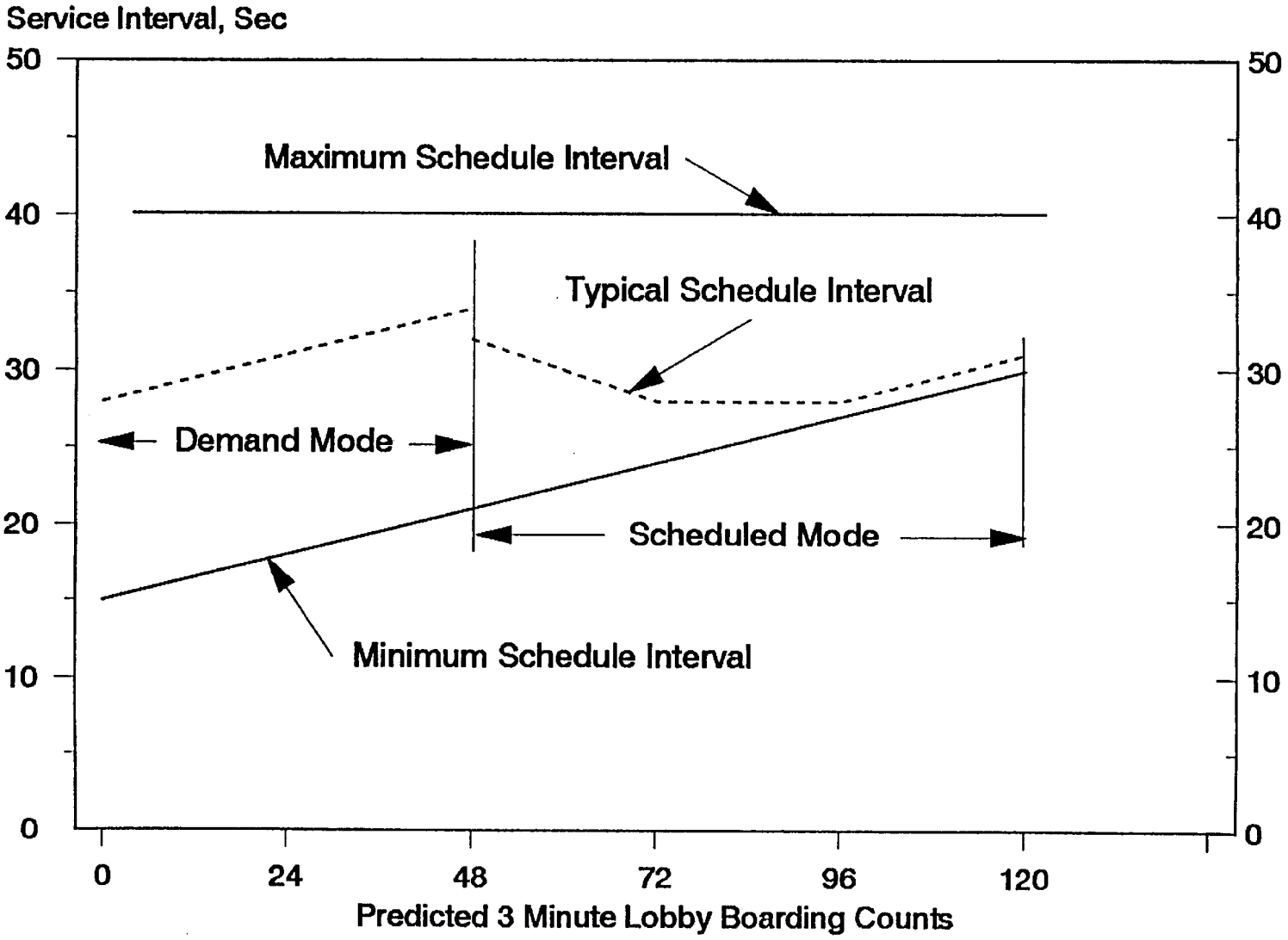
FIG. 6 is a graphical illustration showing a variation of service interval between cars at the lobby as demand and scheduled modes of service are used.

Referring to FIG. 6, a service interval is defined as the time interval between the time when a car is available for passenger boarding at the lobby and the time when the next car is available for passenger boarding at lobby. The service interval can be measured during both the demand service mode and the scheduled service mode. FIG. 6 shows the variation of the service interval between successive cars assigned to hall calls at the lobby. In demand mode, the service interval between cars depends on the passenger arrival rate and lobby dwell times. As the traffic volume increases the boarding process takes more time, but a hall call is registered shortly after the boarded car leaves the lobby. The interval between successive cars assigned to the lobby varies randomly, due to the random passenger arrival process. Accordingly, the service interval also varies randomly in demand service mode.

When the dispatcher switches to scheduled service mode, the service interval is controlled by assigning cars such that they are available for passenger boarding at regular intervals. The service interval in this mode is called the schedule interval. Accordingly, the schedule interval is the interval between the scheduled time when a car is made available for passenger boarding at a floor and the scheduled time when the next car is made available for passenger boarding at the floor. Initially, the schedule interval selected is the average interval between cars that departed the lobby during the past short time period, e.g., three minute period. Alternately, a schedule interval may be selected to minimize hall call registration time and passenger waiting time at the lobby. Thus, a schedule interval of 40 seconds may be initially selected.

Figure 7:
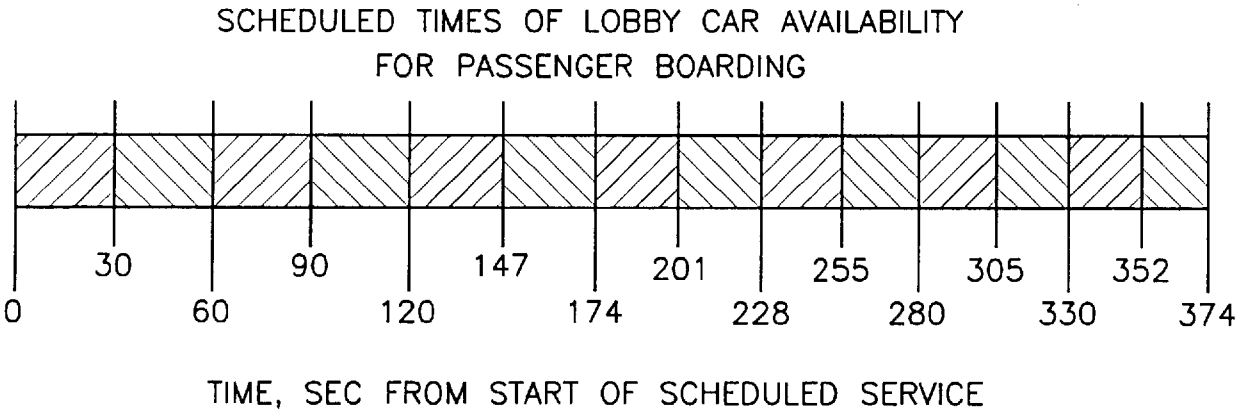
FIG. 7 is a time line showing a concept of lobby car assignment scheduling during scheduled service using determined regular schedule intervals.

Referring to FIG. 7, the dynamic scheduling elevator dispatcher uses the schedule interval to compute a next scheduled time to dispatch a car to the lobby. If a hall call is registered at the lobby, a car will open its doors only if the time is reached. This causes the passengers to queue up at the lobby waiting for cars. Therefore, as the car opens its doors, and becomes available for boarding several passengers board the car quickly and the boarding time is short. This allows the car to reach a preset load limit quickly and leave the lobby. Thus, the car does not have to wait for passengers with its doors open for an extended period of time.

As shown in FIGS. 6 and 7, the schedule interval is initially decreased with an increase of predicted traffic. This inverse relationship between the schedule interval and the predicted traffic is chosen because increased traffic causes the cars to reach a preset load limit faster which in turn causes the cars to leave the lobby quickly and hall calls are registered quickly after the cars close their doors. Additionally, when the system predicts higher traffic, it reduces the schedule interval, to keep the car load within desired threshold and to use the cars arriving at the lobby efficiently. Typically the desired load is 50% to 60% of car capacity so that stochastic passenger arrival is accommodated. For example, as the three minute predicted traffic volume increases from 3% to 6% of the building population, the dispatcher decreases the schedule interval from 30 seconds to 25 seconds.

When scheduled service is used and cars are assigned at the lobby to open doors at schedule intervals, the cars may come to the lobby before the scheduled time and wait to open their doors. Therefore, the cars are idling at the lobby for some time. As the traffic increases, the idling decreases because increased car load results in more car calls during up trips and thus increased round trip time. Thus, the interval between car arrivals at the lobby automatically increases. The increased interval results in decreased idle time. If the idle time is decreased to zero then the cars may not come quickly enough to service lobby hall calls and passengers must wait for the arrival of a car. If this happens, the schedule interval is increased by the dispatcher so that the car load is increased for each car.

The maximum schedule interval determines the lobby maximum hall call registration time and passenger waiting time. Thus, in one embodiment, a maximum schedule interval on the order of 40 seconds to 50 seconds is selected for the lobby depending on the number of floors in the building, number of cars in operation, and relative levels of single source traffic and non-lobby traffic. The minimum schedule interval depends on the average round trip time and the number of cars in operation. For example, if the average round trip time is 150 seconds and there are 6 cars in operation, the minimum interval possible is 25 seconds. To allow for stochastic car arrivals at the lobby, a schedule interval of 30 seconds may be used.

In one embodiment, the dispatcher collects the lobby traffic data for each minute and updates the three minute counts at the end of each minute. Accordingly, the dispatcher updates its predictions once a minute. The predicted traffic is used to predict the average number of car calls for up trips and thus the average round trip time. Therefore, the schedule interval can be varied at the end of each minute, based on the computed round trip time.

In another embodiment, the dispatcher collects the hall call registration times of lobby hall calls for each three minute period so that the dispatcher can predict the hall call registration time for the next three minute period. The predicted three minute average lobby hall call registration times can be used to compute the next schedule interval. The schedule interval can be selected from the interval based on average round trip time and/or the computed interval based on predicted hall call registration time. The selected schedule interval and predicted traffic determine the predicted load of the car when it leaves the lobby; the computation of which can be made by one skilled in the art of dispatching.

The assigning of cars to the lobby hall call at regular intervals provides the advantages of decreasing the lobby crowd, the duration of the lobby crowd, the average passenger waiting time at the lobby and the maximum passenger waiting time at the lobby. The variance in car loads of cars leaving the lobby is also decreased, resulting in decreased variance in the round trip time of cars; thus, regularity of car arrivals at the lobby is achieved.

When scheduled service is used, if a car comes to the lobby and opens doors to allow passengers to exit in response to a car call, it does not light the hall lantern unless it is assigned to the lobby and the scheduled time has been reached. If a passenger boards an unassigned car and a presses a car call button, the car call is not registered and the button lights do not turn on. Thus, passengers cannot use cars that are not assigned to lobby hall calls.

d. Schedule Window and Schedule Tolerances

When the traffic in the building increases and there is significant traffic at floors other than the lobby, the cars may come to the lobby before the scheduled time and stand idle until the scheduled time. Alternatively, the cars may come after the scheduled time and may be immediately assigned to a lobby hall call. In either case, the passenger waiting time and lobby queue may be large. In order to use the cars efficiently, it is desirable to assign the cars to the lobby hall call immediately if the car arrives within a short time before its scheduled time.

Furthermore, in buildings with significant interfloor and counterflow traffic, and in buildings with cafeteria floors, a secondary lobby or a basement with significant traffic, the priority assignment of some cars to the lobby provides poor service at other floors, resulting in large registration times and repeated hall call reassignments at those floors. The above-mentioned problems can be ameliorated by selecting schedule windows for car assignment to the lobby.

The schedule window is defined in terms of a lower and an upper tolerance around the scheduled time. For example, if a 25 seconds schedule interval is used, a lower tolerance of 5 seconds and an upper tolerance of 10 seconds may be selected. The schedule interval modified by the schedule window in this example ranges from 20 seconds to 35 seconds. By allowing the car to come to the lobby within the schedule window, car assignments at other floors are better accommodated. Cars do not have to come to the lobby before the scheduled times and wait for being assigned at specific times.

Figure 8:
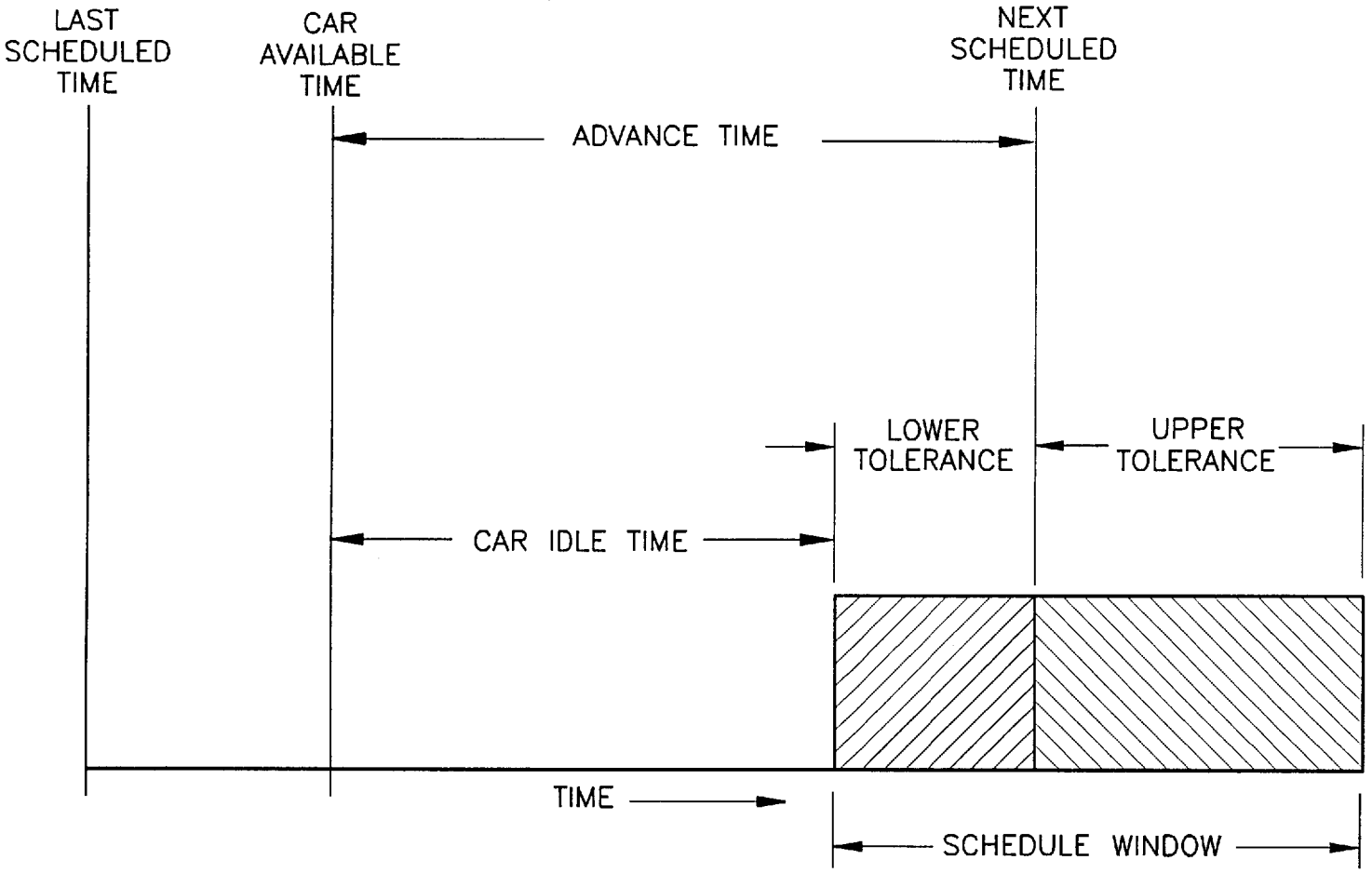
FIGS. 8 and 9 are time lines showing concepts of schedule windows, schedule tolerances, car idle time, car advance time and car delay time.
Figure 9:
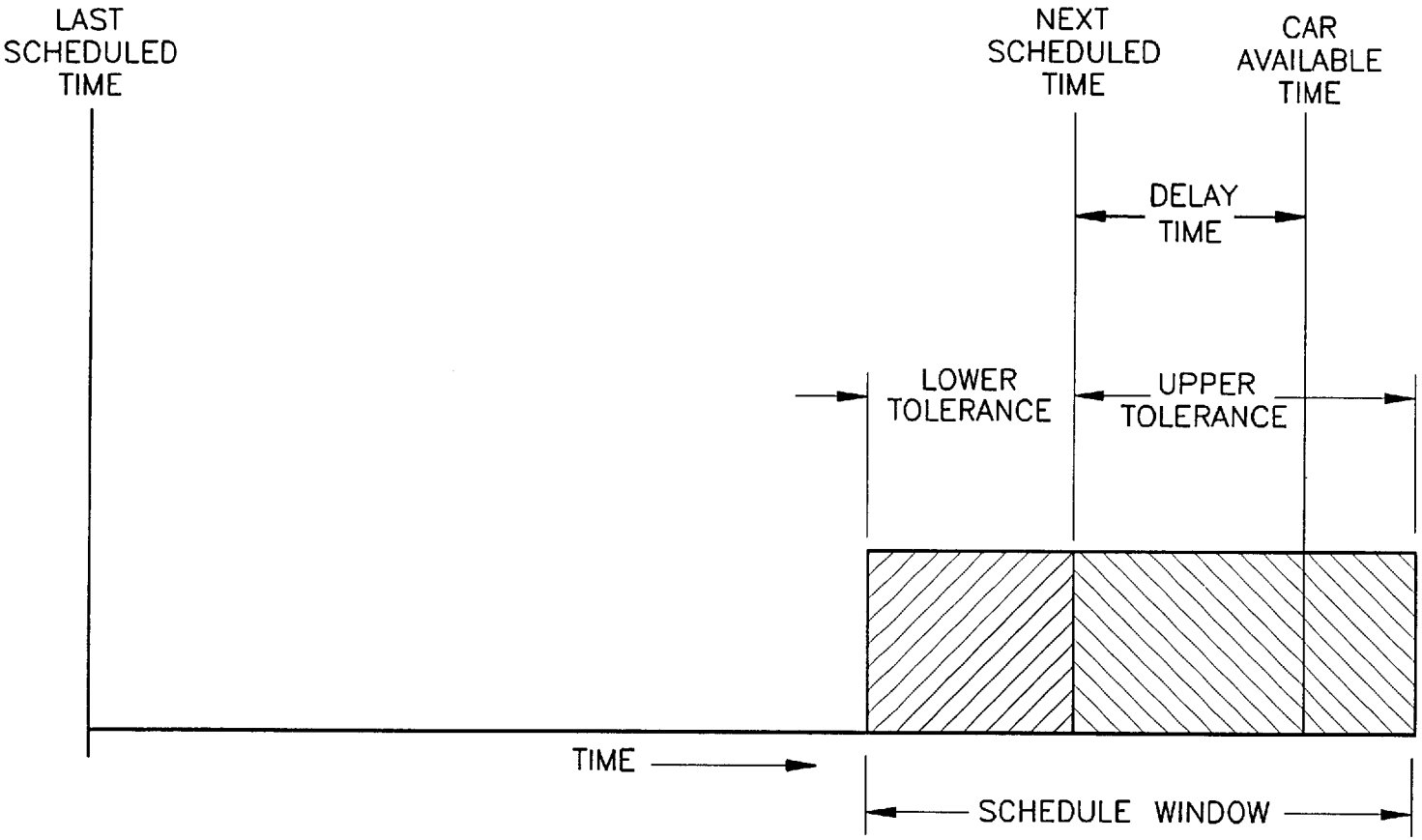
Figure 10:
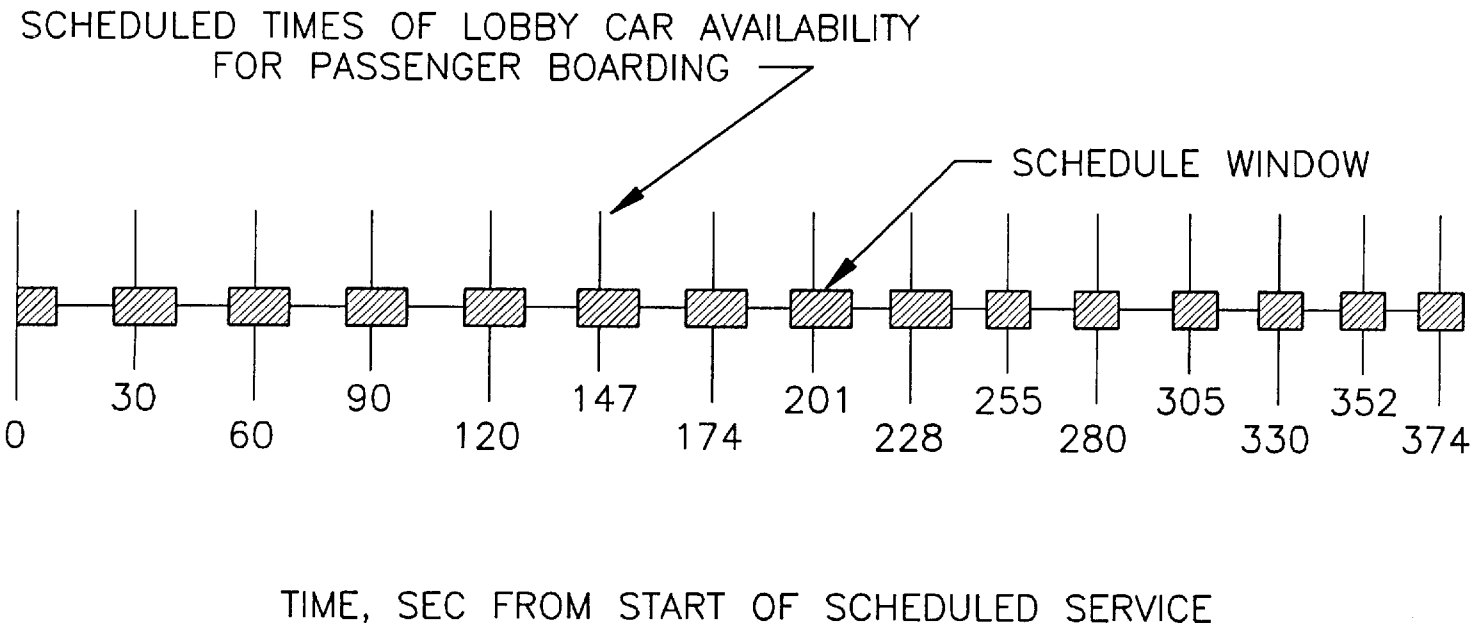
FIG. 10 is a time line showing the schedule window around scheduled times.

FIGS. 8 and 9 show the concepts of scheduled time and schedule window. FIG. 10 shows lobby car assignment in scheduled service mode using schedule windows. The use of schedule windows and scheduling car arrival process at the lobby within the windows improves service to hall calls at floors above the lobby and below lobby, reducing their registration times and hall call reassignments. The maximum passenger waiting time is thus decreased. At the same time, by assuring car arrivals within the schedule window, the lobby waiting times, crowds and the duration of crowds are kept low. The cars are better utilized to provide balanced service to all hall calls in the building.

In order to implement the schedule window, the lower and upper tolerances are selected based on predicted lobby traffic and predicted highest hall call registration times for three categories of traffic. The categories include traffic at the lobby in the primary direction, traffic at all other floors in the primary direction and traffic at all floors in the secondary direction. The upper tolerance may or may not be the same as the lower tolerance.

In one embodiment, the lobby hall call registration times and hall call registration times for floors other than the lobby are recorded for three minute periods. Accordingly, the highest hall call registration times are recorded and the highest hall call registration times for the next three minute period are predicted for each of the three categories of traffic using a known exponential smoothing technique.

The allowable maximum hall call registration times are separately selected for each of the three categories. The allowable maximum hall call registration time at the lobby for the primary direction is limited to a relatively small time, for example 40 sec or 50 seconds, because the lobby traffic is heavy and large delays in car assignments to the lobby could result in a large lobby crowd and long persistence of the lobby crowd.

However, the allowable maximum hall call registration time for traffic at all other floors in the primary direction is typically higher than that of the lobby allowable maximum registration time in the primary direction because during up peak and noon time, cars make frequent stops for car calls at floors in the primary direction of the single source traffic. Accordingly, the primary direction hall call maximum registration time is typically between 50 to 60 seconds.

The allowable maximum hall call registration time for traffic at all floors in the secondary direction is also typically higher than that of the lobby allowable maximum registration time in the primary direction. There is negligible traffic in the secondary direction during up peak and thus the allowable maximum registration time for secondary direction hall calls is of the order of 50 to 60 seconds. However, during noon time often there is significant secondary direction traffic when the majority of the traffic is in the primary direction. The significant secondary traffic requires lower allowable maximum hall call registration times for secondary traffic.

The schedule window is selected by comparing the predicted highest hall call registration time against the allowable maximum registration times. The differences between the allowable maximum and the predicted highest values are used to select the lower and upper tolerances at the lobby and the schedule window.

If the lobby traffic is low, for example less than 3% of building population, and the predicted highest hall call registration times for other than primary direction lobby traffic are short and less than the allowable maximum registration time selected, then the tolerances selected are small, of the order of 5 seconds.

However, if the predicted highest hall call registration times for non-lobby primary direction traffic exceed the allowable maximum hall call registration times for non-lobby primary traffic, larger lower and upper tolerances are selected. The actual values selected are dependent on the difference between predicted highest hall call registration times and allowable maximum registration times. For example, if the difference is less than 10 seconds for primary or secondary direction hall calls, the lower and upper tolerances may be 5 and 7 seconds respectively. If the difference is more than 10 seconds but less than 20 seconds, then the lower and upper tolerances may be 7 and 10 seconds respectively. If the difference further increases for primary or secondary direction hall calls, then the allowable maximum hall call registration times for non-lobby primary direction hall calls are increased. In one embodiment, a look up Table similar to Table 1 is used to select the schedule tolerances. This Table is generated by using off-line simulations; the methodology of which is known to one skilled in the art of elevator dispatching.

TABLE 1

Selection of Lower and Upper tolerances of schedule window based on predicted and allowable maximum hall call registration times.

| Lobby Schedule Interval | Difference Between Predicted and Allowable Maximum Hall Call Registration Times | Lower Tolerance | Upper Tolerance |
|---|---|---|---|
| 30 | 0 or negative | 5 | 5 |
| | <10 | 5 | 7 |
| | <20 | 7 | 10 |
| | >20 | 7 | 12 |
| 40 | 0 or negative | 5 | 5 |
| | <10 | 8 | 12 |
| | <20 | 10 | 14 |
| | >20 | 12 | 15 |
| 50 | 0 or negative | 8 | 12 |
| | <10 | 8 | 12 |
| | >10 | 12 | 15 |

In assigning cars to primary or secondary direction hall calls and for lobby service, the number of occurrences that hall call registration times exceed the allowable maximum hall call registration time for that category of hall calls is recorded when the hall call is answered. This information is used to modify the allowable maximum hall call registration times. For example, if the allowable maximum registration time for primary direction hall calls at floors other than the lobby is violated repeatedly, the allowable maximum registration time will be increased for primary direction hall calls for the lobby and other floors. If the allowable maximum hall call registration time for secondary direction hall calls is violated repeatedly, the primary direction allowable maximum hall call registration time at the lobby and other floors will be increased. If the lobby allowable maximum hall call registration time is violated repeatedly, the schedule interval is increased, thus increasing the car load of the cars leaving the lobby.

If the schedule window is used and the scheduled times are independent of schedule tolerance, then the maximum interval between two successive cars will be $(ti+\Delta tu)-\Delta tl$ where ti is the schedule interval, $\Delta tu$ is the upper tolerance and $\Delta tl$ is the lower tolerance. This maximum interval occurs when one car comes before the schedule window and can open doors $\Delta tl$ before scheduled time and the next car comes $\Delta tu$ seconds after its scheduled time. Thus, the selected tolerances affect the car load, lobby queue and waiting times. The higher the tolerances, the higher the variation in car loads. High tolerances also cause longer waiting times and larger lobby crowds to occur. Thus, it is necessary to keep the tolerances small.

The minimum interval between cars occurs if the first car is assigned $\Delta tu$ seconds after scheduled time and the second car comes before the scheduled time and is assigned $\Delta tl$ seconds before the scheduled time.

To reduce the variation in car loads, whenever a car is assigned to a hall call at the lobby, the next scheduled time and successive scheduled times are updated using the selected schedule interval. Accordingly, the successive scheduled times will be ta, ta+ti, ta+2ti . . . etc., where ta is the time when the current car is available for passenger boarding, after assignment to a hall call and passenger deboarding. If the next car comes earlier than scheduled and is assigned at $ta+ti-\Delta tl$, then that time will be used as the next scheduled time, and successive scheduled times updated. Similarly if the car is assigned at any time within the schedule window between $ta+ti-\Delta tl$ to $ta+ti+\Delta tu$, that time is used as the next scheduled time and successive scheduled times updated. This process keeps the minimum interval between the cars at $ti-\Delta tl$ and the maximum interval at $ti+\Delta tu$. Therefore, the variation in car load is kept small.

Lobby Car Arrival Scheduling

The dispatcher determines the farthest floor in the primary direction and a car arrival time at the farthest floor on the car's trip in the primary direction. If the car is assigned to primary direction hall calls, the probable car call stops due to these hall calls are determined and used in computing car arrival time at the farthest floor. If the car is assigned to secondary direction hall calls, the car arrival time at the hall call floors is computed. The probable car call stops due to the secondary direction hall calls are determined and car arrival time at the floors computed. Finally, the car arrival time at the lobby is computed. If the car arrives empty to the lobby, it is available for boarding immediately after it opens its doors. If the car carries passengers to the lobby, first it opens doors and lets deboarding passengers off, thereafter the car is available for passenger boarding at the lobby.

The car travel times vary with duty speed, acceleration, interfloor distances, the car call stops to be made, the hall calls assigned and estimated car call stops caused by assigned, but unanswered, hall calls.

In assigning cars to primary direction hall calls made at floors other then the lobby, first preference is given to the cars having coincident car call stops at those floors, within a certain waiting time limit. Then, cars not assigned to the lobby are considered. Finally, cars assigned to the lobby are evaluated. A car already assigned to the lobby while still going in the primary direction, can be considered for primary direction hall calls made at floors other than the lobby only if the car has idle time at the lobby and will arrive at the lobby within the schedule window or another car is available to be assigned to the lobby within the schedule tolerance.

For secondary direction hall calls, first the cars unassigned to the lobby are considered. Then cars assigned to the lobby are considered, if they have advance time and will arrive at the lobby within the schedule window or if another car is available to be assigned to the lobby within the schedule window.

For performing this evaluation, the scheduler maintains a schedule of car arrival times at the lobby and the associated cars arriving at that time, as shown in Table 2. This schedule is compared against the lobby car assignment schedule, Table 3. If a car arrives before its scheduled time, the advance time is computed as the difference between scheduled time and car available time. If the car arrives after the scheduled time, the car delay time is computed as the difference between car arrival time and scheduled time. These values are computed for each car eligible for assignment to the lobby schedule and saved in a Table as shown in Table 4. Lobby car assignment and assignment of cars to primary and secondary direction hall calls at floors other than the lobby can be accomplished using Table 4, so that the cars assigned to the lobby arrive within the schedule window.

TABLE 2

Schedule of Car Arrival Times at Lobby

| Car Arrival Time At Lobby, seconds | Car Number |
|---|---|
| 80 | 3 |
| 95 | 5 |
| 109 | 2 |
| 121 | 1 |
| 139 | 0 |
| 158 | 4 |

TABLE 3

Lobby Schedule Window

| Lobby Next Scheduled Time | Schedule Window: Earliest Available Time at which a Car Can Be Assigned | Schedule Window: Latest Available Time at Which a Car Can Be Assigned |
|---|---|---|
| 90 | 80 | 105 |
| 120 | 110 | 135 |
| 147 | 139 | 163 |
| 174 | 166 | 190 |
| 201 | 193 | 217 |

TABLE 4

Computation of Advanced Time and Delay Time for Lobby Arriving Cars

| Next Scheduled Time | Car Number | Advance Time, sec. | Delay Time, sec. |
|---|---|---|---|
| 90 | 3 | 10 | — |
| | 5 | — | 5 |
| 120 | 5 | 25 | — |
| | 2 | 11 | — |

TABLE 4-continued

Computation of Advanced Time and Delay Time for Lobby Arriving Cars

| Next Scheduled Time | Car Number | Advance Time, sec. | Delay Time, sec. |
|---|---|---|---|
| | 1 | — | 1 |
| 147 | 2 | 38 | — |
| | 1 | — | 26 |
| | 0 | 8 | — |
| | 4 | — | 11 |

When there are several cars available at the lobby, some of the cars will not be required for lobby service in the near future and will have large advance times. These cars may be assigned to non-lobby hall calls. This method of assigning cars to the non-lobby hall calls provides the advantages of reducing lobby bunching and reducing hall call registration times at other than the lobby.

e. Lobby Schedule Delays

In order to prevent oscillations between demand and scheduled mode, the dispatcher uses suitable delays. In one embodiment, if the predicted traffic is significantly more than S, for example S is 3% and predicted traffic is more than 3.5% of building population, the scheduled service mode is activated immediately. If the predicted traffic is less than 3.5% and more than 3%, the dispatcher waits for one more prediction at the end of the next minute. If the next prediction also confirms that predicted traffic is more than 3%, only then is the scheduled service mode activated. Similarly, when the traffic is decreasing, if the predicted traffic decreases for example from above 3% to 2% or less, then the scheduled service mode is deactivated immediately. If not, the dispatcher waits for two more predictions at one minute periods. Only if these predictions are less than 2.5%, the scheduled service mode is deactivated. Similarly, if the traffic drops rapidly from above 3.5% of building population, the dynamic schedule waits for one more prediction to confirm this low traffic level before going to demand mode.

Figure 11:
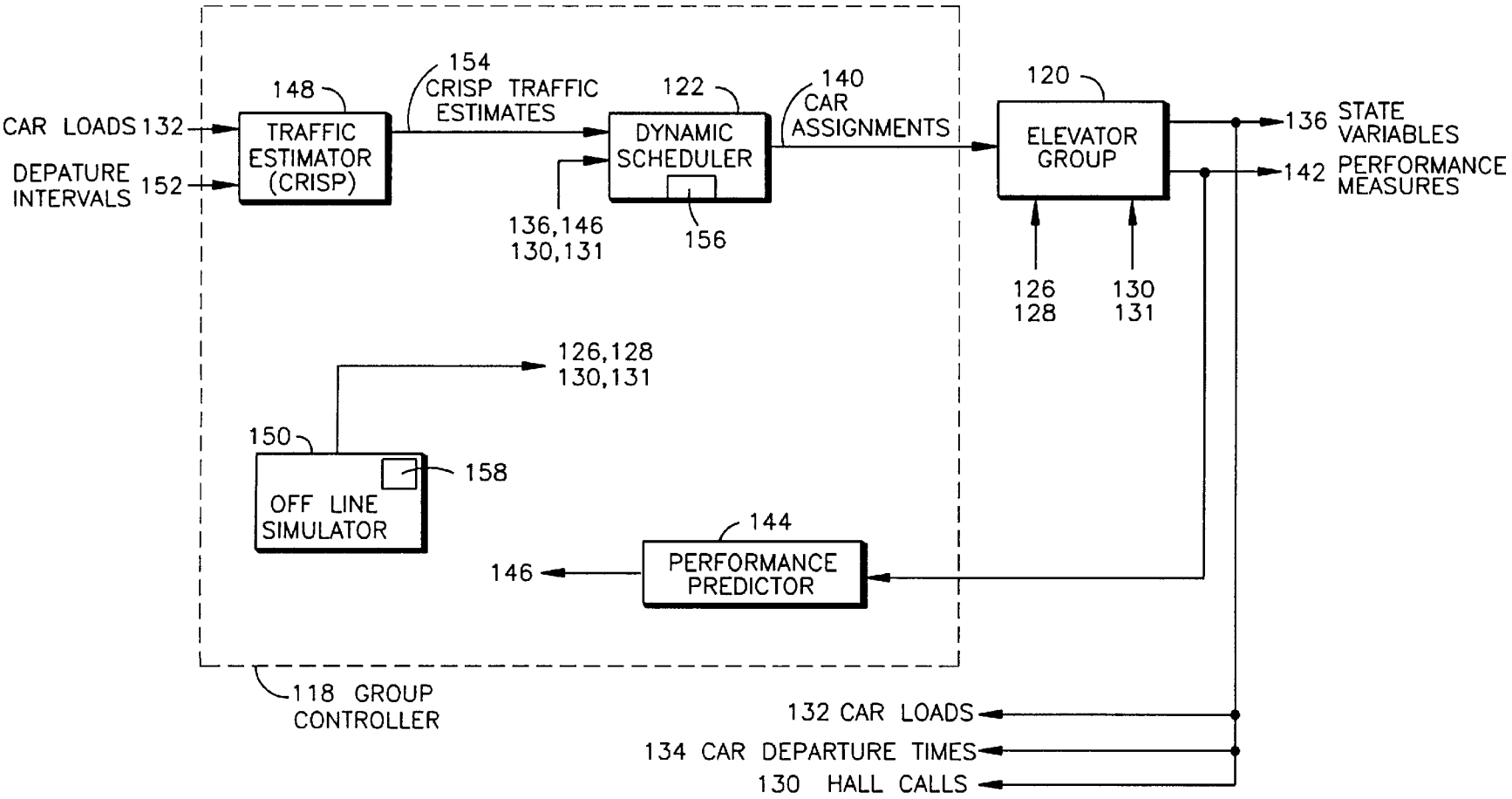
FIG. 11 is a simplified block diagram showing an elevator dispatcher of the group controller for implementing dynamic scheduling with crisp estimates of lobby traffic and traffic rate.

II Dynamic Scheduling Based on Estimates of Lobby Traffic and Traffic Rate and Off-Line Learning of Control Parameters FIG. 11 is a simple block diagram of the group controller 118 resident in the GCSS 101, which is used with this second method of implementing dynamic scheduler. The group controller comprises a dynamic scheduler 122, a traffic estimator 148, a performance predictor 144 and an off line simulator 150. The departure times 134 are used to compute the departure intervals 152 between cars leaving the lobby. The car loads 132 and the departure intervals 152 are used as inputs by the fuzzy logic based traffic estimator 148 to produce crisp estimates of lobby traffic and traffic rate as described hereinbelow. The dynamic scheduler 122 uses these traffic and traffic rate estimates 154, the other input signals 130, 131 and 136, and the performance predictions 146 made by the performance predictor to generate the values of various control parameters used in dynamic scheduling, using the on-line control parameter selector 156. The dynamic scheduler makes car assignment 140 using the control parameters and the dynamic scheduling logic. The group controller 118 is also provided with an off-line simulator to simulate the elevator group operation using predicted building traffic and select control parameters off-line using a learning methodology described below.

a. Use of Fuzzy Logic to Estimate Lobby Traffic and Traffic Rate

The second method of implementing the dynamic scheduling dispatcher develops real time estimates of lobby traffic and traffic rate using the car loads of cars leaving the lobby and the departure interval between successive cars leaving the lobby. The traffic rate is the rate of change of lobby traffic. A fuzzy set theory approach is used to develop these estimates. The estimates of lobby traffic and traffic rate are made using the fuzzy relationships that exist among car loads, departure intervals, lobby traffic and traffic rate. The lobby traffic and traffic rate are estimated as crisp values on a continuous spectrum. For example, the lobby traffic is estimated using a scale of 0 to 100 and the traffic rate is estimated using a scale of −50 to 50. The estimates of lobby traffic and traffic rate are made using the real time data collected on car loads and car departure times, whenever a car leaves the lobby in the primary direction with passengers.

The various dynamic scheduling control parameters, namely lobby service mode, number of cars assigned to the lobby, lobby schedule interval, schedule window tolerances scheduled mode activation and cancellation delays, and allowable maximum registration times, are first selected using off-line simulations and learning techniques as explained hereinbelow. The values selected for the control parameters are then used to generate look up Tables. The look up Tables and the estimates of lobby traffic and traffic rate made during elevator group operation are used to select the control parameter values for real time operation.

In one embodiment, fuzzy sets of car loads of up to three successive cars and departure intervals between those cars and corresponding preceding cars are used as inputs. The fuzzy sets of lobby traffic and traffic rate are used as outputs. Fuzzy rules connecting the inputs and the outputs are developed using approximate reasoning as used by human beings. The lobby traffic and traffic rate are then estimated from outputs of the rules using appropriate inference methods and a commercially available fuzzy logic development system software.

The loads of the cars leaving the lobby are categorized using fuzzy sets. The car loads are measured using load weighing devices and converted to load counts in the range of 0 to 255 by the DCSS. The actual load measured is represented as a percent of car duty load and then converted to a load count. A car load of zero represents an empty car, while a car load of 255 represents 127.5% of duty load. The DCSS sends this information to the MCSS, which in turn sends the information to the OCSS. The OCSS sends this information to the group controller.

Figure 12:
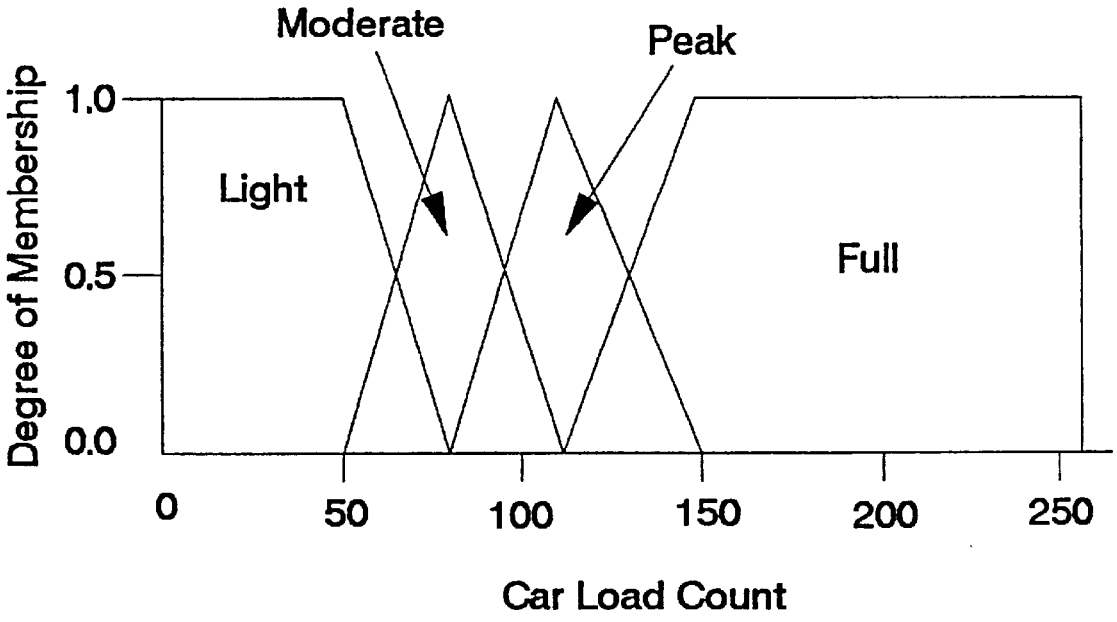
FIG. 12 is a graphical illustration of an example of fuzzy sets of carloads of the cars leaving the lobby and their membership functions.

A determined number of load categories are implemented. For example, four load categories are obtained by defining four fuzzy sets as: light, moderate, peak and full. The fuzzy sets differ from crisp sets. In a crisp set, a particular load such as 100 units either belongs to the set or does not. However, in the fuzzy set, a typical car load belongs to a set to some degree, known as membership function. When the car load is between 0 and 50 units it is light. When the car load is between 50 and 80, it is light to some degree and moderate to another degree. A car load of 100 units may be moderate to a degree of 0.4 and peak to a degree of 0.6. FIG. 12 shows the fuzzy sets for car loads of cars leaving the lobby and the corresponding membership functions. A higher or lower number of load categories can be chosen. For example, three to six fuzzy sets can be used to categorize the car loads. The membership functions can be specified using linear or non-linear functions.

Figure 13:
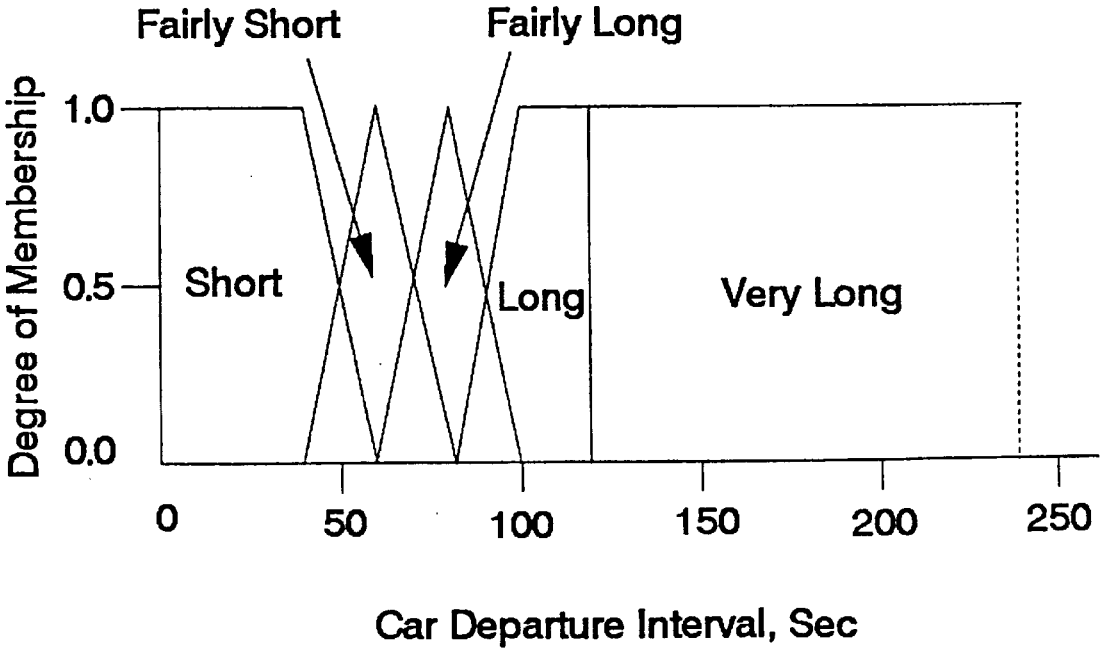
FIG. 13 is a graphical illustration of an example of fuzzy sets of car departure intervals and their membership functions.

When a car leaves the lobby with passengers, its departure time is compared with the departure time of the car that previously left the lobby with passengers. The departure interval between the cars is computed and the departure interval is categorized using three to six fuzzy sets, e.g., short, fairly short, fairly long, long and very long. FIG. 13 shows an example of fuzzy sets used to represent the departure interval between cars leaving the lobby with car loads. Again, a particular departure interval may be wholly in a fuzzy set or it may be in more than one set, to some degree.

Figure 14:
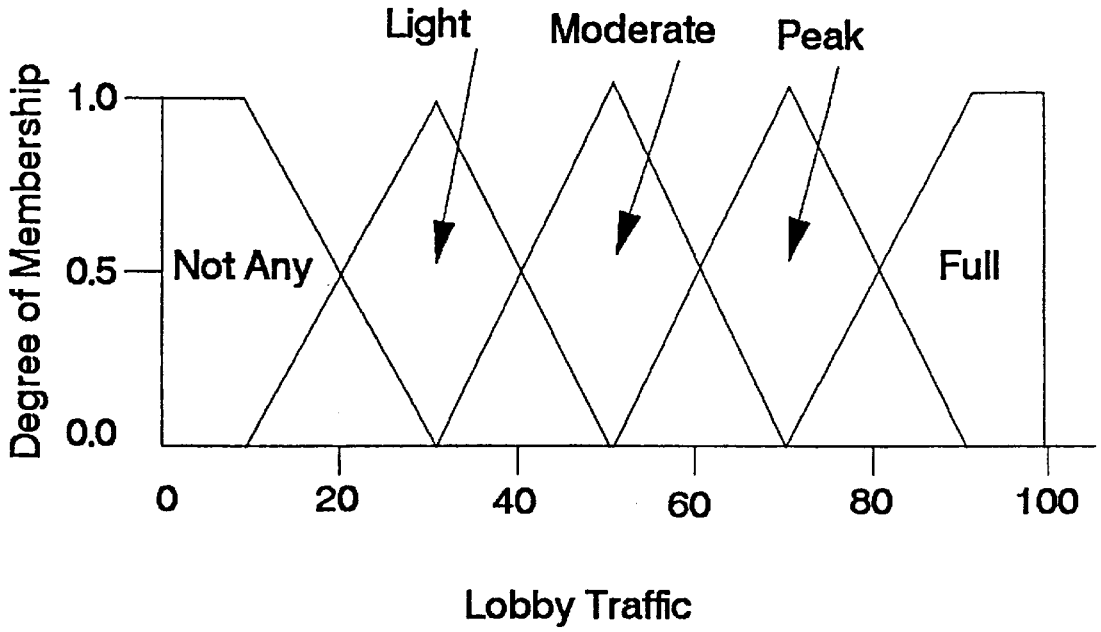
FIG. 14 is a graphical illustration of an example of fuzzy sets selected for lobby traffic and their membership functions.

The lobby traffic is represented by a scale of, for example, 0 to 100. It may also be represented using a scale of 0 to 255. The lobby traffic is categorized using fuzzy sets similar to car loads, e.g., not-any, light, moderate, peak and full. FIG. 14 shows an example of fuzzy sets and the membership functions used to categorize the lobby traffic. The category of not-any is used by the dispatcher to indicate that no car left the lobby with passengers during the past determined period, for example, two minutes.

Figure 15:
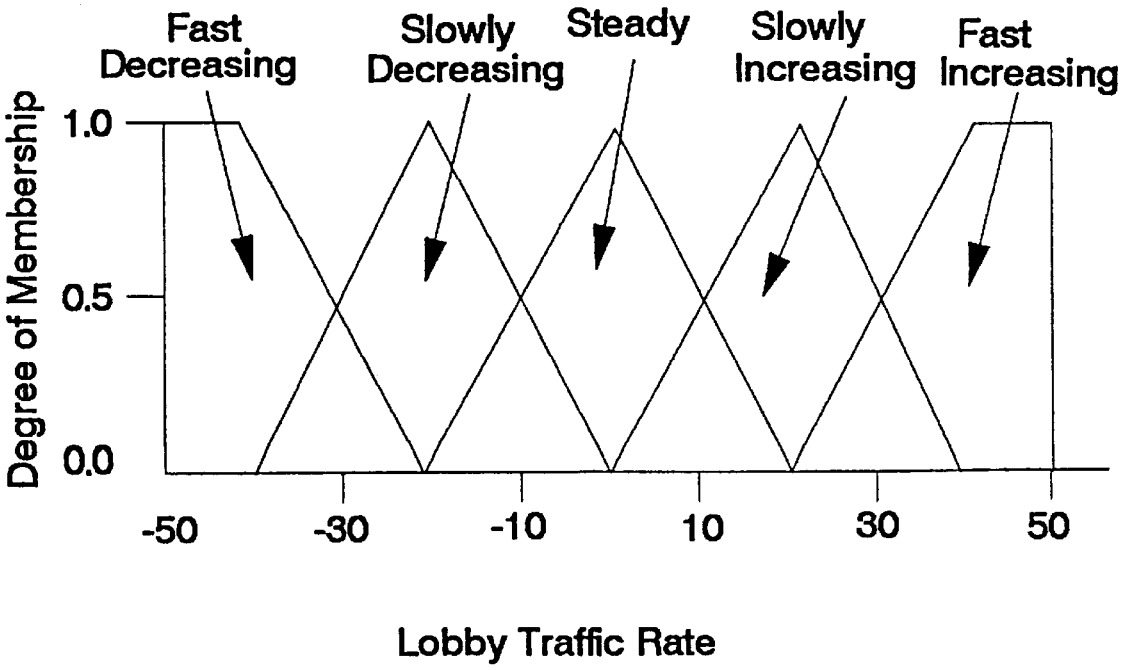
FIG. 15 is a graphical illustration of an example of fuzzy sets selected for lobby traffic rate and their membership functions.

The rate of change of incoming traffic at the lobby is represented using a scale of −50 to 50, as an example. The rate of change is categorized using the fuzzy sets of fast decreasing, slowly decreasing, steady, slowly increasing and fast increasing. FIG. 15 shows the fuzzy sets for the rate of change and the membership functions.

When the departure interval between a current car and a previous car is very long, of the order of more than two minutes, only the car load of the current car is used to estimate the lobby traffic and traffic rate. Table 5 shows an example of a determination of lobby traffic and lobby traffic rate when one car leaves the lobby with passengers and no car left the lobby with passengers during the previous determined period.

TABLE 5

Determination of lobby traffic when the car departure interval is very long (for example, 120 sec.)

| Current car load | Previous car load | Lobby traffic | Lobby rate of change of traffic |
|---|---|---|---|
| Light | ignored | light | steady |
| Moderate | ignored | moderate | steady |
| Peak | ignored | moderate | slowly increasing |
| Full | ignored | peak | steady |

Table 6 illustrates an example of determination of lobby traffic and traffic rate when a recent departure interval is short and a previous departure interval was not short, but instead was fairly short, fairly long or long. The recent departure interval is the departure interval between a recent car (car 3) to depart from the lobby and a previous car (car 2) to depart from the lobby. The previous departure interval is the departure interval between the previous car (car 2) to depart from the lobby and a second previous car (car 1) to depart from the lobby.

TABLE 6

Determination of lobby traffic and traffic rate when the recent departure interval is short, but previous departure interval is not short

| Current Car load (Car 3) | Previous Car load (Car 2) | Previous to Previous Car Load (Car 1) | Lobby Traffic | Lobby rate of change of traffic |
|---|---|---|---|---|
| moderate | moderate | ignored | moderate | steady |

TABLE 6-continued

Determination of lobby traffic and traffic rate when the recent departure interval is short, but previous departure interval is not short

| Current Car load (Car 3) | Previous Car load (Car 2) | Previous to Previous Car Load (Car 1) | Lobby Traffic | Lobby rate of change of traffic |
|---|---|---|---|---|
| peak | moderate | ignored | moderate | slowly increasing |
| peak | peak | ignored | peak | steady |
| moderate | peak | ignored | moderate | slowly increasing |
| full | moderate | ignored | peak | slowly increasing |
| moderate | full | ignored | peak | steady |
| full | full | ignored | full | steady |
| full | peak | ignored | peak | slowly increasing |
| peak | full | ignored | peak | slowly increasing |
| light | moderate | ignored | moderate | slowly decreasing |
| moderate | light | ignored | light | slowly increasing |
| light | peak | ignored | moderate | slowly decreasing |
| peak | light | ignored | moderate | slowly increasing |
| light | full | ignored | peak | steady |
| full | light | ignored | peak | steady |
| light | light | ignored | light | steady |

Table 7 shows an example of a determination of lobby traffic and lobby traffic rate when the recent departure interval is not short, but the previous departure interval was short. The load of the second previous car (car 1) may be ignored in categorizing the lobby traffic and traffic rate because the recent departure interval is not short. However, the cause of the recent departure interval not being short may be due to delay in car arrival at the lobby or passengers holding the car at the lobby. Thus, unless the recent departure interval is very long or more than a maximum limit, such as 120 seconds, the car load of both of the cars (car 3 and car 2) should be used to estimate the lobby traffic and its rate of change. This is the approach used in Table 7.

TABLE 7

Determination of lobby traffic and traffic rate when the recent car departure interval is not short but previous departure interval is short.

| Current car load (Car 3) | Previous car load (Car 2) | Second previous car load (Car 1) | Lobby traffic | Lobby traffic rate |
|---|---|---|---|---|
| moderate | moderate | ignored | moderate | steady |
| peak | moderate | ignored | moderate | steady |
| peak | peak | ignored | moderate | slowly increasing |
| moderate | peak | ignored | moderate | steady |
| full | moderate | ignored | peak | steady |
| moderate | full | ignored | moderate | steady |
| full | full | ignored | full | fast increasing |
| full | peak | ignored | peak | slowly increasing |
| peak | full | ignored | peak | steady |
| light | moderate | ignored | light | steady |
| moderate | light | ignored | light | steady |
| light | peak | ignored | light | steady |
| peak | light | ignored | moderate | steady |
| light | full | ignored | peak | steady |
| full | light | ignored | moderate | slowly increasing |
| light | light | ignored | light | steady |

If three cars leave the lobby such that the recent car departure interval and the previous car departure interval are both short, then full consideration is given to the car loads of all three cars to estimate the lobby traffic and traffic rate. Table 8 illustrates an example determination of lobby traffic and traffic rate when two successive departure intervals are short.

TABLE 8

Determination of lobby traffic and rate of change of traffic when two successive departure intervals are short.

| Current car load (Car 3) | Previous car load (Car 2) | Second Previous Car Load (Car 1) | Lobby Traffic | Lobby traffic rate |
|---|---|---|---|---|
| moderate | moderate | moderate | moderate | steady |
| peak | moderate | moderate | moderate | steady |
| moderate | peak | moderate | moderate | steady |
| peak | peak | moderate | peak | steady |
| full | moderate | moderate | peak | slowly increasing |
| moderate | full | moderate | peak | slowly increasing |
| full | full | moderate | full | steady |
| full | peak | moderate | peak | slowly increasing |
| peak | full | moderate | peak | slowly increasing |
| peak | moderate | peak | peak | steady |
| moderate | moderate | peak | moderate | steady |
| moderate | peak | peak | peak | steady |
| peak | peak | peak | peak | steady |
| full | moderate | peak | peak | slowly increasing |
| moderate | full | peak | peak | slowly increasing |
| full | full | peak | full | steady |
| full | peak | peak | peak | slowly increasing |
| peak | full | peak | peak | steady |
| moderate | moderate | full | peak | steady |
| peak | moderate | full | peak | steady |
| peak | peak | full | peak | steady |
| moderate | peak | full | peak | steady |
| full | moderate | full | full | steady |
| moderate | full | full | peak | steady |
| full | full | full | full | slowly increasing |
| peak | full | full | full | steady |
| full | peak | full | full | steady |
| light | light | full | light | steady |
| moderate | light | light | light | slowly increasing |
| light | moderate | light | light | steady |
| moderate | moderate | light | moderate | steady |
| moderate | peak | light | moderate | slowly increasing |
| peak | moderate | light | moderate | fast increasing |
| peak | peak | 1ight | peak | steady |
| full | peak | light | peak | slowly increasing |
| peak | full | light | peak | slowly increasing |
| full | full | light | full | steady |
| peak | light | light | moderate | slowly increasing |
| light | peak | light | moderate | steady |
| full | light | light | peak | steady |
| light | full | light | moderate | steady |
| full | moderate | light | peak | slowly increasing |
| moderate | full | light | peak | slowly increasing |
| light | light | moderate | light | steady |
| moderate | light | moderate | moderate | steady |
| moderate | light | peak | moderate | steady |
| peak | light | moderate | moderate | slowly increasing |
| peak | light | peak | peak | steady |
| full | light | peak | peak | steady |
| peak | light | full | peak | steady |
| full | light | full | full | steady |
| light | light | peak | light | steady |
| light | light | full | light | steady |
| full | light | moderate | peak | slowly increasing |
| moderate | light | full | moderate | steady |
| light | moderate | moderate | moderate | slowly decreasing |
| light | peak | moderate | moderate | steady |
| light | moderate | peak | moderate | slowly decreasing |
| light | peak | peak | moderate | slowly incrcasing |
| light | peak | full | moderate | slowly increasing |
| light | full | peak | peak | steady |
| light | full | full | peak | steady |
| light | moderate | full | moderate | slowly decreasing |
| light | full | moderate | moderate | steady |

Tables 5 to 8 are used to develop fuzzy logic rules which determine the lobby traffic and lobby traffic rate from car loads and car departure intervals whenever a car leaves in the primary direction from the lobby. The fuzzy rules are developed as described below.

The first row in Table 5 can be stated as a fuzzy rule: If car departure interval is very long and car load is light then the lobby traffic is light and lobby traffic rate is steady. This rule uses the current car's load count and the fact that no car left the lobby with passengers during a previous period, for example, 120 seconds, to estimate lobby traffic and lobby traffic rate. A rule can thus be derived for each entry in Table 5.

Similarly, the first row entry in Table 6 can be stated as a fuzzy rule: If car departure interval is short and previous car departure interval is not short and car load is moderate and previous car load is moderate then lobby traffic is moderate and lobby traffic rate is steady. This rule uses two car departure intervals and two car loads as inputs. It estimates the lobby traffic and traffic rate using four inputs. A fuzzy rule is derived for each row entry in Table 6.

For the first entry in Table 7, the fuzzy logic rule is: If car departure interval is not short and previous car departure interval is short, and car load is moderate and previous car load is moderate, then the lobby traffic is moderate and lobby traffic rate is steady. This rule also uses two departure intervals and two car loads in all four inputs to develop estimates of lobby traffic and lobby traffic rate. A fuzzy rule is derived for each row entry in Table 7.

The first entry in Table 8 can be expressed as a fuzzy logic rule as follows: If car departure interval is short and previous car departure interval is short and car load is moderate and previous car load is moderate and second previous car load is moderate, then the lobby traffic is moderate and lobby traffic rate is steady. This rule uses two departure intervals and three car loads to estimate the lobby traffic and lobby traffic rate. A fuzzy rule is derived for each row entry in Table 8.

Thus, for each row entry in Tables 5 to 8, a fuzzy logic rule is derived. These fuzzy logic rules take into account that the car load measurements are not precise, and the relationship among the departure intervals, car loads and lobby traffic and lobby traffic rate are likewise not precise. However, fuzzy logic is used to represent this impression and arrive at estimates of lobby traffic and traffic rate to a high degree of satisfaction.

The membership functions of the car loads, car departure intervals, lobby traffic and lobby traffic rate are coded in a fuzzy programming language. Several such languages are commercially available. For example, these membership functions can be coded in Togai InfraLogic's Fuzzy programming language (FPL). For further information, reference can be made to "Fuzzy-C Development System User's Manual", Release 2.3.0, Togai InfraLogic, Inc. Similarly, the fuzzy logic rules are coded in the FPL language. The fuzzy language file, in one embodiment, is then compiled using the FPL compiler to produce C language code for processing the rules and estimating lobby traffic and traffic rate.

The C code developed by the FPL compiler is integrated with the dispatcher software such that as a car leaves the lobby with passengers the C code is executed with the car loads and departure intervals as inputs. The C code develops the degrees of membership of the specified car loads and departure intervals in various fuzzy sets using the membership function declarations. The C code also computes the degree of membership to the premise of the fuzzy rule. The premise is the part of the fuzzy rule before the word "then".

For example, "if car departure interval is short and previous car departure interval is not short and car load is moderate and previous car load is moderate" is the premise. The word "then" implies outputs of the rule follow. Accordingly, "lobby traffic is moderate and lobby traffic rate is steady" is the output of the rule.

A premise degree of membership is then calculated using a max-min rule. In the max-min rule, the conditions combined by "and" result in degree of membership which is the minimum of the degrees of individual conditions. The conditions combined by "or" result in the degree of membership, which is the maximum of the degrees of individual conditions.

Each output in a rule has an associated fuzzy set. All the fuzzy sets of an output are defined in a range, known as a universe of discourse. Each fuzzy set is defined in a portion of the universe.

Discrete points are selected from the universe to compute the output degrees of membership at those points. For example, lobby traffic points are selected from 0 to 100, at intervals of 1, resulting in 101 points. For lobby traffic rate, points are selected from −50 to 50 at intervals of 1, resulting in 101 points. For each output fuzzy set, the defined degrees of membership at these points are calculated, using the membership functions shown in FIGS. 14 and 15. These are stored in Tables as shown in Tables 9 and 10.

TABLE 9

Table of lobby traffic degrees of membership in various fuzzy sets

| Points | Not any | Light | Moderate | Peak | Full |
|---|---|---|---|---|---|
| 0 | 1.0 | 0.0 | 0.0 | 0.0 | 0.0 |
| 1 | 1.0 | 0.0 | 0.0 | 0.0 | 0.0 |
| 2 | 1.0 | 0.0 | 0.0 | 0.0 | 0.0 |
| 3 | 1.0 | 0.0 | 0.0 | 0.0 | 0.0 |
| 4 | 1.0 | 0.0 | 0.0 | 0.0 | 0.0 |
| 5 | 1.0 | 0.0 | 0.0 | 0.0 | 0.0 |
| 31 | 0.0 | 0.95 | 0.05 | 0.0 | 0.0 |
| 32 | 0.0 | 0.90 | 0.10 | 0.0 | 0.0 |
| 33 | 0.0 | 0.85 | 0.15 | 0.0 | 0.0 |
| 34 | 0.0 | 0.80 | 0.20 | 0.0 | 0.0 |
| 35 | 0.0 | 0.75 | 0.25 | 0.0 | 0.0 |
| 51 | 0.0 | 0.0 | 0.95 | 0.05 | 0.0 |
| 52 | 0.0 | 0.0 | 0.90 | 0.10 | 0.0 |
| 53 | 0.0 | 0.0 | 0.85 | 0.15 | 0.0 |
| 54 | 0.0 | 0.0 | 0.80 | 0.20 | 0.0 |
| 55 | 0.0 | 0.0 | 0.75 | 0.25 | 0.0 |
| 71 | 0.0 | 0.0 | 0.0 | 0.95 | 0.05 |
| 72 | 0.0 | 0.0 | 0.0 | 0.90 | 0.10 |
| 73 | 0.0 | 0.0 | 0.0 | 0.85 | 0.15 |
| 74 | 0.0 | 0.0 | 0.0 | 0.80 | 0.20 |
| 75 | 0.0 | 0.0 | 0.0 | 0.75 | 0.25 |
| 96 | 0.0 | 0.0 | 0.0 | 0.0 | 1.0 |
| 97 | 0.0 | 0.0 | 0.0 | 0.0 | 1.0 |
| 98 | 0.0 | 0.0 | 0.0 | 0.0 | 1.0 |
| 99 | 0.0 | 0.0 | 0.0 | 0.0 | 1.0 |
| 100 | 0.0 | 0.0 | 0.0 | 0.0 | 1.0 |

TABLE 10

Table of lobby traffic rate degrees of membership in various fuzzy sets

| Points | Fast Decreasing | Slowly Decreasing | Steady | Slowly Increasing | Fast Increasing |
|---|---|---|---|---|---|
| −50 | 1.0 | 0.0 | 0.0 | 0.0 | 0.0 |
| −49 | 1.0 | 0.0 | 0.0 | 0.0 | 0.0 |
| −48 | 1.0 | 0.0 | 0.0 | 0.0 | 0.0 |
| −47 | 1.0 | 0.0 | 0.0 | 0.0 | 0.0 |
| −46 | 1.0 | 0.0 | 0.0 | 0.0 | 0.0 |
| −20 | 0.0 | 1.0 | 0.0 | 0.0 | 0.0 |
| −19 | 0.0 | 0.95 | 0.05 | 0.0 | 0.0 |
| −18 | 0.0 | 0.90 | 0.10 | 0.0 | 0.0 |
| −17 | 0.0 | 0.85 | 0.15 | 0.0 | 0.0 |
| −16 | 0.0 | 0.80 | 0.20 | 0.0 | 0.0 |
| 0 | 0.0 | 0.0 | 1.0 | 0.0 | 0.0 |
| 1 | 0.0 | 0.0 | 0.95 | 0.05 | 0.0 |
| 2 | 0.0 | 0.0 | 0.90 | 0.10 | 0.0 |

TABLE 10-continued

Table of lobby traffic rate degrees of membership in various fuzzy sets

| Points | Fast Decreasing | Slowly Decreasing | Steady | Slowly Increasing | Fast Increasing |
|---|---|---|---|---|---|
| 3 | 0.0 | 0.0 | 0.85 | 0.15 | 0.0 |
| 4 | 0.0 | 0.0 | 0.80 | 0.20 | 0.0 |
| 20 | 0.0 | 0.0 | 0.0 | 1.0 | 0.0 |
| 21 | 0.0 | 0.0 | 0.0 | 0.95 | 0.05 |
| 22 | 0.0 | 0.0 | 0.0 | 0.90 | 0.10 |
| 23 | 0.0 | 0.0 | 0.0 | 0.85 | 0.15 |
| 24 | 0.0 | 0.0 | 0.0 | 0.80 | 0.20 |
| 46 | 0.0 | 0.0 | 0.0 | 0.0 | 1.0 |
| 47 | 0.0 | 0.0 | 0.0 | 0.0 | 1.0 |
| 48 | 0.0 | 0.0 | 0.0 | 0.0 | 1.0 |
| 49 | 0.0 | 0.0 | 0.0 | 0.0 | 1.0 |
| 50 | 0.0 | 0.0 | 0.0 | 0.0 | 1.0 |

The membership values in Tables 9 and 10 are used to compute the degrees of memberships of rule outputs using fuzzy rules. An inference method is used to compute the degrees of membership of rule outputs from the premise degrees of memberships. There are two such widely used methods of inference: max-dot (also known as max-product) and max-min. In the max-dot inference method, for each output in the rule, the degree of membership is given by the product of the premise degree of membership and the degree of membership of the output in its fuzzy set, at various discrete points. For example, to obtain the degree of membership at each point for the output "the lobby traffic is moderate", the degree of membership at each point, from the column "moderate" in Table 9 is multiplied by the premise degree of membership for that rule when max-dot inference is used.

In the max-min method, for each output in the rule, the degree of membership is given by a minimum of the premise degree of membership and the output degree of membership in its fuzzy set, at discrete points. For example, for the output "lobby traffic rate is slowly increasing", the degree of membership of the output at each point is obtained as the minimum of the degree of membership at the corresponding point from the column "slowly increasing" in Table 10 and the premise degree of membership for that rule. Thus, for each discrete point in the output set range, a degree of membership is calculated using the premise degree of membership of the rule and defined degree of membership of the output fuzzy set.

To combine the outputs of each rule either maximum or a union, also known as summation, is used. For either maximum or union method, an array is used to accumulate the degrees of membership at each point for lobby traffic and another array for lobby traffic rate, as shown in Tables 11 and 12. These arrays are initially zeroed out. As the first rule is evaluated, the output degree of membership calculated at each point for lobby traffic is stored in Table 11 and the output degree of membership calculated at each point for lobby traffic rate is stored in Table 12. When successive rules are evaluated, the rule output degrees calculated at different points are compared with the values in Table 11 or Table 12.

If the maximum method is used and if the new values are greater than the values in the Tables, they are saved in the Tables at those points. If the union method is used, the output degrees calculated at different points are added to the values in the Tables 11 and 12 at those points. The process continues until all rules are evaluated. The resulting Tables give a fuzzy evaluation of the lobby traffic and traffic rates. Finally, if the union method is used, the accumulated degrees of membership at various points are limited to 1.0.

TABLE 11

Accumulated lobby traffic degree of membership at various points

| Points | Accumulated degrees of membership |
|---|---|
| 0 | 0.0 |
| 1 | 0.0 |
| 2 | 0.0 |
| 3 | 0.0 |
| 4 | 0.0 |
| 5 | 0.0 |
| . | 0.0 |
| . | 0.0 |
| . | 0.0 |
| . | 0.0 |
| . | 0.0 |
| 91 | 1.0 |
| 92 | 1.0 |
| 93 | 1.0 |
| 94 | 1.0 |
| 95 | 1.0 |
| 96 | 1.0 |
| 97 | 1.0 |
| 98 | 1.0 |
| 99 | 0.0 |
| 100 | 0.0 |

Crisp estimates of lobby traffic and traffic rates are obtained by defuzzifying the fuzzy values; this is accomplished by using the centroid method of defuzzification. In this method, the data in Table 11 is used to plot a graph. Taking a typical interval, say between 22 and 23 on the graph, the area can be calculated using the average of the degree of membership points 22 and 23 and the width of 1 unit. The moment of the area is calculated by the distance from lower limit of the universe of discourse namely zero; thus, the distance is 22.5.

TABLE 12

Accumulated lobby traffic rate degree of membership at various points

| Points | Accumulated degrees of membership |
|---|---|
| −50 | 0.0 |
| −49 | 0.0 |
| −48 | 0.0 |
| −47 | 0.0 |
| −46 | 0.0 |
| −45 | 0.0 |
| −44 | 0.0 |
| −43 | 0.0 |
| . | 0.0 |
| 0 | 1.0 |
| 1 | 1.0 |
| 2 | 1.0 |
| . | 1.0 |
| 41 | 0.0 |
| 42 | 0.0 |
| 43 | 0.0 |
| 44 | 0.0 |
| 45 | 0.0 |
| 46 | 0.0 |
| 47 | 0.0 |
| 48 | 0.0 |
| 49 | 0.0 |
| 50 | 0.0 |

The areas are calculated for each small interval and added together to get the total area. Similarly the moments are calculated for each interval and added together to get the total moment. By dividing the total moment by total area, the centroid of the plot is obtained, e.g., 37.5 for lobby traffic. Similarly the defuzzified value of lobby traffic rate can be obtained, for example, 55.

Whenever a car leaves the lobby with passengers, the car load, previous car loads, the second previous car load, car departure interval and previous car departure interval are used by the traffic estimator associated with the dynamic scheduling dispatcher to provide estimates of lobby traffic and lobby traffic rate.

b. Selection of Control Parameters in Dynamic Scheduling

The various parameters used in dynamic scheduling are selected using a two stage process. In the first stage, the operation of the elevator group is simulated using the traffic data collected for each determined interval and initial values of control parameters at various estimates of lobby traffic and traffic rate. In one embodiment, the determined interval is five minutes. The initial values of the number of cars assigned to the lobby, lobby service mode, lobby schedule interval and lobby schedule tolerances are selected for this simulation. Several simulation runs are made using different random number streams.

During these simulations, appropriate values of the control parameters are selected using interpolation techniques. The dispatching process is controlled using these selected values of the control parameters. The elevator group performance data are then collected and analyzed. Using the knowledge of one skilled in the art regarding adjusting the parameters, new values of the above control parameters are selected off-line, at different values of the lobby traffic and traffic rate estimates.

This process of off-line control parameter selection, simulation and analysis of performance data is repeated until satisfactory values of control parameters are selected off-line. Then, in the second stage, these parameter values are used in real time operation of elevator group and real time dispatching using the dynamic scheduler.

Off-line Simulation and Learning of Parameters

In order to select the values of the parameters used in dynamic scheduling for different levels of lobby traffic and traffic rates, an off-line simulation and learning technique is used. In this method, the values appropriate for different traffic levels and rates are first subjectively selected by one skilled in the art and tabulated as shown in Table 13. If the elevator system is new and no previous operational data are available, the elevator system is operated during single source traffic conditions, using selected initial parameter values. The values of the parameters at different traffic levels and rates are obtained using appropriate interpolation rules.

TABLE 13

Selection of Dynamic Scheduling Parameters using Look Up Tables based on Lobby Traffic and Traffic Rate

| Lobby Traffic | Lobby Traffic Rate | Lobby Service Mode | No. of cars assigned to the lobby | Lobby schedule interval | Lobby maximum waiting time | Schedule Lower Tolerance | Schedule Upper Tolerance |
|---|---|---|---|---|---|---|---|
| 0 | — | Demand | 1 | — | — | — | — |
| 10 | — | Demand | 1 | — | — | — | — |
| 20 | — | Demand | 1 | — | — | — | — |
| 30 | — | Demand | 2 | — | — | — | — |
| 40 | — | Demand | 2 | — | — | — | — |
| 50 | −50 to −30 | Scheduled | 3 | 30 | 40 | 5 | 10 |
| 50 | −30 to −10 | Scheduled | 3 | 30 | 40 | 5 | 10 |
| 50 | −10 to 10 | Scheduled | 3 | 30 | 40 | 5 | 10 |
| 50 | 10 to 30 | Scheduled | 3 | 28 | 38 | 5 | 10 |
| 50 | 30 to 50 | Scheduled | 3 | 28 | 38 | 5 | 10 |
| 60 | −50 to −30 | Scheduled | 3 | 28 | 38 | 7 | 10 |
| 60 | −30 to −10 | Scheduled | 3 | 25 | 35 | 7 | 10 |
| 60 | −10 to 10 | Scheduled | 3 | 25 | 35 | 7 | 10 |
| 60 | 10 to 30 | Scheduled | 3 | 25 | 35 | 7 | 10 |
| 60 | 30 to 50 | Scheduled | 3 | 25 | 35 | 7 | 10 |
| 70 | −50 to −30 | Scheduled | 3 | 28 | 40 | 10 | 12 |
| 70 | −30 to −10 | Scheduled | 3 | 28 | 40 | 10 | 12 |
| 70 | −10 to 10 | Scheduled | 3 | 28 | 40 | 10 | 12 |
| 70 | 10 to 30 | Scheduled | 4 | 30 | 42 | 10 | 12 |
| 70 | 30 to 50 | Scheduled | 4 | 30 | 42 | 10 | 12 |
| 80 | — | Scheduled | 4 | 32 | 44 | 10 | 12 |
| 90 | — | Scheduled | 4 | 32 | 47 | 10 | 15 |
| 100 | — | Scheduled | 4 | 35 | 50 | 10 | 15 |

During system operation, traffic data are collected for each determined minute period in terms of car boarding counts at all floors in the up and down directions. At the end of first operating period, the collected traffic data are used to predict the traffic for the next day and run simulations using the predicted traffic. Several runs of the operation, for example 10, are simulated using various sets of random number streams, the determined period traffic data predicted and the dynamic scheduling control parameter values first selected. During these simulations, whenever a car left the lobby, the estimated lobby traffic and traffic rate are recorded. The service mode, the number of cars assigned to lobby, the schedule interval, and the schedule tolerances are selected by interpolation and recorded as inputs. The highest hall call registration time at the lobby, the highest hall call registration times at floors non-lobby and the maximum lobby queue length for the previous period between two successive car departures from lobby, the average and maximum passenger waiting times for the passengers in the car, and the car load of the car at departure are recorded as outputs.

The data collected are then grouped by setting different collection intervals around traffic levels of 0, 10, 20, 30, 40, 50, 60, 70, 80, 90 and 100 for each of traffic rates of −50, −40, −30, −20, −10, 0, 10, 20, 30, 40 and 50. Accordingly, 121 collection sets are set up. The interval width is three units for lobby traffic and traffic rate. The records of data collected when the cars left the lobby are read one by one. If the traffic level was within one of the collection intervals and the traffic rate was within its collection interval, for example the traffic was between 30 and 33 and traffic rate was between −10 and −7, the output data in the record are listed under that collection set. The process is repeated for all the data collected during simulations.

The grouped data are then analyzed to determine the average, maximum and standard deviations of registration times, queue lengths, passenger waiting times at lobby and the car loads of cars leaving the lobby. The rates of change of these values from the previous set values are computed. Large variations in the values of the variables or their standard deviations or maximum values are then identified.

A computer program is used to select the appropriate values of the control parameters at various collection points. The computer program embodies the knowledge and experience of one skilled in the art in adjusting the control parameter values based on the analysis of values of the simulation output variables, their variations with adjacent collection sets, and the variances and maximums of the output variables. Accordingly, new sets of values are selected and inserted in Table 13 above.

The simulation process is again repeated and the performance data collected whenever a car leaves the lobby. The simulation data from a determined number of runs are again analyzed to select better values of the control parameters. The process is repeated several times until the values of the control parameters selected off-line result in acceptable system performance during simulations.

This method of predicting the traffic for the next day and running simulations after the up peak period and noon time, to select the values of the control parameters for the next day is repeated each day. Thus, the system learns the control parameters applicable for the predicted traffic conditions.

On-line Parameter Selection

The off-line selected control parameter values are saved in the group controller's memory. Then, as the elevator group is operated the next day and single source traffic conditions occur, the off-line selected control parameter values are used to select the parameter values in real time, using known interpolation techniques. The dynamic scheduling dispatcher operates in real time using these on-line selected control parameter values.

Controlling Oscillations in Parameter Values

In selecting the parameters, oscillations in values are avoided using proper delays. If the traffic and traffic rate increase rapidly, the system will respond rapidly. However, if the traffic and traffic rate decrease rapidly the system will wait for two or three observations to confirm the decrease and then only adjust the control parameters. The service mode, service interval, number of cars assigned to the lobby, allowable maximum waiting time at the lobby and the lobby service window tolerances are all selected using these delays.

Figure 16:
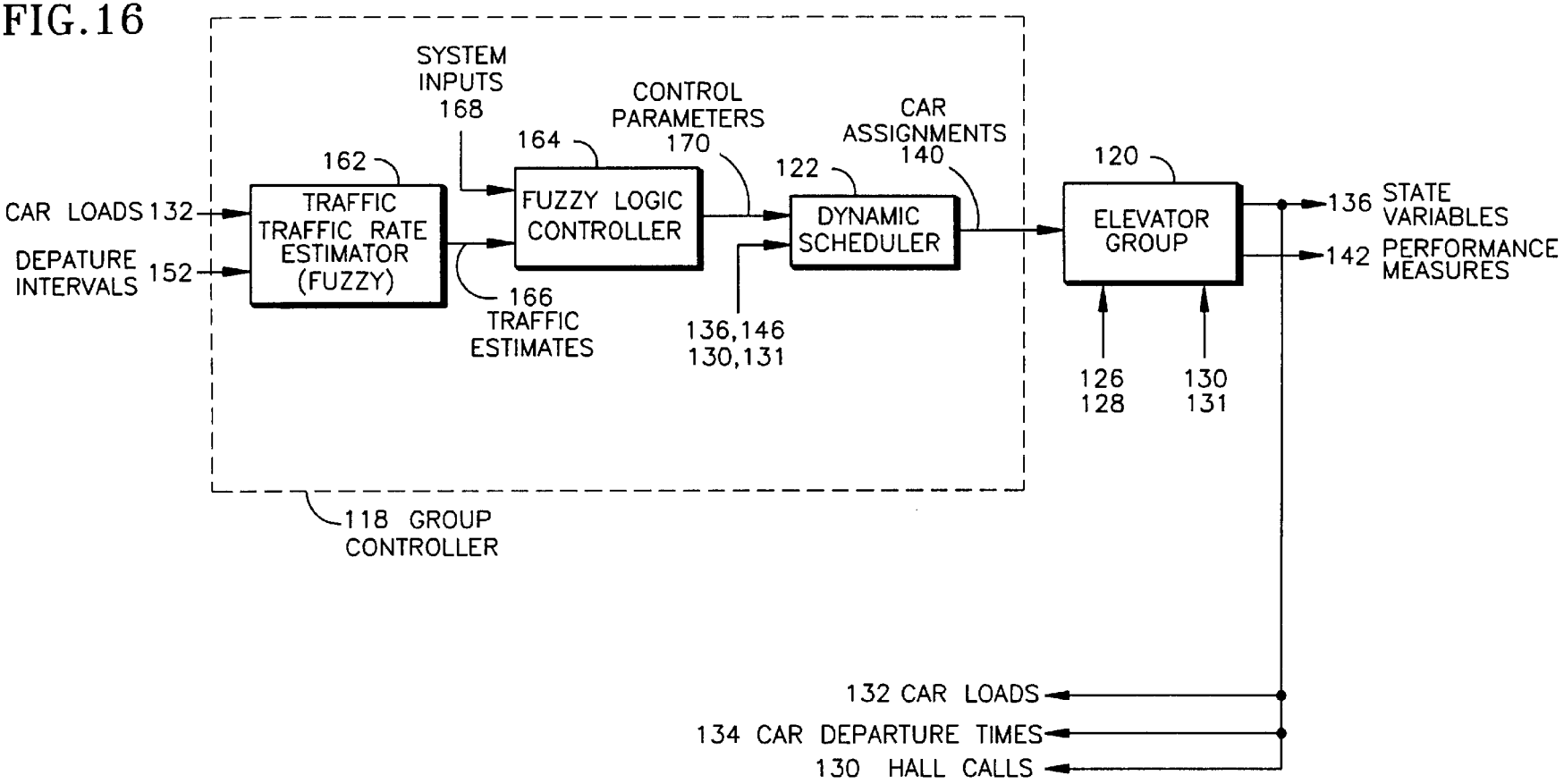
FIG. 16 is a block diagram showing an elevator dispatcher of the group controller for implementing dynamic scheduling using fuzzy estimates of lobby traffic and fuzzy logic control of parameters.

III Dynamic Scheduling Using Fuzzy Estimates of Lobby Traffic and Traffic Rate and Fuzzy Logic Control of Parameters FIG. 16 shows the diagram of the group controller 118 used to implement dynamic scheduling using fuzzy estimates of lobby traffic and traffic rate and fuzzy logic control of dynamic scheduling parameters. This group controller includes a traffic and traffic rate fuzzy estimator 162, a fuzzy logic controller 164 and the dynamic scheduler 122.

In this third method of implementing the dynamic scheduling dispatcher, the lobby traffic and traffic rate are estimated as fuzzy variables using the car loads 132 and departure intervals 152 of successive cars leaving the lobby. The lobby traffic and traffic rate are obtained in terms of their fuzzy sets. The possibilities of occurrence of each fuzzy set is specified using a set degree of membership described below. A joint occurrence and an independent occurrence of these variables are established in terms of joint set degrees of membership and simple set degrees of membership as described hereinbelow. Fuzzy estimates of lobby traffic and traffic rate 166 are then used in various fuzzy logic controllers 164 as inputs to select the control parameters 170 for controlling the dynamic scheduling dispatcher.

The fuzzy logic controllers 164 select the control parameters in real time using the real time generated fuzzy estimates of lobby traffic and traffic rate 166 as one set of inputs, the elevator control system inputs 168 as a second set of inputs, various state variables 136 of the elevator control system as the third set of inputs and performance measures 142 of the elevator control system as the fourth set of inputs as is explained hereinbelow. The dynamic scheduling control parameters 170, namely number of cars assigned to the lobby, lobby service mode, schedule interval, schedule window tolerances and the schedule delays, are all selected using the fuzzy logic controllers 164. Such real time selection of control parameters result in rapid and accurate response to changing traffic conditions at the lobby.

Five different fuzzy logic controllers are used to select the control parameters, using fuzzy estimates of lobby traffic and traffic rate as one set of inputs. The controllers are:

1. Open loop fuzzy logic controller
2. Open loop adaptive fuzzy logic controller
3. Closed loop fuzzy logic controller
4. Closed loop adaptive fuzzy logic controller
5. Fuzzy logic controllers with adaptive constraint generators The design principles and methodologies used in the above-mentioned controllers and their applications to select the control parameters used in the dynamic scheduling dispatcher during single source traffic conditions are described hereinbelow.

a. Fuzzy Estimation of Lobby Traffic and Traffic Rate Using Fuzzy Logic

The present method of implementing the dynamic scheduler develops estimates of lobby traffic and traffic rate as fuzzy variables using the car loads and departure intervals of successive cars leaving the lobby. The fuzzy estimates are made using the fuzzy relationships that exist between the car loads, car departure intervals, lobby traffic and lobby traffic rate. The estimates are developed using the fuzzy sets selected for lobby traffic and traffic rate. The estimates are made as a car leaves the lobby in the primary direction with passengers.

The fuzzy sets used for car loads, car departure intervals, lobby traffic and traffic rate are the same as those given in the previous Section II in FIGS. 12, 13, 14 and 15. The fuzzy relationships that exist among these variables are specified in Tables 5 through 8. Accordingly, the fuzzy logic rules described in Section II are used to estimate the lobby traffic and traffic rate as fuzzy variables as is described below.

One method of obtaining fuzzy outputs of the fuzzy logic rules uses discrete points and gives the degrees of membership for the output variable at those points. However, such an approach requires a large number of computations in real time as a result of the large number of rules used to estimate the lobby traffic and traffic rate. Thus, a preferred method of achieving the objects of the present invention is described hereinbelow.

In the preferred method, the set degree of membership for each output fuzzy set is defined. The premise degree of membership of the rule is used as the output set degree of membership for all output sets of that rule. Several rules can produce the same output set. Such an approach is used to simplify the complexity of the rules. The rules represent human-like thinking and reasoning processes and thus are easily readable and understandable. Then the output set degrees of membership of all rules producing same output fuzzy set are added together and limited to a maximum of 1.0 to produce an accumulated and bounded sum set degree of membership. The accumulated and bounded sum set degree of membership is computed for each output set. This accumulated and bounded sum set degree of membership is the set degree of membership of the output set. The degrees of membership computed for all sets are stored in an array.

This method uses a set degree method of inference such that the outputs are produced as fuzzy variables and are given using the set degrees of membership of the fuzzy sets of these variables.

Figure 17:
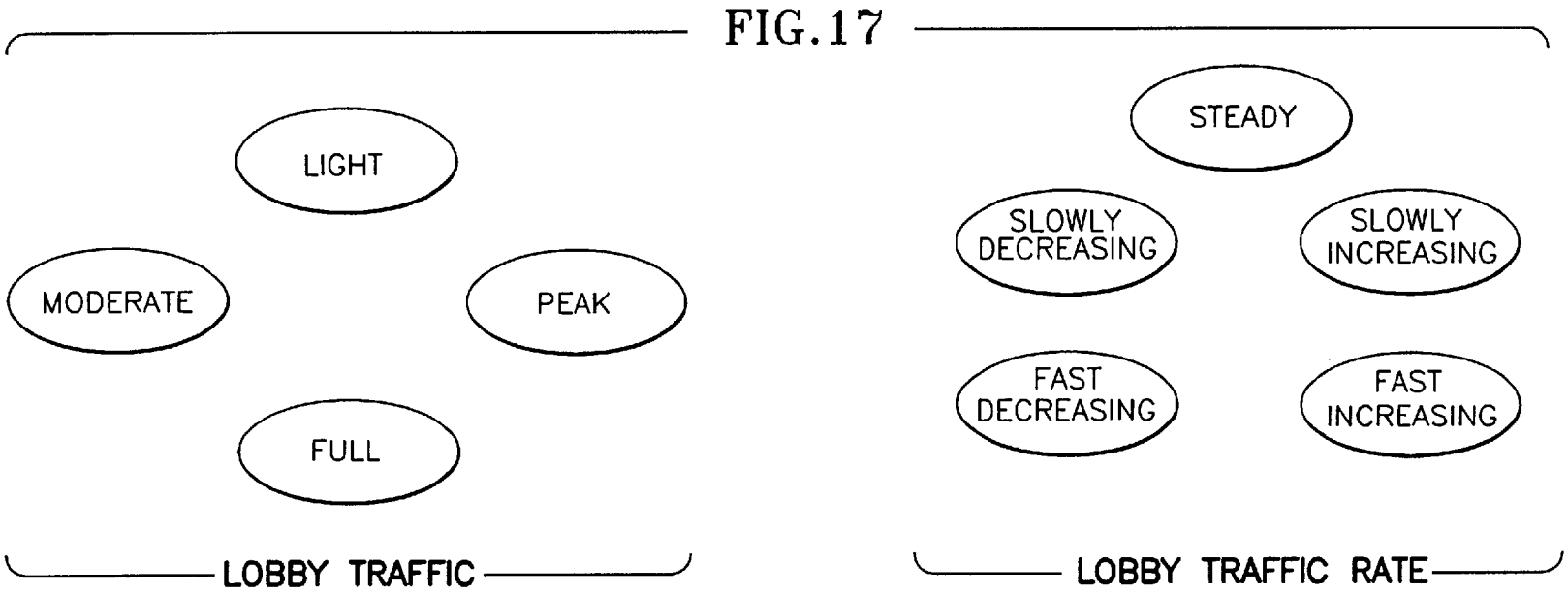
FIG. 17 is a diagram showing simple sets of lobby traffic and traffic rate.
Figure 18:
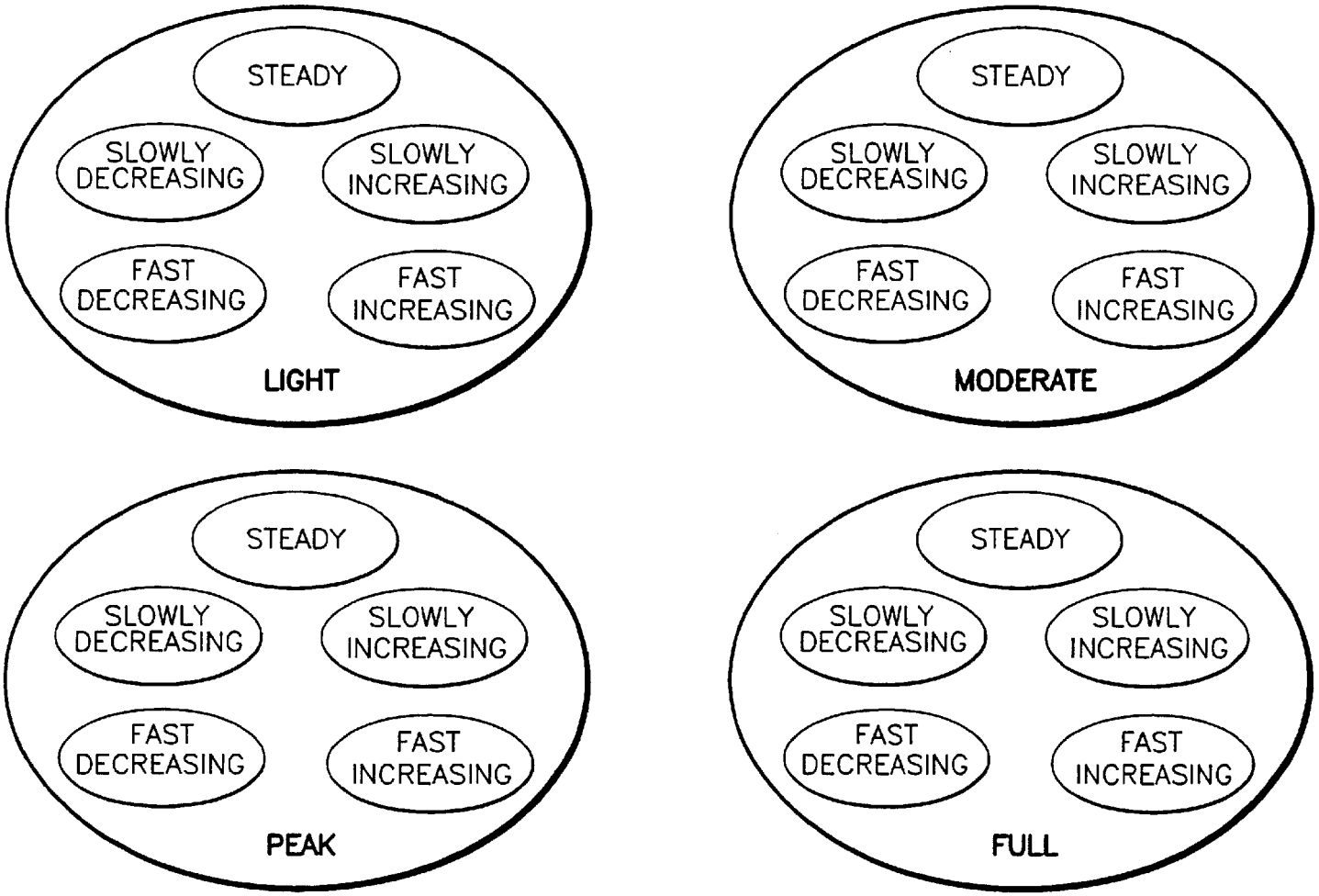
FIG. 18 is a diagram showing the joint sets of lobby traffic and traffic rate.

Another aspect of the present invention is a concept of joint variable. The joint variable is a variable which occurs always in association with another variable. In contrast, a simple fuzzy variable can occur independently of any other variable. Lobby traffic is an example of a simple fuzzy variable. Therefore, lobby traffic can be classified as not-any, light, moderate, peak, and full using fuzzy sets. These fuzzy sets are called simple fuzzy sets because the variable is simple. The lobby traffic rate can also be used as a simple variable and can be categorized using the previously defined fuzzy sets of steady, slowly increasing, fast increasing, slowly decreasing and fast decreasing. However, it is appropriate to think of the traffic rate as a subset of the traffic. Accordingly, the traffic rate is specified only with traffic. Therefore, the traffic rate is an example of a joint fuzzy variable. For example, "lobby traffic is moderate and lobby traffic rate is slowly increasing" specifies joint occurrence "moderate and slowly increasing". The joint fuzzy variable is specified using joint fuzzy sets like "moderate and slowly increasing". FIG. 17 shows the concept of simple fuzzy sets, and FIG. 18 shows the concept of joint fuzzy sets.

Fuzzy estimates of lobby traffic and traffic rate are simultaneously made using joint fuzzy sets. A joint set degree of membership is used to specify the possibilities of joint occurrence of the specific fuzzy sets of lobby traffic and traffic rate. The premise degree of membership is used as the joint set degree of membership for the joint fuzzy set of the rule's output. Several rules can result in the same joint output set. The joint set degrees of membership of all rules producing the same joint set are added together and limited to a maximum of 1.0 to produce an accumulated and bounded sum joint set degree of membership. The accumulated and bounded sum joint set degree of membership is computed for each output joint set. This accumulated and bounded sum joint set degree of membership is the joint set degree of membership for that joint set. The degrees of membership computed for all joint sets are stored in an array.

The set degree method of inference produces the output fuzzy variables in terms of joint fuzzy sets and joint set degrees of membership if the rules have joint fuzzy sets in their outputs.

The present invention also uses a concept of intermediate fuzzy variables. An intermediate fuzzy variable is a variable that is used as an output variable in some fuzzy logic rules and as an input variable in some other rules. If intermediate variables are used as rule outputs, this method produces the output variables as fuzzy variables. The set degree method of inference is selected to generate rule outputs. There is no defuzzification involved in generating the outputs of these rules as the outputs are fuzzy variables. This lack of defuzzification is known as a set degree method of defuzzification. When the output variables such as lobby traffic and traffic rate are intermediate variables and are used as inputs to other fuzzy logic rules to determine the values of various control parameters, the set degree method of defuzzification retains all the fuzzy information regarding the possibilities of occurrence of simple and joint fuzzy sets. Additionally, the computer time required to compute the deflzzified values of lobby traffic and traffic rate is eliminated.

When lobby traffic and traffic rate are used as inputs to other fuzzy logic rules, the input set degrees of membership can be directly read from Tables generated by the set degree defuzzification method. Therefore, there is no need to pass crisp values and then fuzzify them to get the input variable degrees of membership in their associated fuzzy sets. Consequently, the accuracy in obtaining control parameter values is improved and a reduction in computation time is achieved.

To implement the aforementioned capabilities, a fuzzy logic programming language, which can process the intermediate variables and estimate the lobby traffic and traffic rate in terms of joint and simple fuzzy sets and their set degrees of membership is used in a preferred embodiment.

The preferred fuzzy logic programming language has the following capabilities:

- methodology to specify variables as intermediate variables, so they will be treated as fuzzy variables;
- methodology to produce set degrees of membership of output fuzzy sets by using rule premise degrees of membership and by using accumulated and bounded sums of rule output set degrees of membership;
- methodology to produce the fuzzy output in terms of output fuzzy sets and set degrees of membership;
- methodology to specify simple fuzzy variables and joint fuzzy variables;
- methodology to produce joint set degrees of membership of output joint fuzzy sets by using rule premise degrees of membership and by using accumulated and bounded sums of rule output joint fuzzy set degrees of membership;
- methodology to produce joint fuzzy outputs using joint fuzzy sets and joint set degrees of membership.

In light of the above requirements, a fuzzy language program can be developed by one skilled in the art of fuzzy logic.

Thus, for each entry in Tables 5 to 8, a fuzzy logic rule is derived, using the preferred fuzzy logic programming language such that the variables and their associated fuzzy sets are coded in the fuzzy logic programming language. In one preferred embodiment, the membership functions of the fuzzy sets are represented using linear functions and coded. The fuzzy logic programming language files are created using the variable definitions, their fuzzy set declarations, membership function definitions and rule specifications. In one embodiment, the files are compiled using the fuzzy logic programming language compiler, to produce the C language code.

The C code developed by the compiler is integrated with the dispatcher software such that, as car loads and departure intervals are transferred to the C code, it produces the degrees of membership of various fuzzy sets of rule outputs.

The C code produces the degrees of membership of the car loads and the car departure intervals in their fuzzy sets. Then the degree of membership of the premise of the fuzzy rules is developed using max-min rule as described in Section II. The set degrees of membership of the joint sets used to get the rule outputs are obtained. If several rules produce the same output joint sets, the bounded sum approach, as explained above, is used to get the final joint set degrees of membership. All the rules in the determination of lobby traffic and traffic rate use a determined number of output joint sets. Table 14 shows an example of set degrees of membership computed for the various joint sets of lobby traffic and traffic rate.

TABLE 14

Example of Set Degrees of Membership of Output Fuzzy Sets of Lobby Traffic and Traffic Rate

| Lobby Traffic | Lobby Traffic Rate | Set Degree of Membership |
|---|---|---|
| Not any | None | 0.10 |
| Light | Steady | 0.20 |
| Light | Slowly increasing | 0.25 |
| Moderate | Steady | 0.30 |
| Moderate | Slowly increasing | 0.40 |
| Moderate | Fast increasing | 0.40 |
| Moderate | Slowly decreasing | 0.20 |
| Peak | Steady | 1.00 |
| Peak | Slowly increasing | 0.70 |
| Peak | Fast increasing | 0.50 |
| Full | Steady | 0.50 |
| Full | Slowly increasing | 0.20 |

In developing fuzzy rules to select the values of dynamic scheduler control parameters, both the lobby traffic and the rate of change of traffic are used as one set of inputs. The set degrees computed and stored in Table 14 can be directly used for determining the premise degrees of membership in those rules, as explained below in the description of fuzzy logic controllers.

Additionally, fuzzy logic rules may also be developed using the simple fuzzy sets of lobby traffic alone. The set degrees of membership of these sets are obtained from those of the joint sets in Table 14. The degree of membership of the joint fuzzy sets having the same simple fuzzy set for lobby traffic are summed and bounded to 1.0 to get the set degree of membership of that simple fuzzy set. Accordingly, the set degrees of membership of lobby traffic sets not-any, light, moderate, peak, and full are obtained. The set degrees of membership of the lobby traffic are saved in another Table and used in all fuzzy logic rules that use only simple fuzzy sets of lobby traffic in the premise. This is shown in Table 15.

TABLE 15

Example of Set Degrees of Membership for Simple Sets of Lobby Traffic

| Lobby Traffic | Set Degree of Membership |
|---|---|
| Not any | 0.0 |
| Light | 0.2 |
| Moderate | 0.5 |
| Peak | 1.0 |
| Full | 0.3 |

If the crisp value of the lobby traffic is required for any other control purpose, it is obtained from the set degree of membership of each fuzzy set. Either the maxdot method of inference or the max-min method of inference is used to arrive at the rule output degrees of membership using the set degree of membership and the defined degree of membership of each fuzzy set of lobby traffic. The centroid method of defuzzification is used to obtain the crisp value of lobby traffic as explained in Section II.

The set degrees of membership of the simple fuzzy sets of lobby traffic rate is obtained from the degrees of membership of the joint fuzzy sets tabulated in Table 14. Only the lobby traffic fuzzy set with the highest set degree is considered. The possibilities of occurrence of this lobby traffic fuzzy set with various fuzzy sets of lobby traffic rate are given in terms of joint set degrees of membership in Table 14. The joint set degrees of membership for all the joint sets having lobby traffic fuzzy set with highest degree of membership are listed in a separate Table. The crisp value of lobby traffic rate is obtained using these joint set degrees as the simple set degree of lobby traffic rate and centroid defuzzification method.

The fuzzy logic controllers are used to obtain the values of various control parameters, using lobby traffic and traffic rate as one set of inputs and elevator control system inputs, elevator control system state variables and elevator control system performance measures as another set of inputs. The use of joint fuzzy sets of lobby traffic and traffic rate to select control parameters requires fewer fuzzy logic rules as compared to using the car loads and car departure intervals to select the control parameters in various fuzzy logic control schemes. Accordingly, efficient fuzzy logic controllers are used to control various dispatching functions in real time using joint fuzzy sets of lobby traffic and traffic rate.

b. Fuzzy Logic Control of the Dynamic Scheduling Dispatcher

The control parameters for the dynamic scheduling dispatcher are selected in real time using fuzzy estimates of lobby traffic and traffic rate as one set of inputs. Additional inputs may or may not be used. When additional inputs are used, these may be elevator control system inputs or elevator control system outputs. The elevator control system outputs include state variables and performance measures. An example of an elevator control system input is a predicted number of hall calls at non-lobby floors; an example of a state variable is a number of cars bunched in the primary direction; an example of a performance measure is a predicted non-lobby hall call registration time.

The lobby traffic and traffic rate are estimated as fuzzy variables in terms of their simple and joint fuzzy sets and set degrees of membership, and thus are directly used as inputs in the fuzzy logic controllers. However, the other inputs are in the form of crisp values and are thus fuzzified by the controllers before processing to generate the outputs. Fuzzy logic rules are specified in Tables connecting the inputs and outputs of the fuzzy logic controller. These Tables are then used to derive the fuzzy logic rules for the fuzzy logic controller. When the rules are executed by the controllers, set degrees of membership for the outputs are produced. The crisp values of the control parameters are then produced using appropriate defuzzification methods as described hereinbelow.

The five different types of the fuzzy logic controllers that are used with fuzzy estimates of lobby traffic and traffic rate to generate the control parameters for the dynamic scheduler are described hereinbelow.

1. Open loop fuzzy logic controller

An open loop fuzzy logic controller is a controller that uses only the elevator control system inputs as inputs to produce the control parameter; for example, lobby traffic and traffic rate and the predicted number of hall calls at non-lobby floors. The information on lobby traffic, traffic rate and the predicted number of non-lobby hall calls is fuzzy and the relationship between these variables and the control parameters is fuzzy, thus a fuzzy logic controller is selected for human-like decision making. This approach is used to select the lobby service mode, the number of cars assigned to the lobby and lobby schedule delays. Fuzzy logic rules connecting the controller inputs and control parameters are used in this controller. The open loop controller does not use any of the elevator control system outputs to modify the control parameters.

Referring to FIG. 16, the principle of an open loop fuzzy logic controller used with dynamic scheduler is shown. The controller 164 receives two sets of inputs. The first set, the fuzzy estimates of lobby traffic and traffic rate 166 is input to the controller as joint fuzzy sets and set degrees of membership, and are generated by the lobby traffic and traffic rate estimator 162 from the car loads 132 and the car departure intervals 152. The fuzzy logic controller can also use other system inputs 168, such as number of hall calls at non-lobby floors, either actual or predicted.

The fuzzy logic controller produces crisp values of the control parameters 170 which are used to control the dynamic scheduler 122 for controlling dispatching. For example, the fuzzy logic controller provides as control outputs 170 the number of cars assigned to the lobby, the service mode and schedule change delays. The dynamic scheduler 122 uses these inputs and makes car assignments 140 to the lobby at intervals while in the scheduled mode, or after hall call registration if in the demand mode of service.

If the elevator group 120 operates under the control of the dynamic scheduling dispatcher certain system state variable values 136 and system performances 142 are produced. These are recorded using proper parameters. Examples of the state variables produced include car loads 132 and departure times 134. These are used by the traffic estimator, to produce fuzzy estimates of lobby traffic and traffic rate. The car loads and the departure intervals depend on the passenger arrival process 126 and boarding process 128. The hall calls 130 registered at non-lobby floors may be used to predict the number of hall calls at non-lobby floors during the next three minute intervals and used as additional elevator control system inputs 168 to the fuzzy logic controller.

Figure 19:
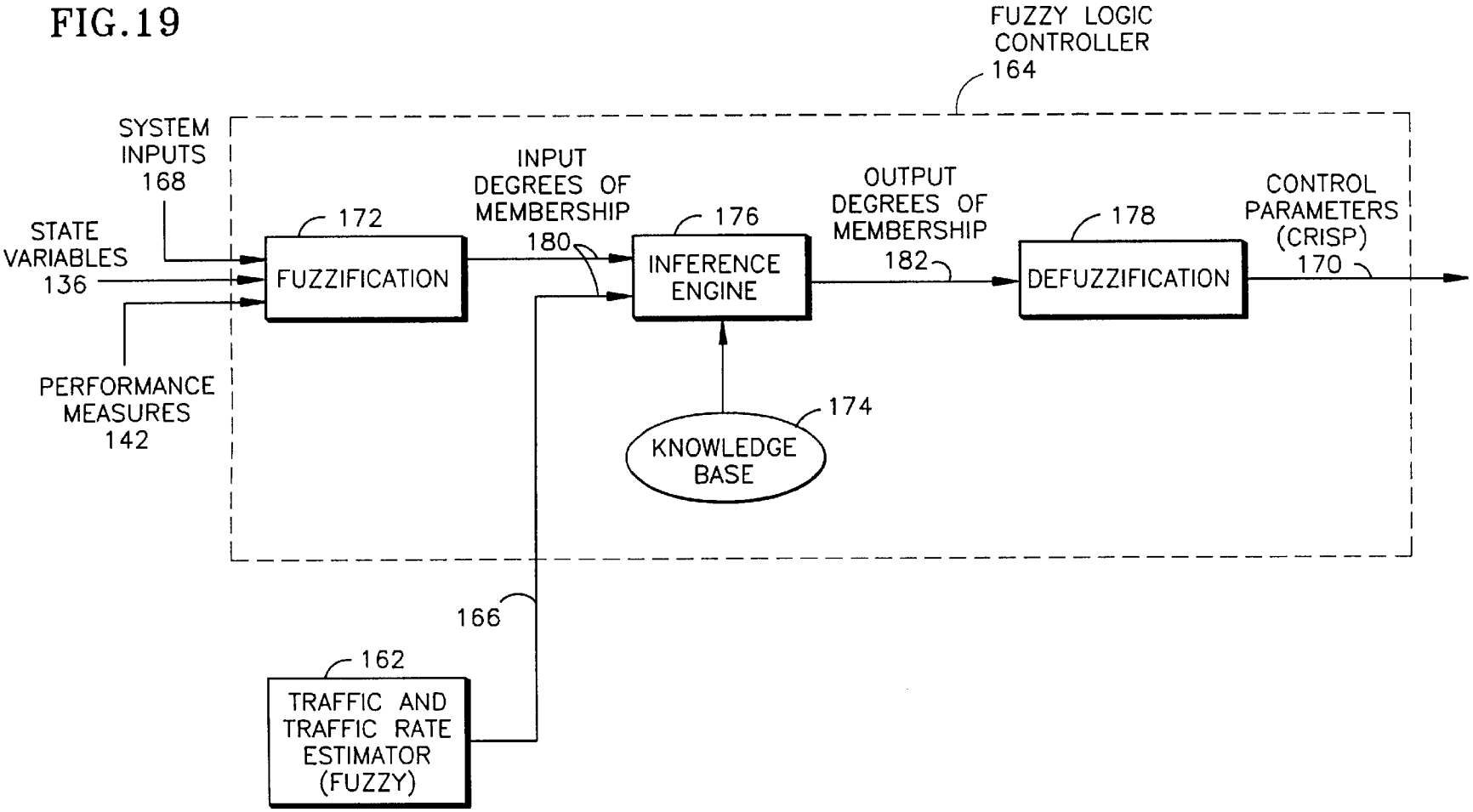
FIG. 19 is a simplified block diagram showing a fuzzy logic controller and its various components.

Referring to FIG. 19, the fuzzy logic controller 164 includes a fuzzification logic 172, a knowledge base 174, an inference engine 176 and a defuzzification logic 178. The fuzzy logic controller uses one-or more sets of inputs. The lobby traffic and traffic rate 166 are input as fuzzy sets with joint set degrees of membership. Other system inputs 168 are in the form of crisp values. Examples of other system inputs are a number of down hall calls predicted and a number of up and down hall calls predicted for the next determined period. The fuzzy logic controller 164 uses the fuzzy sets and membership functions defined for these controller inputs, to obtain the degree of membership for given values of these inputs. This process is accomplished by the fuzzification logic 172 which generates the input degrees of membership 180 as is known in the art. The fuzzy logic controller 164 keeps the fuzzy logic rules in the knowledge base 174 in the fuzzy logic controller's section of the GCSS's memory. The inference engine 176 uses the fuzzy logic rules and the input degrees of membership 180 to generate the rule output set degrees of membership 182 using the set degree method of inference described in the previous section. The output set degrees of membership 182 are obtained using the bounded sum method described in the previous section. The defuzzification logic 178 in the controller 164 produces crisp control outputs 170 using a defuzzification method as is known to one skilled in the art.

Figure 20:
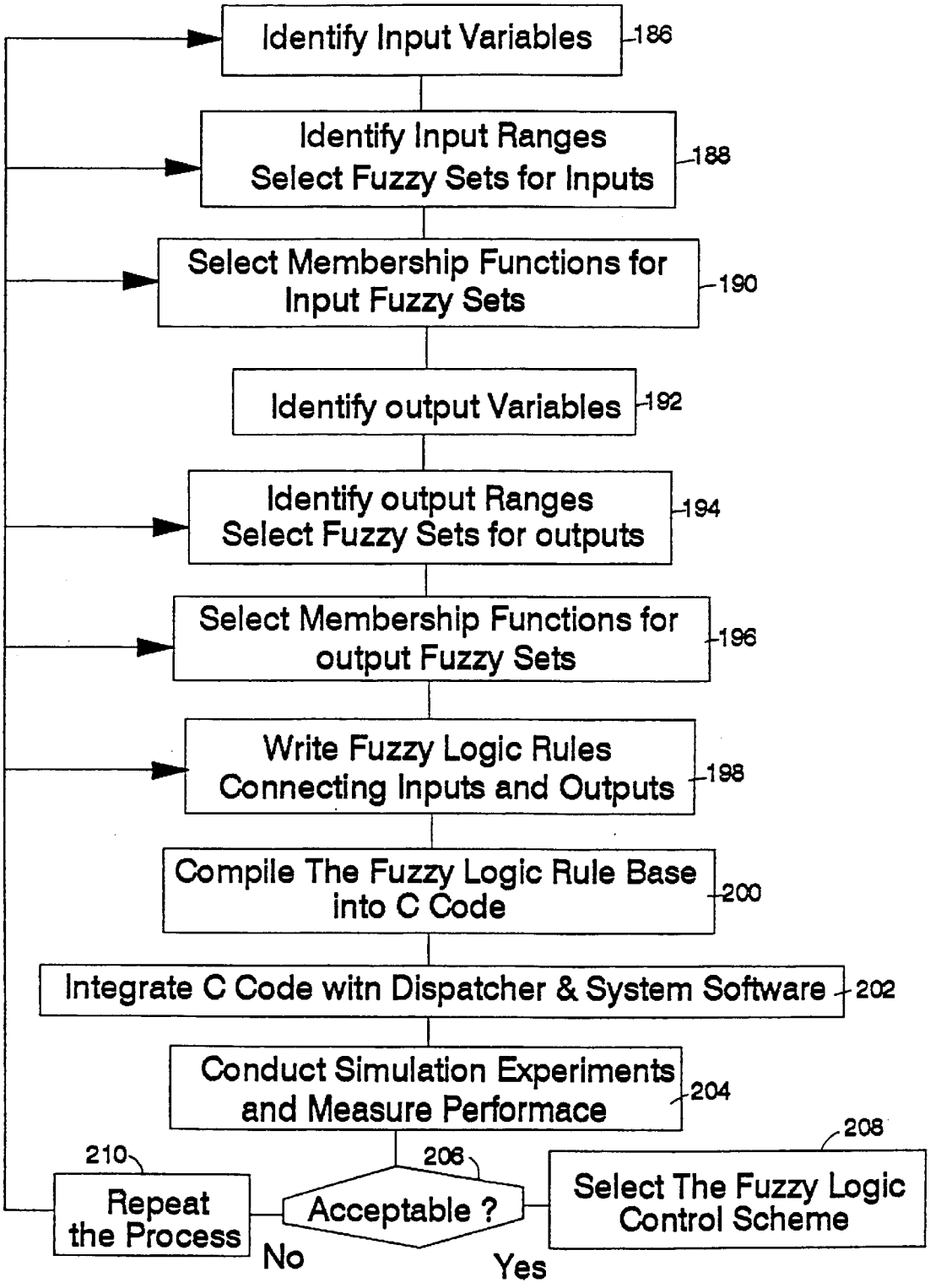
FIG. 20 is a flow diagram showing steps involved in developing a fuzzy logic controller.

Referring to FIG. 20, the steps involved in developing a fuzzy logic controller to select the control parameters are shown. In Step 186, the input variables to be used in a control scheme are identified. Then, in Step 188, the ranges of variation of the input variables are identified. The fuzzy sets to be used to categorize the input variables are then selected. In Step 190, appropriate membership functions are selected for the input fuzzy sets. The membership functions could be linear or nonlinear functions.

Then, in Step 192, the output variables to be controlled in the control scheme are identified. In Step 194, the ranges of variation of the output variables are identified. The fuzzy sets to be used to categorize the output variables are then selected. In Step 196, appropriate membership functions are selected for the output fuzzy sets.

Step 198, fuzzy logic rules are written connecting the input and output variables. These rules form the knowledge base (rule base) 174. In step 200, the fuzzy set definitions, their membership functions and the rule base are coded in the fuzzy logic programming language and compiled into C language code using the fuzzy logic compiler.

In Step 202, the controller C code is integrated with the dispatcher and system software. Then, in Step 204, the elevator group operation is simulated and experiments conducted using the traffic profile for the operating period and various random number streams. The system performance data are then collected and analyzed.

In Step 206, if the system performance is acceptable, the fuzzy logic control scheme, via the fuzzy sets, membership functions and the fuzzy logic rules are accepted in Step 208. If on the other hand, the performance is not acceptable, then in Step 210, the whole process is repeated until the performance is acceptable.

The controller so selected is used for real time selection of various control parameters used in dynamic scheduling as is described hereinbelow with four examples. Each controller used for a specific purpose is developed separately using the methodology of FIG. 20.

A. An open loop fuzzy logic controller to select the number of cars assigned to the lobby during up peak period.

In the first example, the number of cars assigned to the lobby during up peak period can be selected in real time as a function of lobby traffic and traffic rate alone by using the open loop fuzzy logic controller. By controlling the number of cars assigned to the lobby for up peak period using the open loop fuzzy logic controller, the supply of cars to the lobby is matched to lobby traffic and traffic rate; this provides improved service at the lobby and at floors other than the lobby. When lobby traffic is increasing rapidly cars are assigned to the lobby rapidly. When the traffic is decreasing, less cars are sent to lobby.

Figure 21:
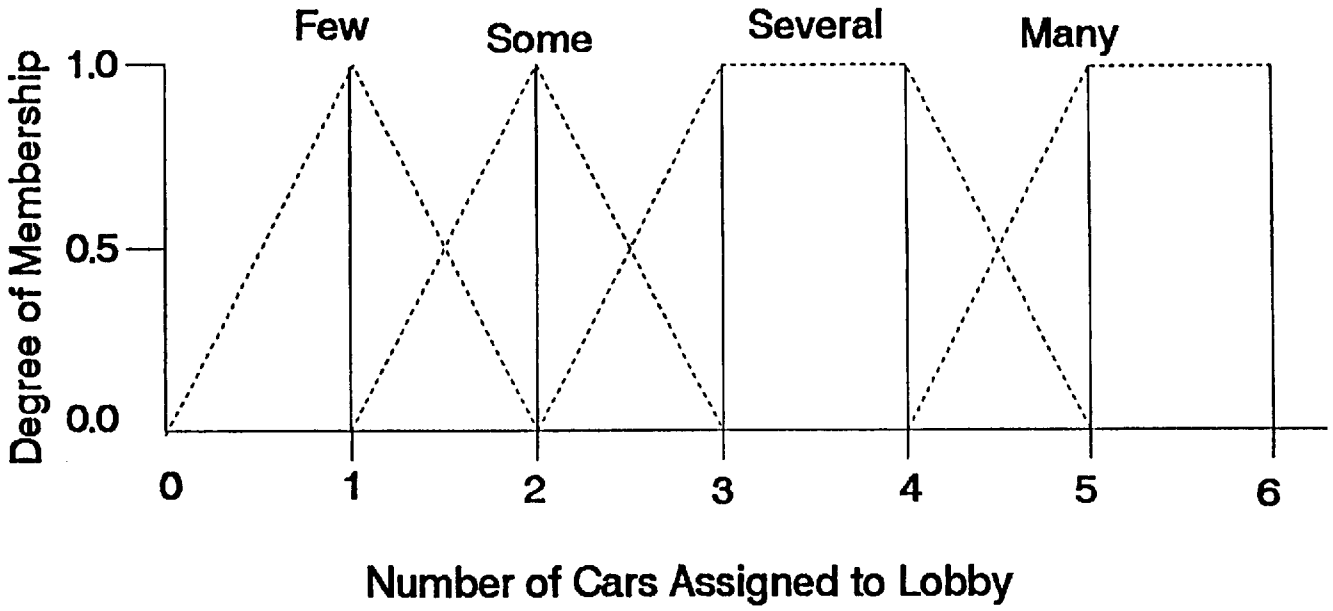
FIG. 21 is a diagram showing fuzzy sets and membership functions for a number of cars assigned to the lobby.

Referring to FIG. 21, an example of fuzzy sets and membership functions used to categorize the number of cars assigned to the lobby is shown. The fuzzy sets of few, some, several and many are used. The number of cars assigned to the lobby are integers; thus, the degree of membership in the fuzzy sets are defined only for integer values of number of cars assigned to the lobby.

Table 16 shows a method of selecting the number of cars assigned to the lobby using lobby traffic and traffic rate. The method is used during up peak periods if the counterflow and interfloor traffic are not significant. Fuzzy logic rules are written using Table 16, connecting the number of cars assigned to the lobby with lobby traffic and traffic rate. The fuzzy logic language is used to write these rules. For example, the sixth row entry can be written in fuzzy logic as a fuzzy rule.

If lobby traffic is moderate and lobby traffic rate is slowly increasing, then the number of cars assigned to the lobby is some.

TABLE 16

Method of selecting number of cars assigned to the lobby from lobby traffic and traffic rate during up peak period

| Lobby Traffic | Rate of Change of Lobby Traffic | Number of Cars Assigned to the Lobby |
|---|---|---|
| Not Any | Steady | Few |
| Light | Steady | Few |
| Light | Slowly Increasing | Few |
| Moderate | Slowly Decreasing | Few |
| Moderate | Steady | Some |
| Moderate | Slowly Increasing | Some |
| Moderate | Fast Increasing | Several |
| Peak | Steady | Several |
| Peak | Slowly Increasing | Several |
| Peak | Fast Increasing | Several |
| Full | Steady | Many |
| Ful1 | Slowly Increasing | Many |

The rules derived from Table 16 are compiled into C language code using the fuzzy logic compiler. In one embodiment, the C code is integrated with the C code developed for estimating lobby traffic and traffic rate from car loads and departure intervals of cars departing from lobby and other dispatcher software.

In one embodiment, whenever a car leaves the lobby with passengers, the programming embodying the fuzzy logic controller is executed. The set degrees of membership for the joint sets such as "lobby traffic is moderate" and "lobby traffic rate is steady" are obtained and are used as the premise degrees of membership of these rules. The lobby traffic and traffic rate joint set degrees of membership produced by the traffic estimator are directly used as inputs to the fuzzy logic rules used to select the number of cars assigned to the lobby. This reduces the number of computations.

The output of the controller is obtained using the set degree method of inference and a height method of defuzzification. In the set degree method of inference for the output variable number of cars assigned to the lobby, the defined degrees of membership at various discrete points are stored in a Table for all fuzzy sets. The rule output set degree of membership is obtained as the minimum of the premise degree of membership of the rules and the defined degree of membership of the output set, at various discrete points. The outputs of all rules are obtained as the sums of the degrees computed at various discrete points of the output variable. The sums are then limited to 1.0.

In the height method of defuzzification, the crisp value of the number of cars assigned to the lobby is a value, at which the sum of degrees of membership computed by the set degree inference method is the maximum. This defuzzification method is used for integer value outputs. When more than one point have the same degrees of membership, the average of these points is calculated and rounded to the nearest integer.

Accordingly, whenever a car leaves the lobby with passengers, using the car loads and departure intervals, the set degrees of membership of the lobby traffic and traffic rate are computed in one embodiment. Using the set degrees of membership, the number of cars to be assigned to the lobby is determined using the fuzzy logic rules.

B. An open loop fuzzy logic controller to select the number of cars assigned to the lobby during noon time.

Another example of the open loop fuzzy logic controller selects the number of cars assigned to the lobby during noon time as a function of lobby traffic, traffic rate and the predicted number of secondary direction hall calls. During noon time two way traffic exists, and often there is significant secondary direction traffic; thus, this controller uses the predicted number of secondary direction hall calls, as one of its inputs.

The supply of cars to the lobby is matched to the lobby traffic level and traffic rate while also considering hall calls made at floors other than the lobby. This provides improved service at the lobby and at floors other than the lobby.

Figure 22:
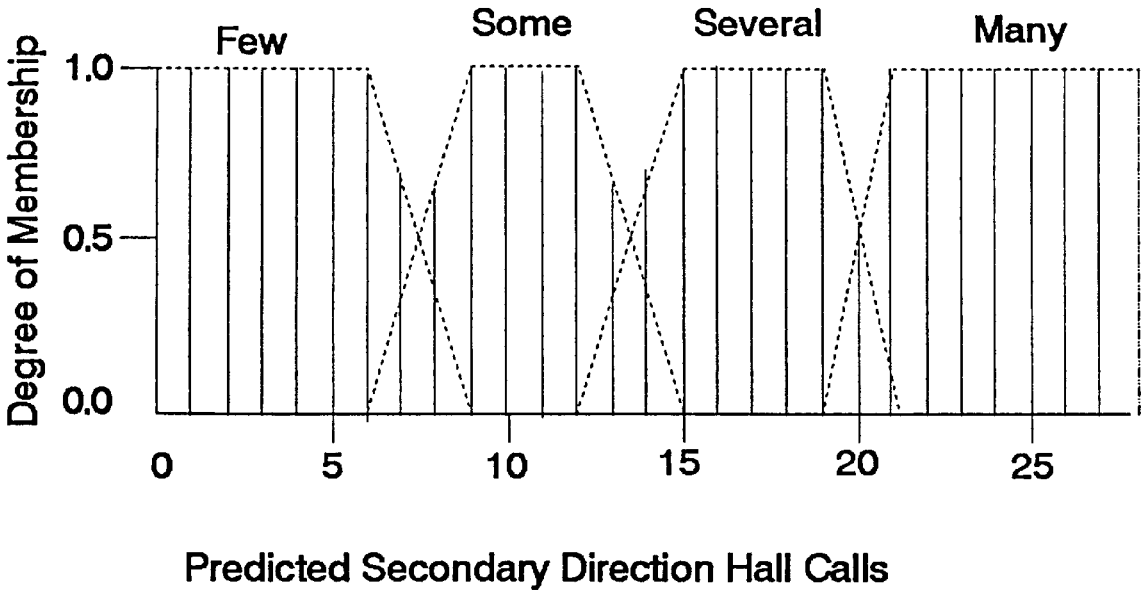
FIG. 22 is a diagram showing fuzzy sets and membership functions for predicted secondary direction hall calls.

Referring to FIG. 22, an example of the fuzzy sets and membership functions used to categorize predicted three minute secondary direction hall calls is shown. The predicted secondary direction hall calls are used instead of actual secondary direction hall calls, so the response will be not rapid, but will slowly adjust. The secondary direction hall calls are integers; thus, the degrees of membership are defined only for integer values of the fuzzy variable. This fuzzy variable is categorized using the fuzzy sets of few, some, several and many, in one embodiment.

Table 17 shows a method of selecting the number of cars assigned to the lobby using lobby traffic, traffic rate and the predicted number of secondary direction hall calls for the next three minute period.

TABLE 17

Method of selecting the number of cars assigned to lobby using lobby traffic, traffic rate and the predicted three minute secondary direction hall cals

| Lobby Traffic | Lobby Traffic Rate | Predicted three minute Secondary Direction Hall Calls | Number of Cars Assigned to Lobby |
|---|---|---|---|
| Not Any | Steady | — | Few |
| Ligit | Steady | — | Few |
| Light | Slowly Increasing | — | Few |
| Moderate | Slowly Decreasing | — | Few |
| Moderate | Steady | Few or Some | Some |
| Moderate | Steady | Several or Many | Few |
| Moderate | Slowly Increasing | Few or Some | Some |
| Moderate | Slowly Increasing | Several or Many | Few |
| Moderate | Fast Increasing | Few or Some | Several |
| Moderate | Fast Increasing | Several or Many | Some |
| Peak | Steady | Few or Some | Several |
| Peak | Steady | Several or Many | Some |
| Peak | Slowly Increasing | Few or Some | Several |
| Peak | Slowly Increasing | Several or Many | Some |
| Peak | Fast Increasing | Few or Some | Several |
| Peak | Fast Increasing | Several or Many | Some |
| Full | Steady | Few or Some | Many |
| Full | Steady | Several or Many | Several |
| Full | Slowly Increasing | Few or Some | Many |
| Full | Slowly Increasing | Several or Many | Several |

Table 17 is used to derive fuzzy logic rules connecting lobby traffic, traffic rate, predicted number of secondary direction hall calls to the number of cars to be assigned to the lobby. For example, the last rule for moderate traffic is written as:

If lobby traffic is moderate and lobby traffic rate is fast increasing and predicted number of secondary direction hall calls is several or many, then the number of cars assigned to the lobby is some.

The fuzzy logic rules are coded in the fuzzy logic language and compiled to produce the C code. This C code, the C code for estimating the lobby traffic and traffic rate and the dispatcher software are used to obtain the number of cars assigned to lobby in real time. In one embodiment, whenever a car leaves the lobby with passengers and whenever the traffic predictor predicts the next three minute secondary direction hall calls, the programming embodying this fuzzy logic controller is executed. The joint set degrees of membership of lobby traffic and traffic rate are obtained from the traffic estimator. The secondary direction hall call degree of membership is obtained using the fuzzy set definitions. The premise degree of membership is then obtained using the max-min principle.

The output of the controller is obtained using the set degree method of inference and height method of defuzzification. The method of obtaining the rule output and crisp number of cars assigned to the lobby from the lobby traffic, traffic rate and predicted number of hall calls is same as the method in the previous example.

C. An open loop fuzzy logic controller to select the service mode for single source traffic conditions.

In another example, an open loop controller is used to select the service mode for lobby primary direction service. The occurrence of secondary direction hall calls made at floors other than the lobby affects service requirements at the floors other than the lobby and car availability at the lobby. Accordingly, the fuzzy estimates of lobby traffic and rate of change of traffic and the predicted number of secondary direction hall calls made at non-lobby floors are used to select and rapidly change the service mode at the lobby.

Figure 23:
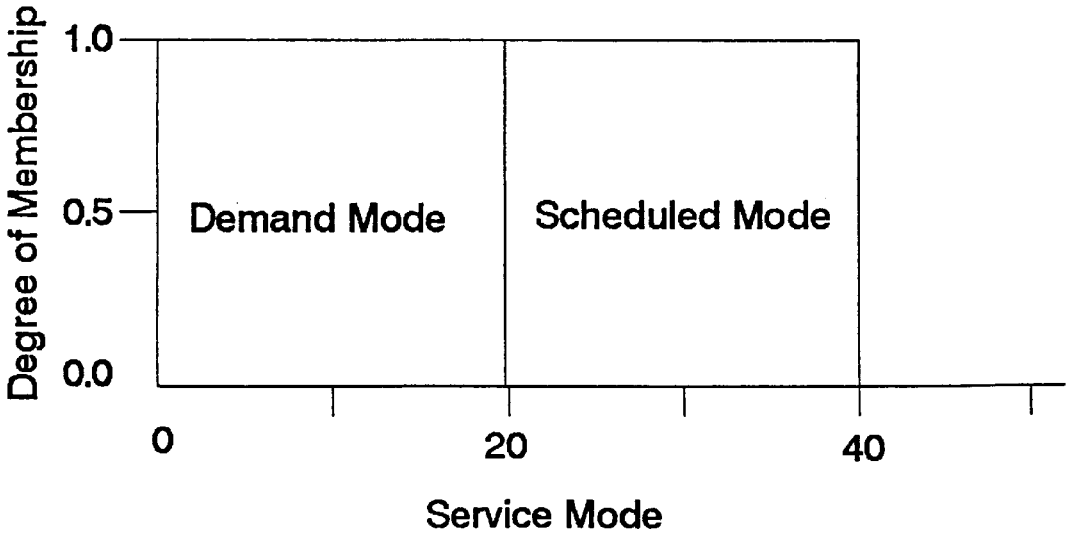
FIG. 23 is a diagram showing fuzzy sets and membership functions for lobby service mode.

The fuzzy sets used for predicted number of secondary direction hall calls are the same as those shown in FIG. 22. FIG. 23 shows the fuzzy sets used to define the service mode. It uses only two fuzzy sets; namely, demand mode and scheduled mode. These fuzzy sets are defined using mode values in any range, e.g. 0–40. For example, if the mode value is between 0 and 20, it indicates demand mode and if it is between 21 and 40, it indicates scheduled mode.

TABLE 18

Method of selecting lobby service mode using lobby traffic, traffic rate and the predicted three minute secondary direction hall calls

| Lobby Traffic | Lobby Traffic Rate | Number of Secondary Direction Hall Calls | Lobby Service Mode |
|---|---|---|---|
| Not any | Steady | Ignored | Demand |
| Light | Steady | Ignored | Demand |
| Light | Slowly Increasing | Ignored | Demand |
| Moderate | Slowly Decreasing | Ignored | Demand |
| Moderate | Steady | Ignored | Demand |
| Moderate | Slowly Increasing | Few or Some | Scheduled |
| Moderate | Slowly Increasing | Several or many | Demand |
| Moderate | Fast Increasing | Few or Some | Scheduled |
| Moderate | Fast Increasing | Several or Many | Demand |
| Peak | Steady | Ignored | Scheduled |
| Peak | Slowly Increasing | Ignored | Scheduled |
| Peak | Fast Increasing | Ignored | Scheduled |
| Full | Steady | Ignored | Scheduled |
| Full | Slowly Increasing | Ignored | Scheduled |

Table 18 shows a method of selecting the service mode using lobby traffic, traffic rate and predicted number of secondary direction hall calls for the next three minute interval. Table 18 is used to write fuzzy logic rules connecting lobby traffic, traffic rate and secondary direction hall calls to the service mode. The rules are compiled into C code using the fuzzy logic compiler. The C code is integrated with the C code developed for estimating the lobby traffic and traffic rate from car loads and departure intervals and other dispatcher software.

Accordingly, when a car leaves the lobby with passengers in the primary direction and the secondary direction hall calls are predicted for the next three minutes, the open loop fuzzy logic controller can be executed. The fuzzy logic controller estimates the lobby traffic and traffic rate, as joint fuzzy sets with associated set degrees of memberships. The premise degree of membership for each rule is then obtained as the minimum of the joint set degree of membership and the degree of membership of secondary direction hall calls in its sets. The output set degree of membership is same as the premise degree of membership. When several rules result in the same output set, their set degrees of membership are added together and limited to 1.0. The set with highest degree of membership determines the service mode. This scheme thus uses the set degree method of inference and height method of defuzzification. Therefore, the service mode is determined using current estimates of lobby traffic, traffic rate and number of secondary direction hall calls predicted.

D. An open loop fuzzy logic controller to select lobby schedule delays

A fourth example illustrates the selection of the lobby schedule delay and lobby schedule cancel delay by an open loop fuzzy logic controller.

A preferred method of selecting the service mode is to estimate lobby traffic and traffic rate using fuzzy logic, and use this estimate to select service mode as explained in the previous section. When a fuzzy logic controller is used to select service mode, the service mode changes rapidly when traffic conditions change. So a method of controlling oscillations in service mode selection is required. This can be done using proper change delays in starting the schedule mode and terminating or canceling the scheduled mode. Lobby schedule start delay and lobby schedule cancel delays are used for this purpose.

An open loop fuzzy logic controller is used to select the lobby schedule start delay and lobby schedule cancel delay using fuzzy estimates of lobby traffic and traffic rate and fuzzy sets of number of secondary direction hall calls present at non-lobby floors. This results in improved control of the service mode selection process, and avoids oscillations between demand and scheduled modes. In addition, lobby hall call registration times, lobby crowd and duration of the crowd are reduced. Hall call registration times at non-lobby floors and hall call reassignments are also reduced.

Figure 24:
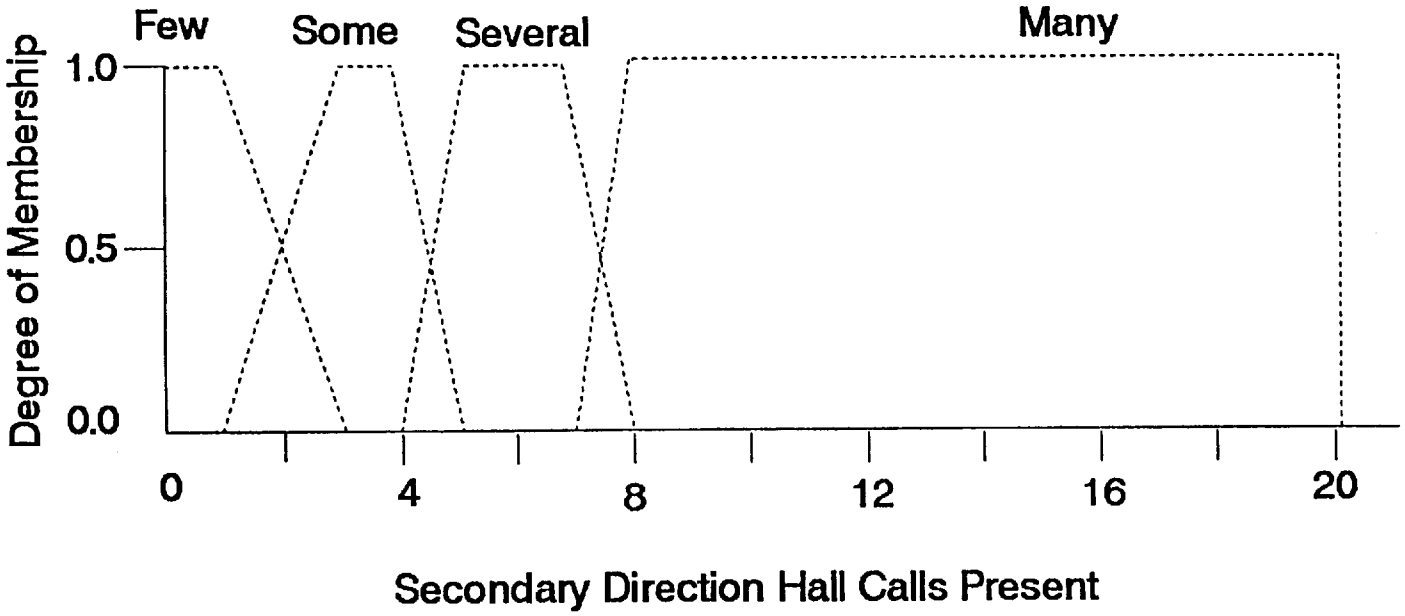
FIG. 24 is a diagram showing fuzzy sets and membership functions for secondary direction hall calls present.

The number of secondary direction hall calls currently present at non-lobby floors are recorded whenever a new secondary direction hall call is registered and whenever a secondary direction hall call is answered. The fuzzy sets and membership functions used for categorizing currently present secondary direction hall calls are shown in FIG. 24. The fuzzy sets of few, some, several and many are used to categorize the secondary direction hall calls.

Figure 25:
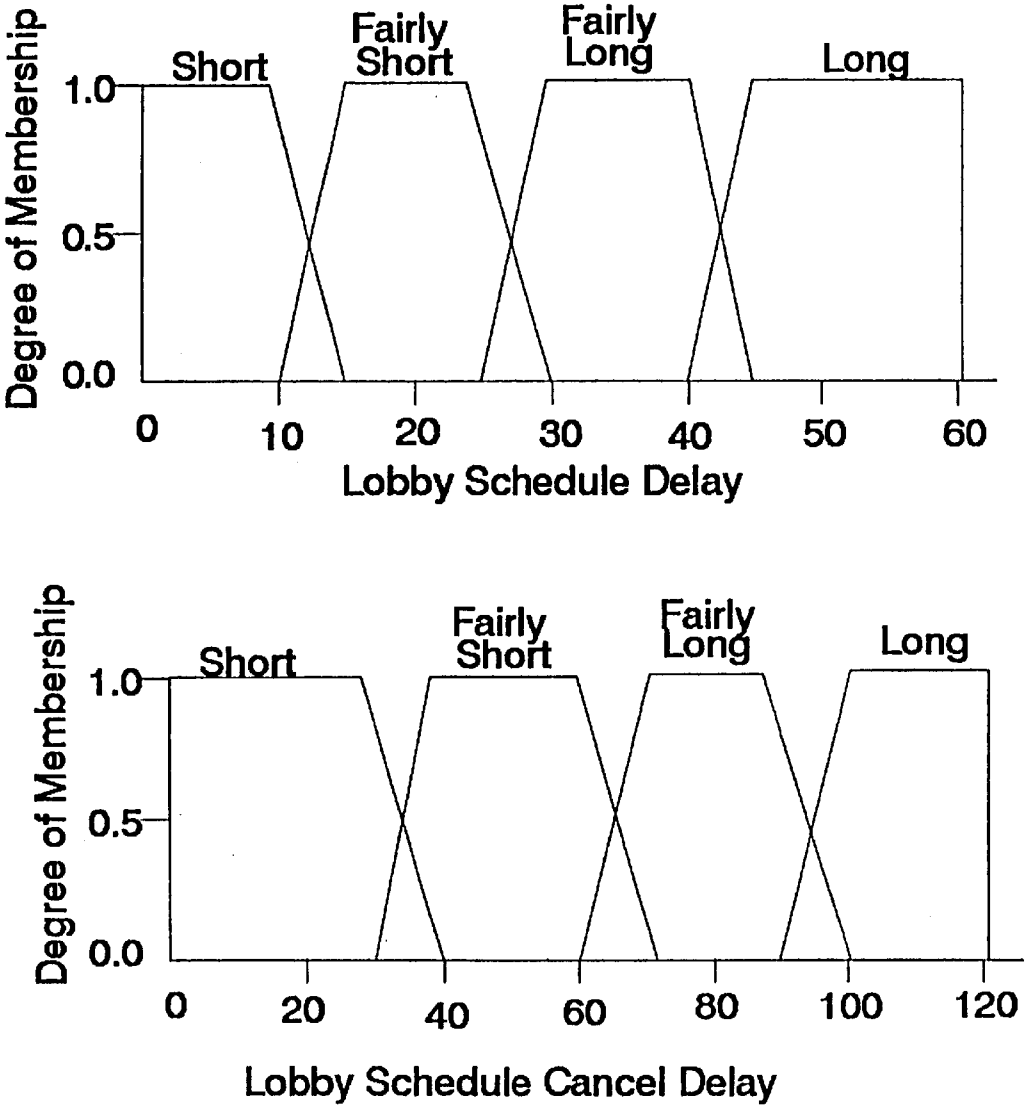
FIG. 25 is a diagram showing fuzzy sets and membership functions for lobby schedule delay and lobby schedule cancel delay.

Referring to FIG. 25, an example of fuzzy sets used to represent the lobby schedule delay and lobby schedule cancel delay is shown. The lobby schedule delay varies in the range of 0–60 seconds and lobby schedule cancel delay varies in the range of 0 to 120 seconds. Both delays are represented by the fuzzy sets of very short, short, fairly short and fairly long; but the ranges of the fuzzy sets are different for the two delays. The membership functions used in this example are linear. However, a non-linear membership function may also be used, as is known to one skilled in the art of fuzzy logic.

Table 19 shows a method of selecting lobby schedule delay and lobby schedule cancel delay based on lobby traffic, traffic rate and secondary direction hall calls present at non-lobby floors. The Table is used to derive fuzzy logic rules connecting the above three inputs and the control parameters. These rules are written in the fuzzy logic language.

TABLE 19

Method of Selecting Lobby Schedule Delay and Lobby Schedule Cancel Delay Using Fuzzy Logic

| Lobby Traffic | Lobby Traffic Rate | Number of Secondary Direction Hall Calls | Lobby Schedule Delay | Lobby Schedule Cancel Delay |
|---|---|---|---|---|
| Not any | Steady | Ignored | F. Long | Short |
| Light | Steady | Ignored | F. Long | Short |
| Light | Slowly | Ignored | F. Long | Short |
| Moderate | Slowly Decreasing | Ignored | F. Long | Short |
| Moderate | Steady | Few or Some | F. Short | Short |
| Moderate | Steady | Several or Many | F. Long | Short |
| Moderate | Slowly Increasing | Few or Some | Short | Short |
| Moderate | Slowly Increasing | Several or Many | F. Short | Short |
| Peak | Steady | Few or Some | V. Short | Long |
| Peak | Steady | Several or Many | Short | Long |
| Peak | Slowly or Fast Increasing | Few or Some | V. Short | Long |
| Peak | Slowly or Fast Increasing | Several or Many | V. Short | Long |
| Full | Steady or Slowly Increasing | Few or Some | V. Short | Long |
| Full | Steady or Slowly Increasing | Several or Many | V. Short | Long |

In one embodiment, the rules are compiled into C code and integrated with the code for lobby traffic estimation and other dispatcher C code. The resulting dispatcher software can then be executed whenever a car leaves the lobby with passengers in the primary direction and the number of secondary direction hall calls present at non-lobby floors changes. Accordingly, the required delays are calculated and when the dynamic scheduler determines the scheduled mode for lobby service, it will delay activating the scheduled service by lobby schedule delay. Thus, if during the lobby schedule delay, the dynamic scheduler determines that the lobby does not need scheduled service, the scheduled mode will not be activated.

Similarly, if the dynamic scheduler determines that the demand mode service is required for the lobby, it will delay activating the demand service by the lobby schedule cancel delay. If during the lobby schedule cancel delay, the dynamic scheduler determines that the lobby requires the scheduled mode, then the demand mode will not be activated. Thus, the transition from demand mode to scheduled mode and scheduled mode to demand mode are made with delayed response.

As can be seen from Table 19, when the lobby traffic and traffic rate are high, the lobby schedule delay is reduced, while lobby schedule cancel delay is increased. When the traffic and traffic rate are low, the lobby schedule delay is increased, while cancel lobby schedule delay is decreased. When the number of secondary direction hall calls made at floors other than the lobby is high, the lobby schedule cancel delay is decreased and lobby schedule delay is increased.

When the fuzzy logic is used to select the delays, the rule's premise degree of membership is computed using the joint set degrees of membership of lobby traffic and traffic rate and the degree of member of the secondary direction hall calls present in the secondary direction hall call fuzzy sets. Then the set degree method of inference is used to get the output set degrees of membership.

For each output set, the degrees of membership at different discrete points in the set range are precomputed and stored in a Table. These defined degrees are multiplied by the set degree of membership for that set to arrive at final degrees of membership at those discrete points. The final degrees of membership calculated at each discrete point are accumulated over all output sets and limited to 1.0. These accumulated final degrees of membership are used to calculate the crisp values of the delays using the centroid method of defuzzification.

2. Open loop adaptive fuzzy logic controller

An open loop adaptive fuzzy logic controller is an open loop controller with the capability to modify the membership function of the controlled parameter and the membership functions of some of the elevator control system input variables in real time based on specified criteria. The open loop adaptive fuzzy logic controller comprises the fuzzy logic controller described in the previous section and an adaptive controller for modifying the membership functions of the control parameters and some elevator control system inputs used as fuzzy logic controller inputs.

The adaptive controller is used to improve elevator control system performance by allowing the open loop adaptive fuzzy logic controller to adapt to various changing building and traffic conditions. The performance of the elevator control system is monitored using determined performance measures and the effectiveness of control is analyzed at regular time intervals as well as when specific events occur. Examples of specific events are a change in the number of secondary direction hall calls present, and a change in the number of cars bunched in the primary direction. In such a method certain elevator control system outputs are compared against other elevator control system outputs as is described hereinbelow.

Based on the analysis of performance measures, a decision is made to modify the control process, if the performance is desired to be improved. This improvement is achieved by modifying the membership functions of the fuzzy sets used for elevator control system inputs and control parameters. Thus, the adaptive controller generates transient membership functions for the fuzzy sets of controlled parameters and some elevator control system inputs from their determined membership functions. The method of varying the membership functions for different conditions of performance measures is predetermined and coded in the adaptive control logic for this purpose. The adaptation is a gradual process and uses a longer time cycle, for example three minutes. Since the lobby traffic and traffic rate are used as inputs in numerous fuzzy logic controllers and they are intermediate fuzzy variables, the adaptive controllers do not modify the membership functions of the lobby traffic and traffic rate.

Figure 26:
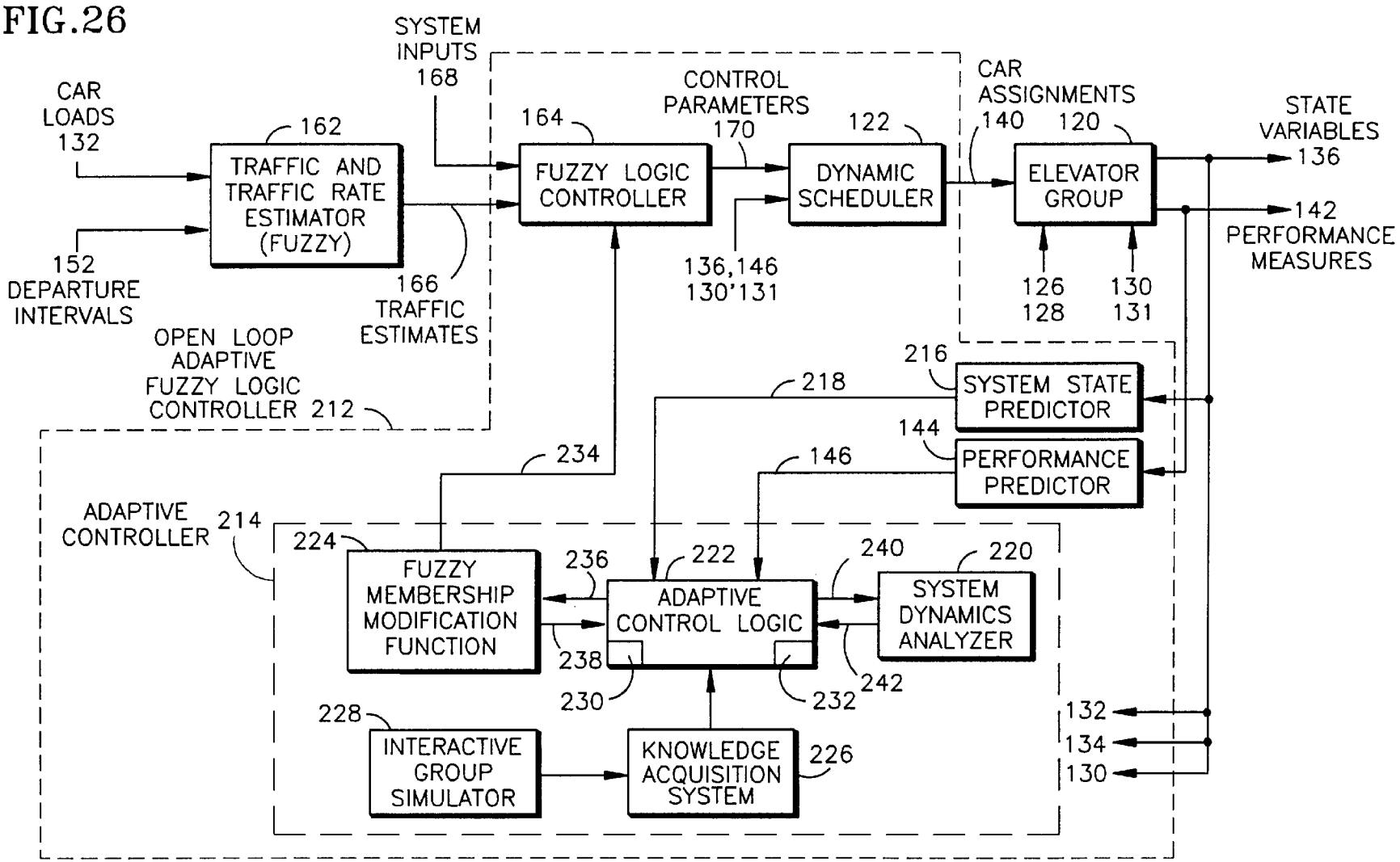
FIG. 26 is a simplified block diagram of an open loop adaptive fuzzy logic controller.

Referring to FIG. 26, a block diagram for the open loop adaptive fuzzy logic controller is shown. The open loop adaptive fuzzy logic controller 212 comprises the open loop fuzzy logic controller 164 and the adaptive controller for open loop 214. The adaptive controller 214 comprises a system state predictor 216, a performance predictor 144, a system dynamics analyzer 220, an adaptive control logic 222, a fuzzy membership modification function 224, a knowledge acquisition system 226 and an interactive group simulator 228. State variables, for example, a number of cars bunched in the primary direction, a number of car calls registered in the car when the car leaves the lobby, and a number of hall stops made in the up and down direction, are input to the system state predictor 216 at preset time intervals and when specific events occur. The predicted values 218 of these state variables are used as one set of inputs by the adaptive control logic 222.

Performance measures, for example, lobby hall call registration times, non-lobby hall call registration times and the round trip times of the cars are also recorded at preset time intervals and if specific events occur. The performance is then predicted, by the performance predictor 144, at regular intervals. The predicted performance data 146 are used as another set of inputs to the adaptive control logic 222.

The adaptive control logic 222 determines, at one minute intervals, if the membership functions of the fuzzy sets of the controlled parameters or the elevator control system input variables need to be modified to improve system performance. The adaptive control logic is shown for the controlled parameters by the subblock 230 and for the elevator control system inputs by the subblock 232. Detailed description of the adaptive control logic is explained hereinbelow. The adaptive control logic is provided with sets of elevator control system output variables to be used to identify the need for modifying the membership functions of the fuzzy sets. Each set of variables has two elevator control system output variables for purposes apparent in the light of the description of FIG. 30, hereinbelow. The adaptive control logic sends one set 240 at a time to the system dynamics analyzer, to evaluate the changes and receive data 242 regarding requirements for changing the fuzzy sets. The adaptive control logic determines the fuzzy set modification requirement based on the data received from the system dynamics analyzer. Modification requests are passed as inputs 236 to the fuzzy membership modification function 224. The fuzzy membership modification function 224 modifies the membership functions of the fuzzy sets as required and stores the information in the GCSS's memory, via memory writes 234, for use by the open loop fuzzy logic controller. The fuzzy set modification completion is indicated by signal 238.

Figure 27:
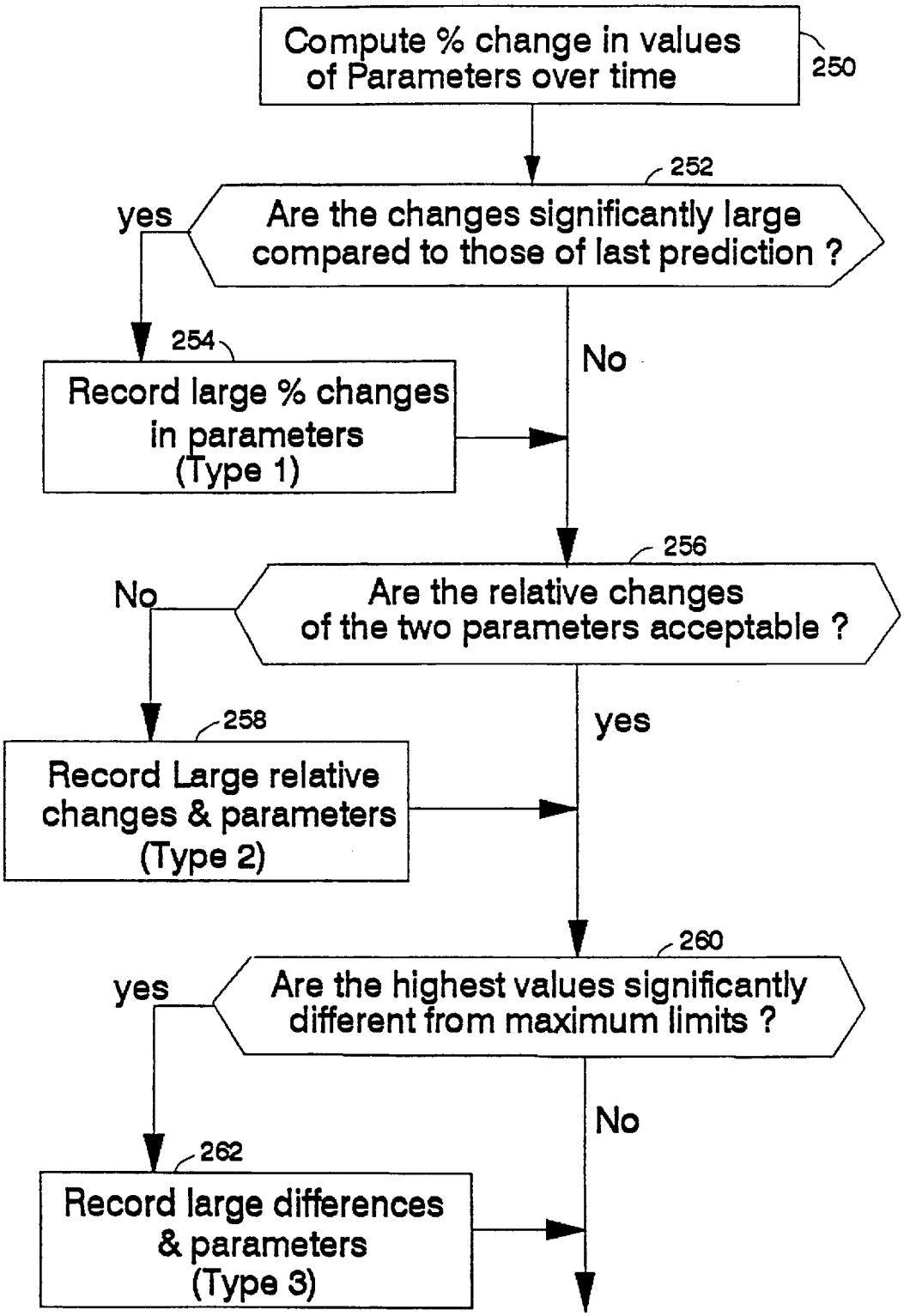
FIG. 27 is a flow diagram of a system dynamics analyzer logic of the adaptive controller.

Referring to FIG. 27, the operation of the system dynamics analyzer is shown. The system dynamics analyzer is used to evaluate the changes in two elevator control system output variables at a time. Three types of changes are determined, namely, percentage changes over time, the relative changes between the two elevator control system output variables and values of the elevator control system output variables relative to determined maximums. The system dynamics analyzer computes, in Step 250, a percentage change of determined performance measures from previously predicted values. Then it determines if the values computed are significantly different from the values computed at the end of previous predictions interval in Step 252. If these changes are significant, when compared to some determined percentages, for example 25% or more, then the elevator control system output variables with large changes and the amount of changes are recorded in Step 254. This is recorded as Type 1 change for the elevator control system output variable. Then in Step 256, it compares two elevator control system output variables at a time to check if the relations between them are acceptable. For example, the changes will be acceptable if they are linear or within preset limits. If not acceptable, the elevator control system output variable that has changed significantly from the previous evaluation time is recorded along with its associated relative magnitude of change, in Step 258. This is Type 2 change for the elevator control system output variable. Then, in Step 260, the highest values of elevator control system output variables are checked against the maximum limits. If the elevator control system output variables are significantly different from the maximum limits, the elevator control system output variables with significant differences are again recorded in Step 262. If the elevator control system output variable is significantly lower than the maximum, it is noted as a large negative difference; if it is significantly higher than the maximum, it is recorded as a large positive difference. This is Type 3 change for the elevator control system output variable.

Figure 28:
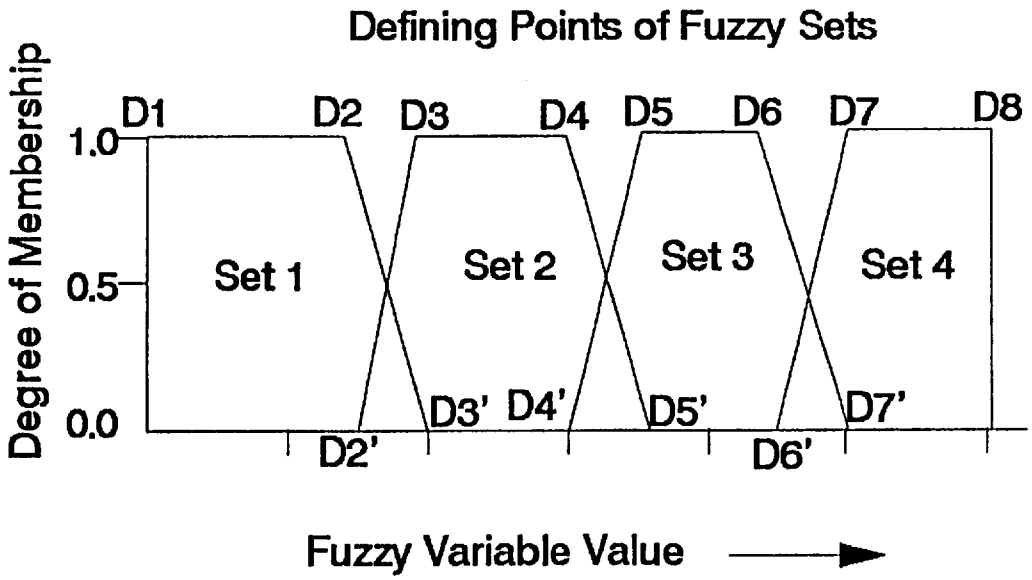
FIG. 28 is a graph showing the definition of fuzzy sets using linear membership functions and defining points of the lines.

The method of modifying the degrees of membership is explained with reference to FIGS. 28 and 29. The membership functions are assumed to be linear in this example. FIG. 28 shows the fuzzy sets with linear membership functions. The number of fuzzy sets, for the controlled parameter or fuzzy logic controller input variable are finite, for example, four. The fuzzy sets are defined using defining points D1, D2, D3, D4, D5, D6, D7 and D8. In this example there are eight defining points. The initial fuzzy sets are defined using these points; these are the specified fuzzy sets. At D2, D3, D4, D5, D6, D7 the degrees of memberships are 1.0. D2' and D2 have same value of the fuzzy variable but the degree of membership at D2' is zero. D2' is in higher fuzzy set as compared to D2. D3' has zero degree of membership and is in a lower fuzzy set as compared to D3. D3', D4', etc. are thus derived from D2, D3, etc.

The fuzzy set modifications can be made using several methods. In the first method, the range or the universe can be scaled up or down. If the range was, for example, initially 60 seconds, then by scaling up, the range can become more than 60 seconds, and, by scaling down, the range can become less than 60 seconds. Then the location of points D2 to D8 will be moved right or moved left so the controller output can be changed. This method is called a mode 1 change. The scaling up is done using the scaling factor greater than 1.0; the scaling down is done by specifying scaling factor less than 1.0.

In the second method, the top range of the fuzzy sets can be increased by a factor or decreased by a factor. When top range of set 1 is expanded, D2 moves to the right; if it is contracted, D2 moves to the left. If a top width of a given set, set 4 in this example, is expanded, D7 moves to the left; if it is contracted D7 moves to right. By expanding or contracting the middle sets, D3, D4, D5 and D6 locations can be changed. This method of fuzzy set modification is denoted as mode 2 change. To effect this change, the expansion or contraction factor should be given separately, for each set. Expansion factors greater than 1.0 expend the set's range; expansion factors less than 1.0 actually contract the sets. By changing the fuzzy sets using this method, the output of the controller and the effects of the input variable can be changed. All fuzzy sets can be made triangular by using the expansion factors of 0.0.

In a third method, the midpoint of the top range of the fuzzy set can be shifted left or right. The shift is positive if moved to the right and negative if moved to the left. The shift is specified in fraction of the universe for example, 0.08 times range. Only the fuzzy sets in the middle, not the terminal sets can be modified using this method.

In a fourth method, the top range of individual sets is specified in fraction of range of variable. This method is used to get trapezoidal membership functions from triangular membership functions. This is indicated using negative scale factors. Table 20 shows an example of fuzzy set modification instructions.

TABLE 20

Examples of Fuzzy Set Modification Instruction

| Mode | Scale Factor or Expansion Factor | Shift Amount | Sets Affected | Remarks |
|---|---|---|---|---|
| 1 | 1.3 | — | — | Range = 1.3* Initial range |
| 1 | 0.7 | — | — | Range = 0.7* Initial range |
| 2 | 1.3 | — | 1 | Set 1 range = 1.3* Initial set 1 range |
| 2 | 1.3 | — | 3 | Set 3 range = 1.3* Initial set 3 range |
| 2 | 0.7 | — | 2 | Set 2 range = 0.7* Initial set 2 range |
| 2 | 0.7 | — | 4 | Set 4 range = 0.7* Initial set 4 range |
| 2 | 0.0 | — | 3 | Set 3 range = 0.0* Initial set 3 range |
| 3 | — | −0.05 | 2 | Move the center of set 2 to the left by 0.05* variable range |
| 3 | — | 0.10 | 3 | Move the center of set 3 to the right by 0.10* variable |
| 4 | −0.10 | — | 1 | Set 1 range = 0.10* variable range |
| 4 | −0.15 | — | 3 | Set 3 range = 0.15* variable range |

Figure 29:
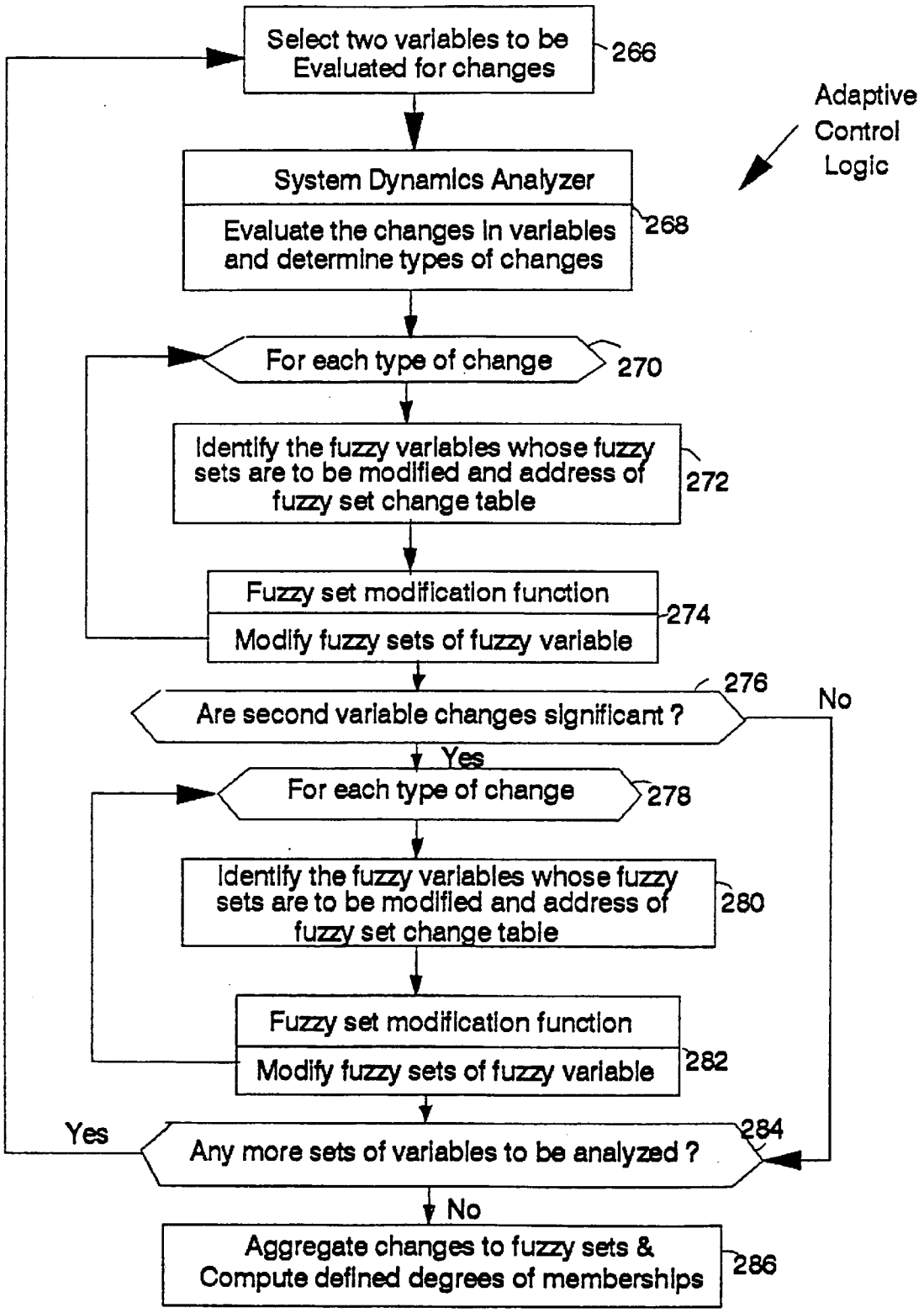
FIG. 29 is a flow diagram of an adaptive control logic.

Referring to FIG. 29, the flow diagram of the adaptive control logic 222 is shown. At step 266, the adaptive control logic selects the set of performance measures to be analyzed to identify if the fuzzy sets need to be changed. This selection is done from a table of sets of two elevator control system output variables. The table is dependent on the fuzzy logic controller design.

The two performance elevator control system output variables selected are passed to the system dynamics analyzer 220. The elevator control system output variables are analyzed in step 268 by the system dynamics analyzer to identify percentage changes over time, relative changes between the two elevator control system output variables and the values relative to determined maximums, if significant, these are indicated by setting Type 1, Type 2 and Type 3 flags on and indicating the magnitude of the change for Type 1 and Type 2, and value for Type 3.

Then in step 270, the type of change is selected as Type 1, Type 2 or Type 3. The type of change and the magnitude of change are used in step 272 to identify the fuzzy sets to be modified and the types of modifications to be made. Tables 21, 22 and 23 known as cross correlation tables are used for this purpose. Referring to Table 21 for Type 1 change, the percentage of change of the elevator control system output variable from the value at the previous prediction interval, and the value at the previous prediction interval are used to identify the fuzzy sets to be modified and their respective changes. For example, if the elevator control system output variable is the performance measure of non-lobby hall call highest registration time, then the values selected for rows (value 1–value 5) may be 60, 75, 90, 105, 120 seconds. The change levels may be 25%, 50%, 75%, 100% and 150%. Thus, if the value of the performance measure was less than 60 seconds and the percentage change was less than 25%, no changes in the fuzzy sets will be made. If the value was between 60 and 75 seconds and the percentage change was between 25% and 50%, then the entry in row 1 and column 1, namely X11, points to the location where the fuzzy sets to be changed and the address of the required modifications instructions are located. Similarly X42 shows the location where the fuzzy sets to be changed and the address of the required modification instructions are stored for fuzzy variable value greater than 105 seconds but less than 120 seconds and percentage changes greater than 50% but less than 75%.

Table 22 shows the fuzzy set change table addresses for Type 2 changes which is relative percentage changes of the first elevator control system output variable against the second elevator control system output variable. If the first elevator control system output variable change is dx % the second elevator control system output variable change is dy% then the relative change is dx−dy. Table 23 shows fuzzy set change table addresses for type 3 changes, which are the variation of the highest value of the elevator control system output variable from the determined maximum. A set of addresses specify the change Tables for positive changes and another set of addresses specify change Tables for negative changes.

TABLE 21

Cross Correlation Table for storing the addresses for required fuzzy set change Table for Type 1 change

| | Change Level 1 25% | Change Level 2 50% | Change Level 3 75% | Change Level 4 100% | Change Level 5 150% |
|---|---|---|---|---|---|
| Value 1 | X11 | X12 | X13 | X14 | X15 |
| Value 2 | X21 | X22 | X23 | X24 | X25 |
| Value 3 | X31 | X32 | X33 | X34 | X35 |
| Value 4 | X41 | X42 | X43 | X44 | X45 |
| Value 5 | X51 | X52 | X53 | X54 | X55 |

TABLE 22

| Cross Correlation Table for storing the addresses of fuzzy set change Table for Type 2 change | | | | | |
|---|---|---|---|---|---|
| Change Level 1 25% | Change Level 2 50% | Change Level 3 75% | Change Level 4 100% | Change Level 5 150% | Change Level 6 200% |
| X1 | X2 | X3 | X4 | X5 | X6 |

TABLE 23

| Cross Correlation Table for storing the addresses of fuzzy set change Table for Type 3 change. | | | | | |
|---|---|---|---|---|---|
| | Change Level 1 20% | Change Level 2 40% | Change Level 3 60% | Change Level 4 80% | Change Level 5 100% |
| Positive | Z1 | Z2 | Z3 | Z4 | Z5 |
| Negative | Z6 | Z7 | Z8 | Z9 | Z10 |

Table 24 shows the contents of fuzzy set change Table. It shows the addresses of the fuzzy sets to be changed and the Table where the required modification instructions are stored. The fuzzy set address points to the memory locations where the defining points of the fuzzy set are stored. These entries are modified using the modification instructions.

TABLE 24

| Fuzzy set change Table | |
|---|---|
| Fuzzy Set Address | Modification Instructions Table Address |
| Y1 | T1 |
| Y2 | T2 |
| Y3 | T3 |

A modification instruction table contains fuzzy sets which are to be modified and how the fuzzy sets are to be modified. The modification instruction table looks similar to Table 20 and contains the mode of change, the factors to be used, the shift amount and the set to be modified. Thus, knowing the type of change and the magnitude of the change, the fuzzy sets to be modified and the types of modifications are identified.

Thus, knowing the types of changes and the magnitudes of changes, the fuzzy sets to be modified and the location of the modification instructions table are obtained. The adaptive control logic 222, sends these instructions to the fuzzy set modification function 224. The fuzzy sets are modified in step 274, by computing the positions of defining points D1, D2, D3, D4, D5, D6, D7, D8 using these instructions.

Then, in step 276, the second elevator control system output variable's changes are determined to be significant or not. If significant, step 270 is repeated for the second elevator control system output variable in step 278. Then step 272 is repeated for the second elevator control system output variable in step 280. Step 274 is repeated for the second elevator control system output variable in step 282. In step 284, the other sets of two elevator control system output variables, if required, are identified. The process from steps 266 to 282 is repeated for other sets of two elevator control system output variables. The adaptive control logic thus effects changes in the fuzzy sets in response to changes in the values of the performance elevator control system output variables.

When several sets of two performance or state variables are analyzed, more than one set may indicate changes in the same fuzzy sets. In such cases, the changes due to each elevator control system output variable is made separately. Finally, the aggregate changes are computed in step 286.

Then the defined degree of memberships are computed for controlled parameter. The computed fuzzy sets and the defined degrees of controlled parameter are written to the GCSS's memory (FIG. 26) through memory writes 234.

The tables for making fuzzy set changes are generated by a learning process using interactive simulation. The adaptive controller (FIG. 26) is provided with a knowledge acquisition system 226 and interactive group simulator 228 for this purpose. When the elevator group controller is not busy, interactive simulations are performed by the interactive simulator 228. This simulator has choice of several traffic profiles.

For example, the normal traffic for the up peak or noon time period can be magnified by a percentage, for example 25%; this is an abnormal situation. As another example, the normal traffic can be served with one car out of service. A third example will be to add a secondary lobby and assume part of the traffic to originate from the secondary lobby. A fourth example is to assume a cafeteria at a higher floor, for example the third floor and assume part of the lobby traffic terminates at the cafeteria and then starts from the cafeteria thereafter, for example, ten minutes and travels to a final destination. A fifth example is to assume a transit station near the building and to assume that 50% of each five minute period traffic enters the building within a one minute period.

The interactive group simulator is instructed by a skilled person, one skilled in the art of elevator dispatching, to run simulations and monitor system dynamics. The elevator control system output variables to be monitored are specified in sets of two elevator control system output variables. When the simulations are run, the system dynamics analyzer 220 monitors these elevator control system output variables. The simulation stops whenever the observed changes in the elevator control system output variables monitored have significant Type 1, Type 2 or Type 3 changes. The skilled person then can ask the simulator to display the fuzzy logic controllers used in the system and their input and output variables such that the fuzzy set defining points and fuzzy variable ranges can also be examined. The skilled person can then request the simulator to save a current simulation state so that the skilled person can input changes to the fuzzy sets in the form of modification instructions as shown in Table 20. The simulator is then run and the system dynamics again analyzed. If the fuzzy set changes resulted in improved performance during the next, for example, five minutes the skilled person will instruct the simulator to save the fuzzy set changes using the knowledge acquisition system 226. The knowledge acquisition system records the fuzzy set change modifications table addresses and fuzzy set addresses in a table similar to Table 24. Then the address of this table is stored in Cross Correlation Table 21, 22 or 23 by the knowledge acquisition system.

By repeating simulations with several different types of traffic profiles, various situations involving significant changes in two elevator control system output variables are observed. The modifications to the fuzzy sets are input by the skilled person. The simulations are then run and performance is again analyzed. When performance is acceptable, the fuzzy set changes are recorded in appropriate Tables. The interactive simulator 228 and the knowledge acquisition system 226 are thus used to generate the fuzzy set change tables, fuzzy set modification instruction tables and cross correlation tables. These tables are then used in real time for adaptive control of the open loop fuzzy logic controller.

The fuzzy logic controller 164 used in the open loop adaptive fuzzy logic controller is the same as that described in the previous section. An example of the implementation of the open loop adaptive fuzzy logic controller is described below.

A. An open loop adaptive fuzzy logic controller to select the number of cars assigned to the lobby during noon time.

In order to adapt the fuzzy sets used in the fuzzy logic controller 164 that selects the number of cars assigned to the lobby during noon time, the highest lobby hall call registration time and the highest non-lobby hall call registration time are recorded for each minute and used to predict these values for the next three minutes by the system performance predictor 144.

Figure 30:
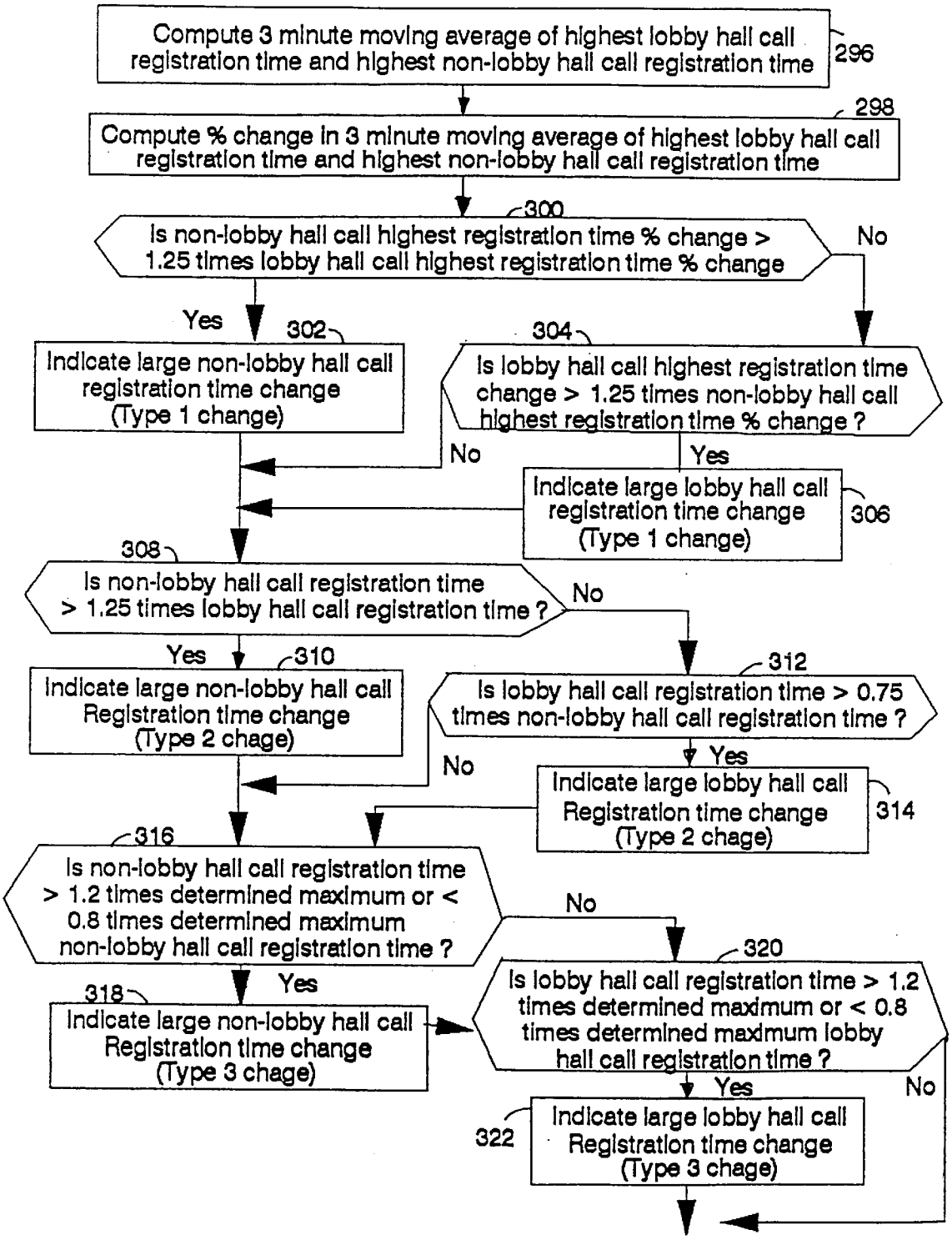
FIG. 30 is a flow diagram of a system dynamics analyzer logic for use with the open loop adaptive fuzzy logic controller.

Referring to FIG. 30, the operation of the system dynamics analyzer 220 of the adaptive controller 214 is shown. In Step 296, the three minute moving average (MA) of the highest lobby hall call registration time and the highest non-lobby hall call registration time are made once per minute, by the performance predictor 144.

In Step 298, percentage changes in the moving averages from those computed during the previous minute are calculated. Then, in Step 300, a percentage change of the non-lobby highest hall call registration time is compared against a percentage change of the highest lobby hall call registration times. If the percentage change of the highest non-lobby hall call registration time is more than, for example, 1.25 times the percentage change of the highest lobby hall call registration time, it is recorded as a type 1 change of non-lobby hall call registration time in Step 302. If the percentage change of the highest non-lobby hall calls is less than 1.25 times the percentage change of the highest lobby hall call registration time, then in Step 304, it is determined if the percentage change of the highest lobby hall call registration time is more than for example, 1.25 times the non-lobby hall call highest registration time. If so, it is recorded in Step 306, as the type 1 change of lobby hall call registration time.

In Step 308, a moving average, ("MA") of the non-lobby hall call highest registration time is compared against a moving average of the highest lobby hall call registration time. If the MA of the highest non-lobby hall call registration time is more than, for example, 1.25 times the MA of the highest lobby hall call registration time, then in Step 310 it is recorded as a type 2 change of non-lobby hall call highest registration time. If the MA of the highest non-lobby hall call registration time is less than 1.25 times the MA of the highest lobby hall call registration time, then in Step 312, the MA of lobby hall call highest registration time is compared against the MA of the highest non-lobby hall call registration time. If the MA of the highest lobby hall call registration time is more than 0.75 times the MA of the highest non-lobby hall call registration time, then in Step 314 it is recorded as a type 2 change of lobby hall call highest registration time.

In Step 316, the MA of the non-lobby highest hall call registration time is compared against a determined maximum non-lobby hall call registration time. If the difference between them is more than, for example 20%, and the highest non-lobby hall call registration time exceeds the determined maximum non-lobby hall call registration time, it is recorded in Step 318 as a positive type 3 change for highest non-lobby hall call registration time; if the highest non-lobby hall call registration time is less than maximum non-lobby hall call registration time, it is recorded in Step 318, as a negative type 3 change for non-lobby hall call registration time. Then, in Step 320, the MA of the highest lobby hall call registration time is compared against the determined maximum lobby hall call registration time. If the MA of the highest lobby hall call registration time exceeds the maximum lobby hall call registration time by 20% it is recorded in Step 322, as the positive type 3 change for lobby highest hall call registration time. If the MA of highest lobby hall call registration time is less than the maximum lobby hall call registration time by more than 20%, it is recorded, in Step 322, as the negative type 3 change for lobby hall call registration time.

Figure 31:
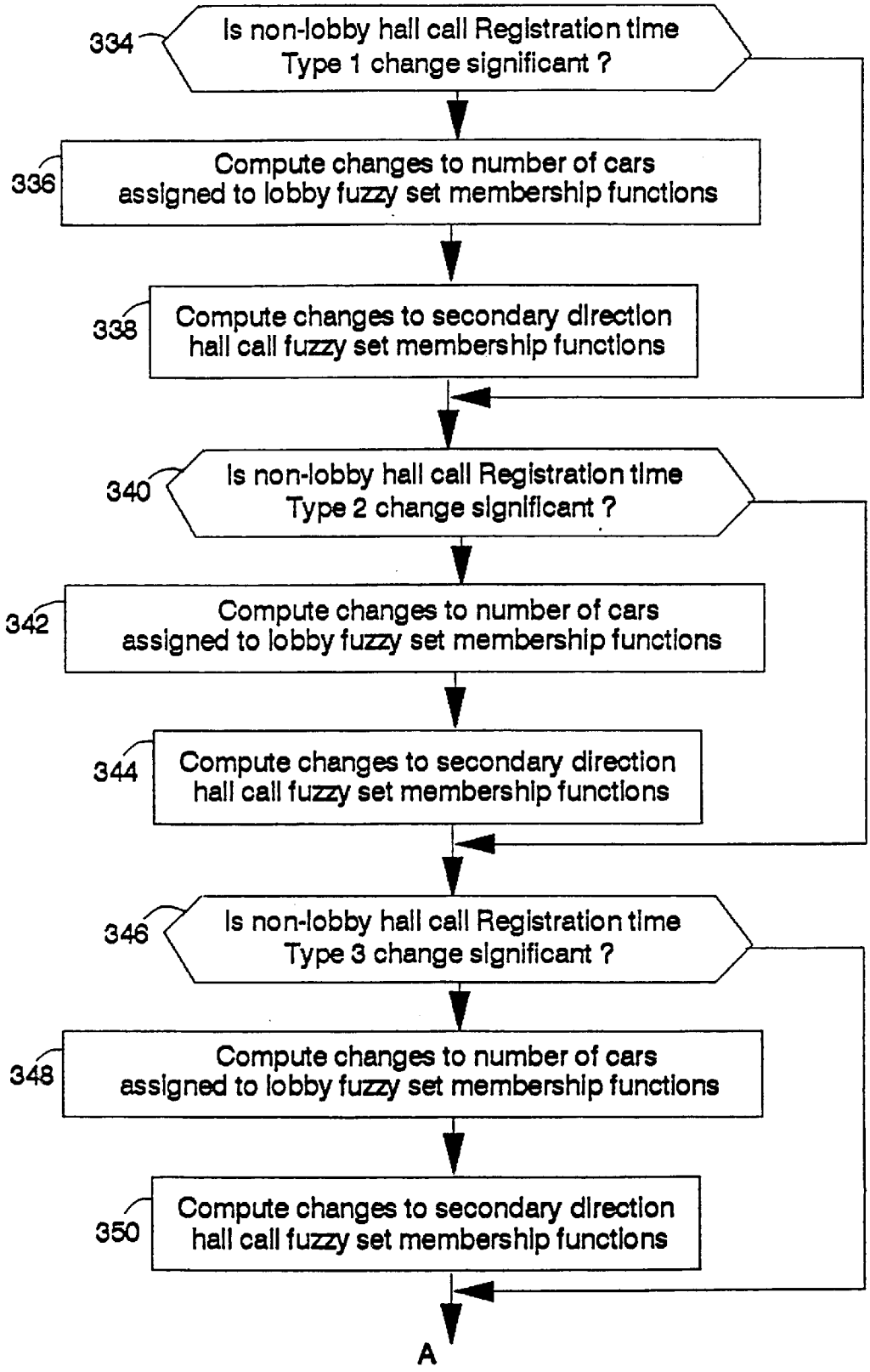
FIGS. 31 and 31*a* are flow diagrams of an adaptive control logic used with the open loop adaptive fuzzy logic controller.

Referring to FIG. 31, a method of determining required changes of the fuzzy set membership functions for the fuzzy logic controller is shown. This required modifications to the fuzzy sets of number of cars assigned to the lobby and the predicted secondary direction hall calls are obtained using cross correlation tables similar to Tables 21, 22 and 23, fuzzy set change tables similar to Table 24 and fuzzy set modification instructions tables similar to Table 20, produced specifically for this controller using interactive simulations.

In Step 334, the type 1 change for non-lobby hall call registration time is determined to be significant or not. If it is significant, then in Step 336, the required modifications to the number of cars assigned to the lobby fuzzy sets is computed and saved. If the non-lobby hall call registration time increases faster than the lobby hall call registration, and the highest non-lobby hall call registration time is close to an allowed maximum, and the number of cars assigned to the lobby is more than two, then the number of cars assigned to the lobby may be decreased by one. This modification is recorded. Similarly, the secondary direction hall call fuzzy sets are adjusted, so a lower number of secondary direction hall calls are associated with higher categories of fuzzy sets. This again decreases the number of cars assigned to the lobby. Such fuzzy set modifications are determined in Step 338 and recorded.

In Step 340, the type 2 change in the highest hall call registration time of the non-lobby hall call is analyzed and the required fuzzy set modifications for number of cars assigned to lobby computed and recorded in Step 342. The changes to the down hall call fuzzy set is computed and recorded in Step 344.

Figure 31A:
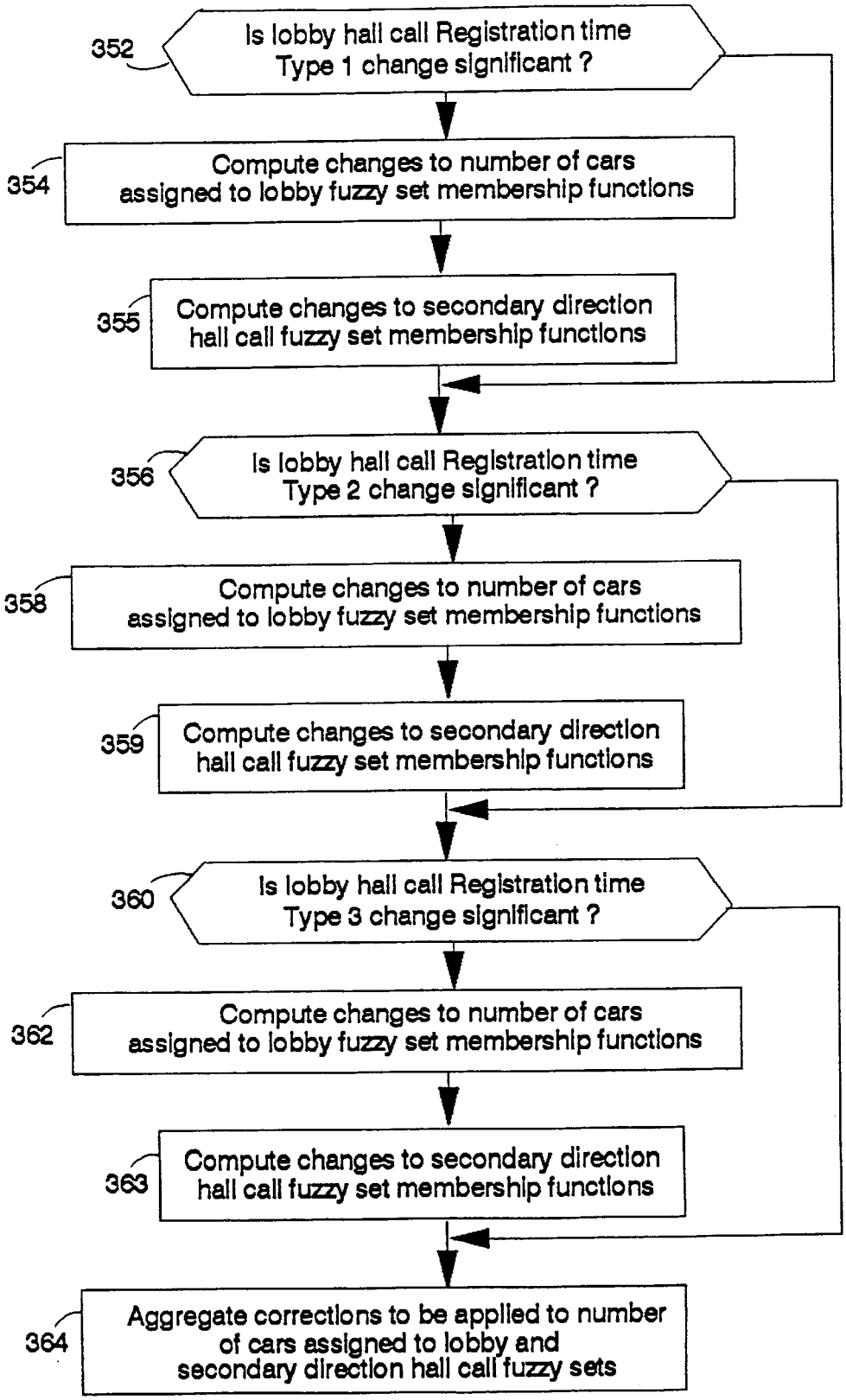

Steps 346, 348 and 350 determine the changes in the fuzzy set membership functions for type 3 changes of the highest non-lobby hall call registration times. Steps 352 through 363 (FIG. 31*a*) compute the required changes to the membership functions of the fuzzy sets due to type 1, type 2 and type 3 changes in the highest hall call registration times of lobby hall calls. Then, in Step 364, the required fuzzy set membership function changes for the non-lobby hall call registration time changes and the lobby hall call registration time changes are compared with the initial fuzzy set membership function and the final changes determined.

The fuzzy set memberships are then modified, and the defined degrees of membership values calculated for rule output fuzzy sets, by membership function modification function 224. Thus, the system adapts itself as the secondary direction non-lobby hall calls change during noon time.

3. Closed loop fuzzy logic controller

A closed loop fuzzy logic controller uses the lobby traffic and traffic rate as one set of inputs and elevator control system outputs as another set of inputs. The elevator control system outputs can be elevator control system state variables or performance measures. The controller can also use other elevator control system inputs as controller inputs. The elevator control system performance data are collected and used to make predictions for the next period. The predicted values are used as inputs. The controller can be executed whenever a car leaves the lobby in the primary direction and whenever the elevator control system makes predictions on performance. Since the relationships between the controller input variables and the controlled parameters are complex and there is uncertainty in the predicted values of elevator control system input and output variables, fuzzy logic is well suited to make decisions and select the control parameters.

The closed loop fuzzy logic controller does not use reference inputs and does not compute control errors as used in classical control problems. Rather, fuzzy logic rules are written by directly using the system output variables and their fuzzy sets.

Figure 32:
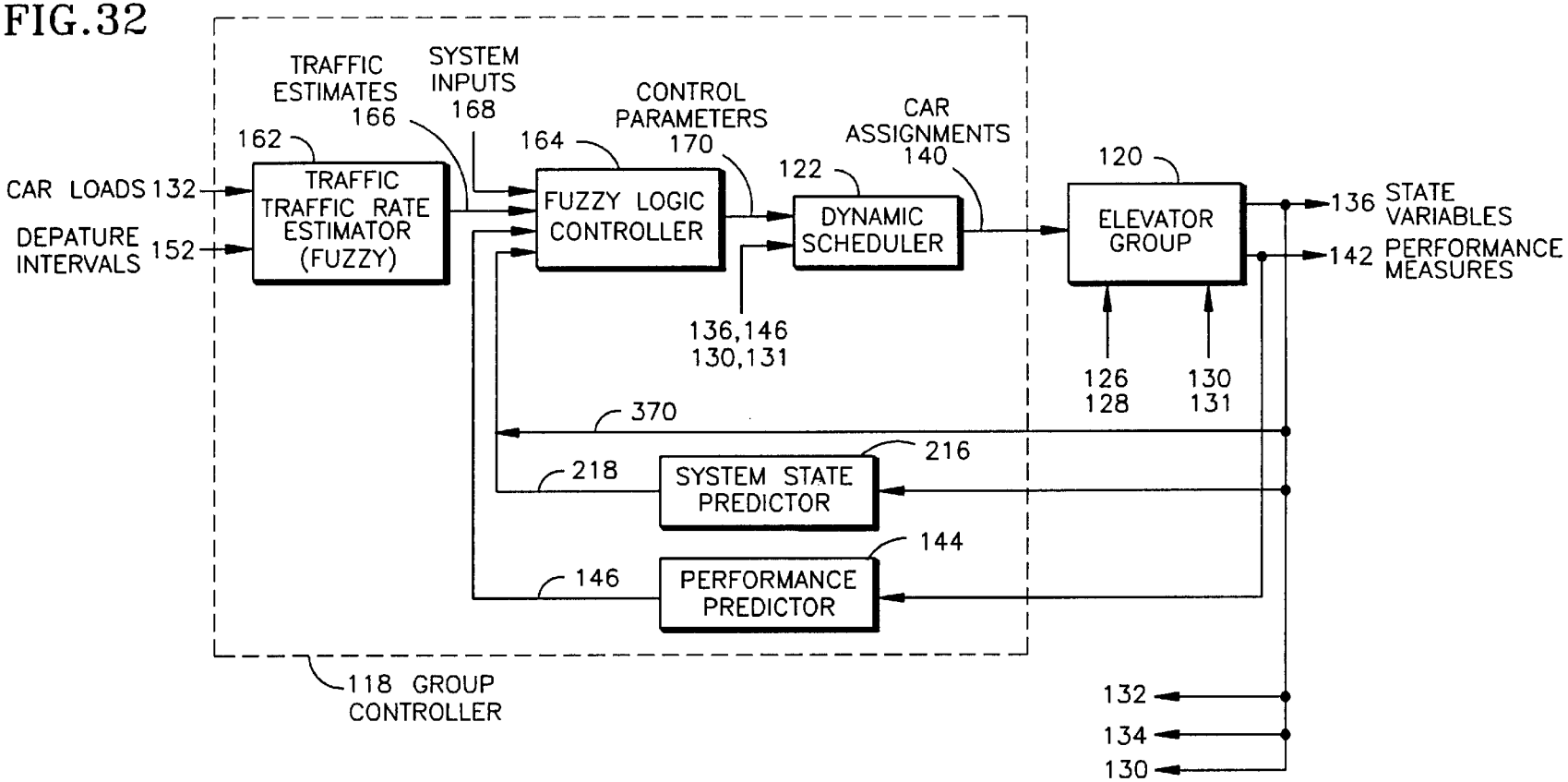
FIG. 32 is a simplified block diagram of a closed loop fuzzy logic controller.

Referring to FIG. 32, a block diagram of the closed loop fuzzy logic controller is shown. State variables 136 are either directly used as inputs 370 or used in the state predictor 216 to generate some state related inputs 218 to the closed loop fuzzy logic controller. For example, during noon time, the car loads of three cars arriving at the lobby are used to identify the presence of significant secondary direction traffic. In such situations, the moving average of secondary direction car loads are used as the lobby predictions 218 to control the number of cars assigned to the lobby. Thus, hall calls made at floors get an adequate supply of cars. Similarly, some performance measures 142 are included as inputs to the closed loop fuzzy logic controller. For example, the lobby and non-lobby hall call registration times are used as inputs to the fuzzy logic controller 164. The performance measures are predicted in the performance predictor 144 and used. The moving average of hall call registration times of three successive hall calls at the lobby or the three minute predictions of hall call registration times of the non-lobby hall calls in the secondary direction are used as predicted performance measures 146. By including the state variables and performance measures in the controller input, the controller can quickly respond to changing traffic conditions in the building. This control method is different from the adaptive control method, because this method does not modify the fuzzy sets of the input or output variables, but instead uses more inputs selected from the elevator control system outputs. The operation of the closed loop fuzzy logic controller is illustrated in five examples described hereinbelow.

A. A closed loop fuzzy logic controller to select the number of cars assigned to the lobby during an up peak period in buildings close to transit stations.

In buildings close to transit stations, a large number of people often come to the lobby during a short interval. In order to serve such large passenger arrivals, it is necessary to send more cars to the lobby, as compared to buildings not having such large passenger arrivals during a short period. Accordingly, the closed loop fuzzy logic controller, using the lobby hall call registration times as one of the inputs, is preferred to select the number of cars assigned to the lobby.

Figure 33:
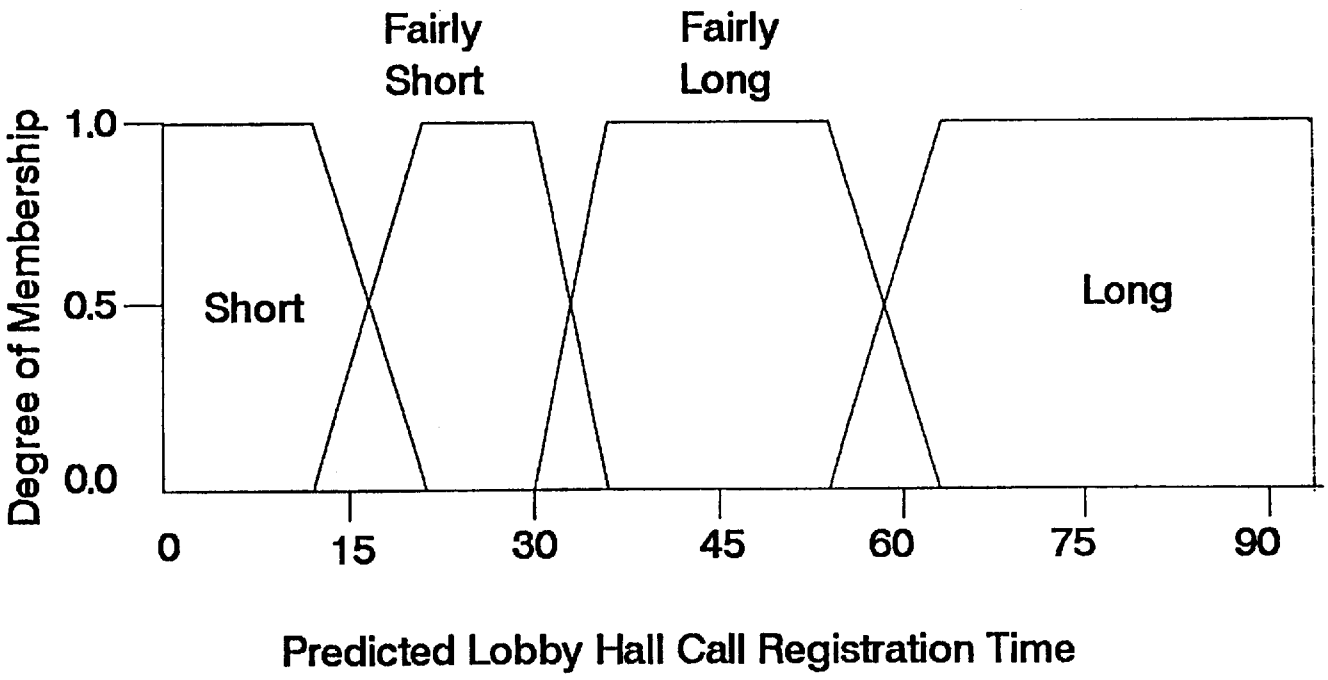
FIG. 33 is a graphical illustration showing fuzzy sets and membership functions for a predicted lobby hall call registration time.

Referring to FIG. 33, an example of fuzzy sets and membership functions used to categorize lobby hall call registration times is shown. The moving average of the registration times of three successive lobby hall calls is used as the closed loop input. The moving average registration time is categorized using the fuzzy sets of short, fairly short, fairly long and long. By using the real time predicted hall call registration times, the closed loop fuzzy logic control can adjust the control parameters rapidly as lobby traffic conditions change.

This example uses the lobby traffic, traffic rate and the predicted lobby hall call registration time as inputs to select the number of cars assigned to the lobby. Table 25 shows the method of selecting the number of cars assigned to the lobby using lobby traffic, traffic rate and the predicted lobby hall call registration time as inputs. This method is preferred during up peak periods if the counterflow and interfloor traffic are not significant, but lobby hall call registration times vary over a wide range.

TABLE 25

Method of Selecting the Number of Cars Assigned to Lobby Using Lobby Traffic, Traffic Rate and Lobby Hall Call Registration Time.

| Lobby Traffic | Lobby Traffic Rate | Lobby Hall Call Registration Time | Number of Cars Assigned to Lobby |
|---|---|---|---|
| Not Any | Steady | — | Few |
| Light | Steady | — | Few |
| Light | Slowly Increasing | — | Few |
| Moderate | Slowly Decreasing | — | Few |
| Moderate | Steady | Short or Fairly Short | Some |
| Moderate | Steady | Fairly long or long | Several |
| Moderate | Slowly Increasing | Short or Fairly Short | Some |
| Moderate | Slowly Increasing | Fairly long or long | Several |
| Moderate | Fast Increasing | Short or Fairly Short | Some |
| Moderate | Fast Increasing | Fairly long or long | Several |
| Peak | Steady | Short or Fairly Short | Some |
| Peak | Steady | Fairly long or long | Several |
| Peak | Slowly Increasing | Short or Fairly Short | Several |
| Peak | Slowly Increasing | Fairly long or long | Many |
| Peak | Fast Increasing | Short or Fairly Short | Several |
| Peak | Fast Increasing | Fairly long or long | Many |
| Full | Steady | Short or Fairly Short | Several |
| Full | Steady | Fairly long or long | Many |
| Full | Slowly Increasing | Short or Fairly Short | Several |
| Full | Slowly Increasing | Fairly long or long | Many |

Fuzzy logic rules are written using Table 25, connecting the number of cars assigned to the lobby with lobby traffic, traffic rate and lobby hall call registration times as described above. The fuzzy logic rules are coded in the fuzzy programming language and C code is produced, as described above. The software is then used with the dispatcher software to select the number of cars assigned to lobby, whenever a car leaves the lobby with passengers in the primary direction. The method of obtaining the number of cars assigned to the lobby from the lobby traffic, traffic rate and predicted lobby hall call registration time is same as the method used to obtain the number of cars assigned to lobby using lobby traffic, traffic rate and the predicted number of down hall calls as explained in the open loop fuzzy logic control method.

B. A closed loop fuzzy logic controller to select the number of cars assigned to the lobby during up peak period in buildings with a cafeteria floor and/or a secondary lobby.

In buildings with cafeteria floors and/or a secondary lobby, often there is significant traffic originating at floors other than the lobby during the up peak period. Consequently, the car assignment process for the lobby should adequately consider service requirements at non-lobby floors during the up peak period; this is achieved by using the non-lobby hall call registration times as one of the inputs in selecting the number of cars assigned to the lobby. For example, the highest hall call registration times for three minutes can be used to predict the highest hall call registration time for the next three minutes for non-lobby floors.

This closed loop controller uses the lobby traffic, traffic rate and the predicted non-lobby hall call registration time as inputs to select the number of cars assigned to the lobby during up peak period.

Figure 34:
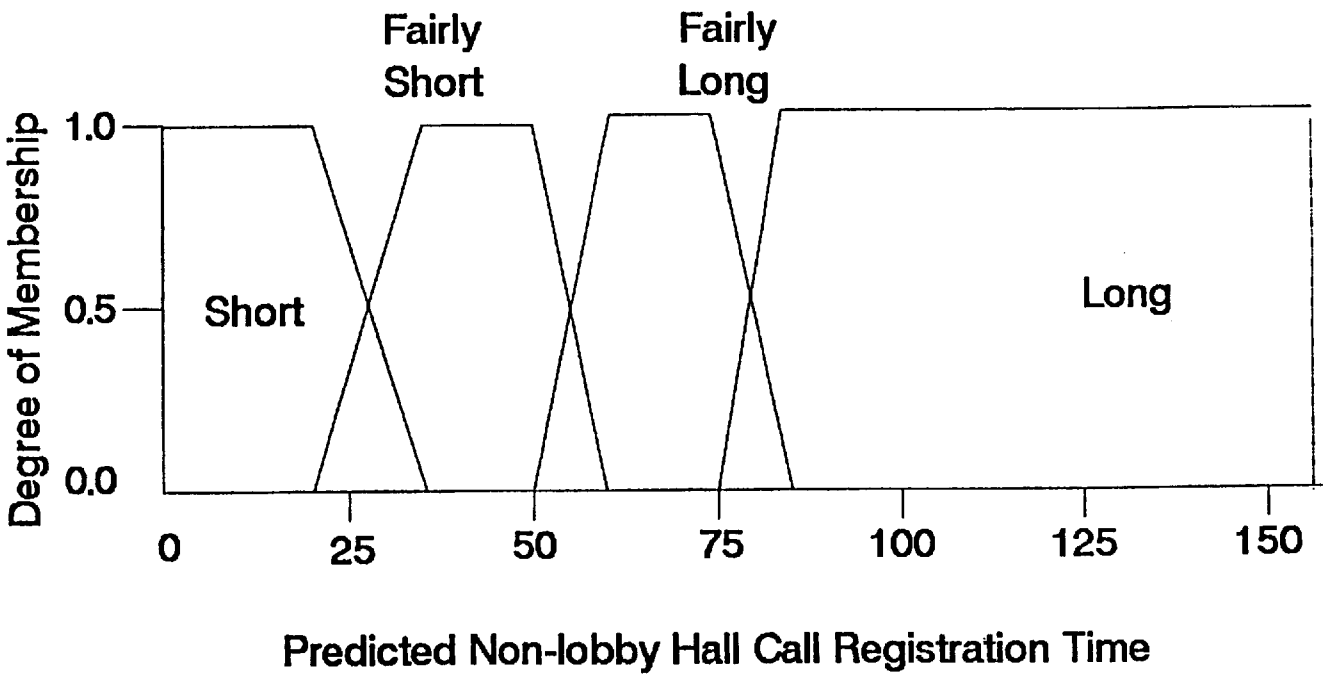
FIG. 34 is a graphical illustration showing fuzzy sets and membership functions for a predicted non-lobby hall call registration time.

FIG. 34 shows an example of the fuzzy sets and membership functions used to categorize non-lobby hall call highest registration times. These are categorized using the fuzzy sets of short, fairly short, fairly long and long. Table 26 shows the method of selecting the number of cars assigned to the lobby using lobby traffic, traffic rate and the predicted non-lobby hall call registration times as inputs.

TABLE 26

Method of Selecting the Number of Cars Assigned to Lobby using Lobby Traffic, Traffic Rate and Non-Lobby Hall call Registration Time.

| Lobby Traffic | Lobby Traffic Rate | Non-Lobby Hall Call Registration Time | Number of Cars Assigned to Lobby |
|---|---|---|---|
| Not Any | Steady | — | Few |
| Light | Steady | — | Few |
| Light | Slowly Increasing | — | Few |
| Moderate | Slowly Decreasing | — | Few |
| Moderate | Steady | Short or Fairly Short | Some |
| Moderate | Steady | Fairly long or long | Few |
| Moderate | Slowly Increasing | Short or Fairly Short | Some |
| Moderate | Slowly Increasing | Fairly long or long | Few |
| Moderate | Fast Increasing | Short or Fairly Short | Several |
| Moderate | Fast Increasing | Fairly long or long | Some |
| Peak | Steady | Short or Fairly Short | Several |
| Peak | Steady | Fairly long or long | Some |
| Peak | Slowly Increasing | Short or Fairly Short | Several |
| Peak | Slowly Increasing | Fairly long or long | Some |
| Peak | Fast Increasing | Short or Fairly Short | Several |
| Peak | Fast Increasing | Fairly long or long | Some |
| Full | Steady | Short or Fairly Short | Many |
| Full | Steady | Fairly long or long | Several |
| Full | Slowly Increasing | Short or Fairly Short | Many |
| Full | Slowly Increasing | Fairly long or long | Several |

Fuzzy logic rules are written using Table 26, connecting the number of cars assigned to the lobby with lobby traffic, traffic rate and the above lobby hall call registration times. The method of selecting the number of cars assigned to the lobby using this controller is the same as that explained in previous section.

C. A closed loop fuzzy logic controller to select the number of cars assigned to the lobby during noon time, when there is significant secondary direction traffic.

During noon time, often there are several secondary direction hall calls at non lobby floors and several floors have significant boarding rates. Therefore, the secondary direction hall call registration times are large. In order to improve service to these floors, an elevator control system performance measure, namely the predicted value of secondary direction hall call registration time is used as one of the inputs in a closed loop fuzzy logic controller to select the number of cars assigned to the lobby.

Figure 35:
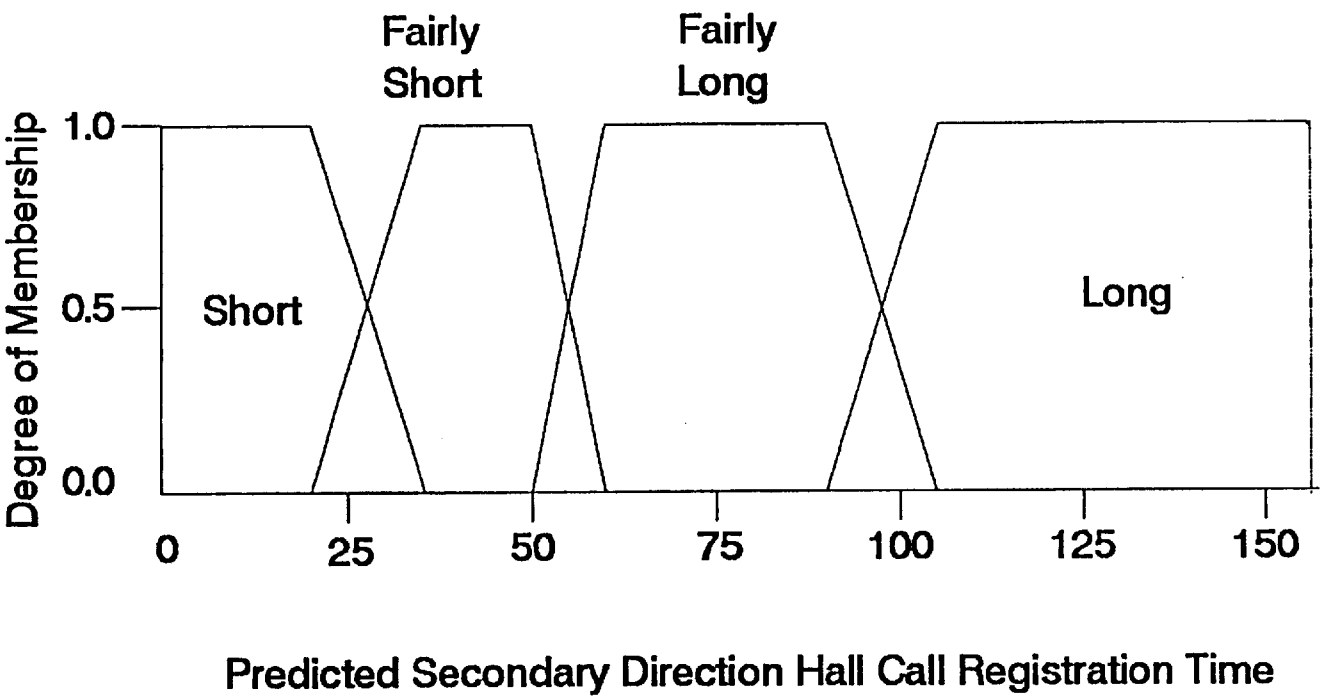
FIG. 35 is a graphical illustration showing fuzzy sets and membership functions for a predicted secondary direction hall call registration time.

FIG. 35 shows the typical fuzzy sets and membership functions used to categorize the predicted secondary direction hall call registration times. These are categorized using the fuzzy sets of short, fairly short, fairly long and long. The predicted three minute hall call registration times are used as inputs. The use of predicted three minute hall call registration times adjusts the control parameter slowly.

Table 27 shows a method of selecting the number of cars assigned to the lobby using lobby traffic and traffic rate and the predicted down hall call registration times.

TABLE 27

Method of selecting the number of cars assigned to lobby using lobby traffic, traffic rate and predicted three minute secondary direction hall call registration time.

| Lobby Traffic | Lobby Traffic Rate | Secondary Direction Hall Call Registration Time | Number of Cars Assigned to Lobby |
|---|---|---|---|
| Not Any | Steady | — | Few |
| Light | Steady | — | Few |
| Light | Slowly Increasing | — | Few |
| Moderate | Slowly Decreasing | — | Few |
| Moderate | Steady | Short or Fairly Short | Some |
| Moderate | Steady | Fairly long or long | Few |
| Moderate | Slowly Increasing | Short or Fairly Short | Some |
| Moderate | Slowly Increasing | Fairly long or long | Few |
| Moderate | Fast Increasing | Short or Fairly Short | Several |
| Moderate | Fast Increasing | Fairly long or long | Some |
| Peak | Steady | Short or Fairly Short | Several |
| Peak | Steady | Fairly long or long | Some |
| Peak | Slowly Increasing | Short or Fairly Short | Several |
| Peak | Slowly Increasing | Fairly long or long | Some |
| Peak | Fast Increasing | Short or Fairly Short | Several |
| Peak | Fast Increasing | Fairly long or long | Some |
| Full | Steady | Short or Fairly Short | Many |
| Full | Steady | Fairly long or long | Several |
| Full | Slowly Increasing | Short or Fairly Short | Many |
| Full | Slowly Increasing | Fairly long or long | Several |

This Table is used to write fuzzy logic rules connecting lobby traffic, traffic rate, and predicted secondary direction hall call registration time to the number of cars to be assigned. These fuzzy logic rules are coded in the fuzzy programming language and converted to C code. This fuzzy logic controller is executed whenever a car leaves the lobby with passengers and whenever the system completes three minute intervals and predicts non-lobby secondary direction hall call hall registration times for the next three minute intervals. The method of getting the crisp value of number of cars assigned to the lobby is the same as described in the previous section.

D. A closed loop fuzzy logic controller to select the schedule interval for single source traffic conditions The closed loop fuzzy logic controller selects the schedule interval using the lobby traffic and traffic rate as one set of controller inputs, one elevator control system input, namely the number of non-lobby secondary direction hall calls as another controller input, and one elevator control system output, namely the number of cars bunched in the primary direction as a third set of inputs. The number of cars bunched in the primary direction is an elevator control system state variable.

The predicted three minute secondary direction hall calls are used as one set of inputs. FIG. 22 shows the fuzzy sets for the secondary direction hall calls.

Figure 36:
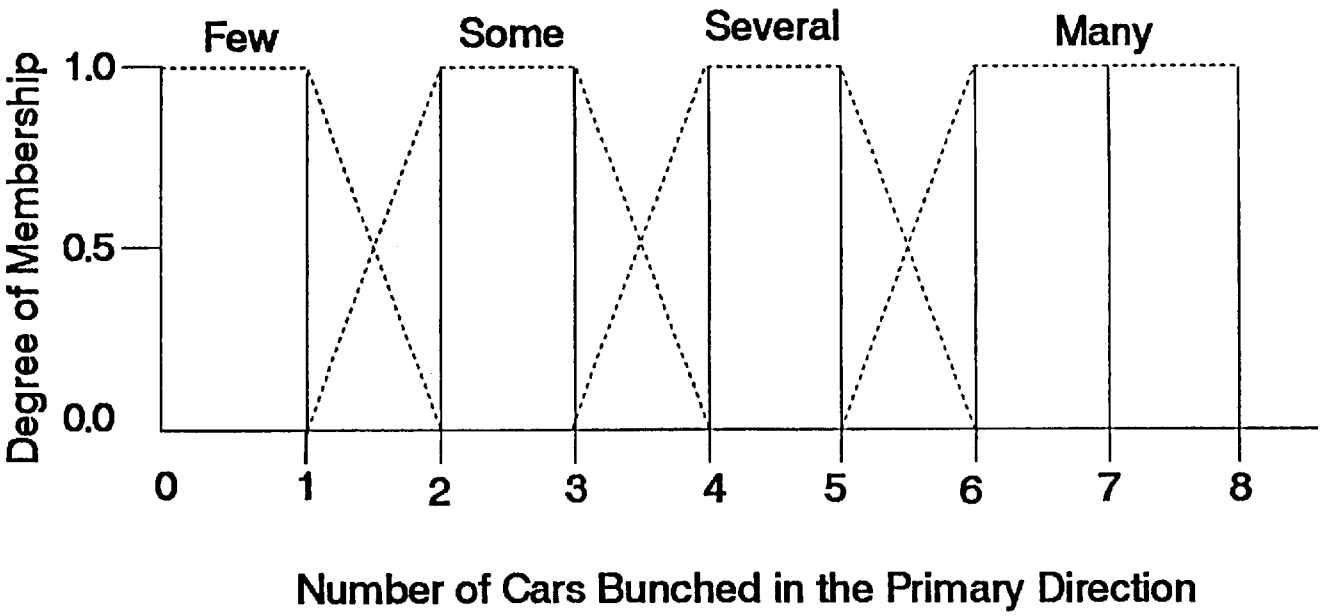
FIG. 36 is a graphical illustration showing fuzzy sets and membership functions for a number of cars bunched in a primary direction.

The number of cars bunched in the primary direction is determined by counting the cars loading passengers in that direction or stopped at floors with hall lantern for that direction turned on (so boarding is set for primary direction) or decelerating to floor with primary direction hall lantern turned on or running in that direction but having not reached their farthest reversal floor commitment points. The fuzzy sets used to define the number of cars bunched in the primary direction are: few, some, several and many; in one embodiment, as shown in FIG. 36.

Figure 37:
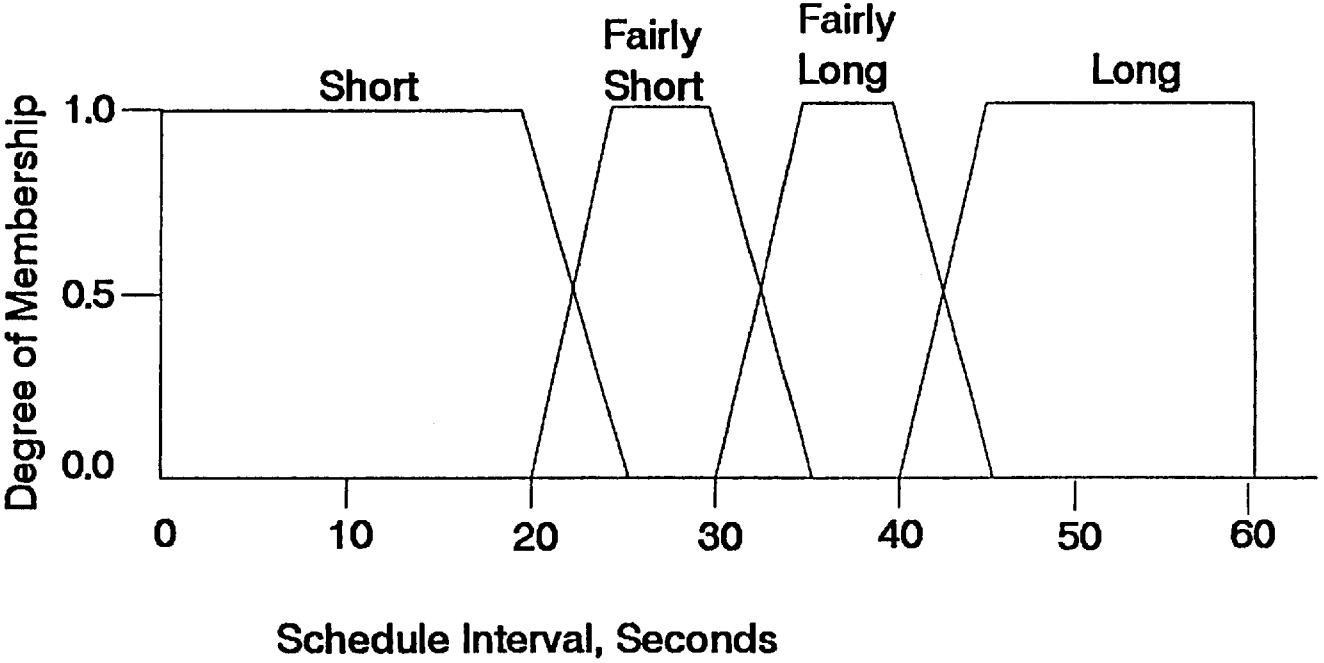
FIG. 37 is a graphical illustration showing fuzzy sets and membership functions for a schedule interval.

Referring to FIG. 37, fuzzy sets used for the schedule interval are shown as very short, short, fairly short and fairly long.

Table 28 shows the method of determining the schedule interval as a function of lobby traffic, traffic rate, number of predicted secondary direction hall calls and the number of bunched cars.

TABLE 28

Method of Selecting Lobby Scheduled Interval

| Lobby Traffic | Lobby Traffic Rate | Number of Secondary Direction Hall Calls | Number of Bunched Cars in Primary Direction | Schedule Interval |
|---|---|---|---|---|
| Not Any | Steady | Ignored | Ignored | N/A |
| Light | Steady | Ignored | Ignored | N/A |
| Light | Slowly Increasing | Ignored | Ignored | N/A |
| Moderate | Slowly Decreasing | Ignored | Ignored | N/A |
| Moderate | Steady | Ignored | Ignored | N/A |
| Moderate | Slowly Increasing | Few or Some | Few or Some | F. Short |
| Moderate | Slowly Increasing | Few or Some | Several or Many | F. Long |
| | Slowly Increasing | Several or Many | Ignored | N/A |
| Moderate | Fast Increasing | Few or Some | Few or Some | F. Short |
| Moderate | Fast Increasing | Few or Some | Several or Many | F. Long |
| Moderate | Fast Increasing | Several or Many | Ignored | N/A |
| Peak | Steady | Few or Some | Few or Some | Short |
| Peak | Steady | Few or Some | Several or Many | F. Short |
| Peak | Steady | Several or Many | Few or Some | Short |
| Peak | Steady | Several or Many | Several or Many | F. Short |
| Peak | Slowly or Fast Increasing | Few or Some | Few or Some | Short |
| Peak | Slowly or Fast Increasing | Few or Some | Several or Many | F. Short |
| Peak | Slowly or Fast Increasing | Several or Many | Few or Some | Short |
| Peak | Slowly or Fast Increasing | Several or Many | Several or Many | F. Short |
| Full | Steady or Slowly Increasing | Few or Some | Few or Some | F. Short |
| Full | Steady or Slowly Increasing | Few or Some | Several or Many | F. Long |
| Full | Steady or Slowly Increasing | Several or Many | Few or Some | F. Short |
| Full | Steady or Slowly Increasing | Several or Many | Several or Many | F. Long |

Table 28 is used to derive fuzzy logic rules to select schedule interval from lobby traffic, traffic rate, number of secondary direction hall calls and number of cars bunched in the primary direction. The fuzzy logic rules written are compiled into C code. The C code is combined with the C code required to estimate lobby traffic and traffic rate and other dispatcher software. Thus, in one embodiment, whenever a car leaves the lobby with passengers, and when the system predicts three minute secondary direction hall calls at the end of each minute, this controller is implemented. Then it determines the number of cars bunched in the primary direction such that the schedule interval to be used at the lobby next time is selected.

The joint set degrees of membership for lobby traffic and traffic rate are determined separately. The degree of membership for secondary direction hall calls predicted and number of cars bunched in the primary direction are determined in the corresponding fuzz sets. The premise degree of membership for the rules are determined using max-min rule. The set degree of membership for the output set is then determined for each rule using premise degree as the set degree. When several rules have same output set, the combined set degree of membership is determined by adding the individual rule set degree for that set and limiting the sum to 1.0.

Each output set is defined in a range of the output variable. The defined degrees of membership at discrete points in the range are computed and stored in a Table for each output fuzzy set. By multiplying its values in the Table with the set degree of membership for that set, the final degrees of membership at those points are obtained. This is called set degree method of inference. The crisp value of the schedule interval is then obtained using the centroid method of defuzzification.

E. A closed loop fuzzy logic controller to select the schedule tolerances

When dynamic scheduling is used in systems with significant interfloor and counterflow traffic or in buildings with cafeteria floors, a secondary lobby or basement with significant traffic during heavy lobby traffic, schedule windows are used for car assignment to lobby in one embodiment. The schedule window is defined in terms of a lower tolerance and an upper tolerance around a scheduled time. By allowing the car to come to the lobby within this window, the car which comes to the lobby before scheduled assignment time need not wait to be assigned. Accordingly, car assignment at other floors is better accommodated.

The schedule tolerances for the schedule window, in this example, are selected using a closed loop fuzzy logic controller. The fuzzy estimates of lobby traffic and traffic rate are used as one set of inputs. An elevator control system input, namely the total non-lobby hall calls in primary and secondary directions, is used as another input to the controller. Since the secondary direction traffic is often significant, and the secondary direction hall call registration time is large as occurring during noon time two-way traffic conditions, an elevator control system performance measure, namely the secondary direction hall call highest registration time is used as a third set of controller inputs. The lower and upper tolerances are selected using fuzzy estimates of lobby traffic and traffic rate and fuzzy sets of total hall calls predicted at non-lobby floors in both directions and the predicted secondary direction hall call highest registration times.

Such a closed loop control method selects the tolerances to match the traffic conditions closely and results in better distribution of cars to the lobby and non-lobby up and down hall calls. Thus, the maximum hall call registration times are reduced at non-lobby floors. At the same time lobby waiting time, lobby crowd and the length of time lobby crowd persists are also kept low. The cars are better utilized to provide balanced service.

Figure 38:
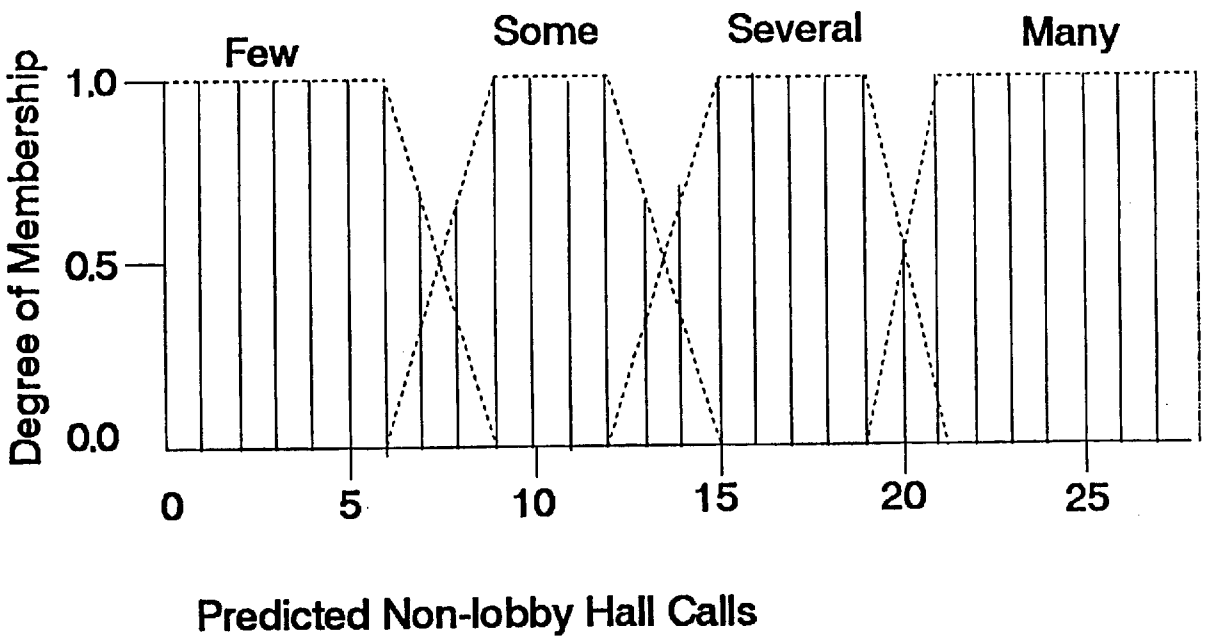
FIG. 38 is a graphical illustration showing fuzzy sets and membership functions for predicted non-lobby hall calls.

FIG. 38 shows fuzzy sets and membership functions used to categorize predicted non-lobby hall calls are shown. These are projected for the next three minute period from those present during the past few three minute period. The predicted hall calls are used instead of currently present calls, so the response will not be rapid, but instead, will slowly adjust. The total hall call counts are integers; thus, the degree of membership is defined for integer values of total hall calls. They are categorized using the sets of few, some, several and many in one embodiment.

Referring to FIG. 35, fuzzy sets and membership functions for predicted secondary direction hall call highest registration times. The highest registration time for the next three minute period is predicted from those of a few previous three minute periods. The predicted value dampens the response of the system and avoids rapid oscillations. The highest secondary direction hall call registration time is categorized using the fuzzy sets of short, fairly short, fairly long and long in one embodiment.

Figure 39:
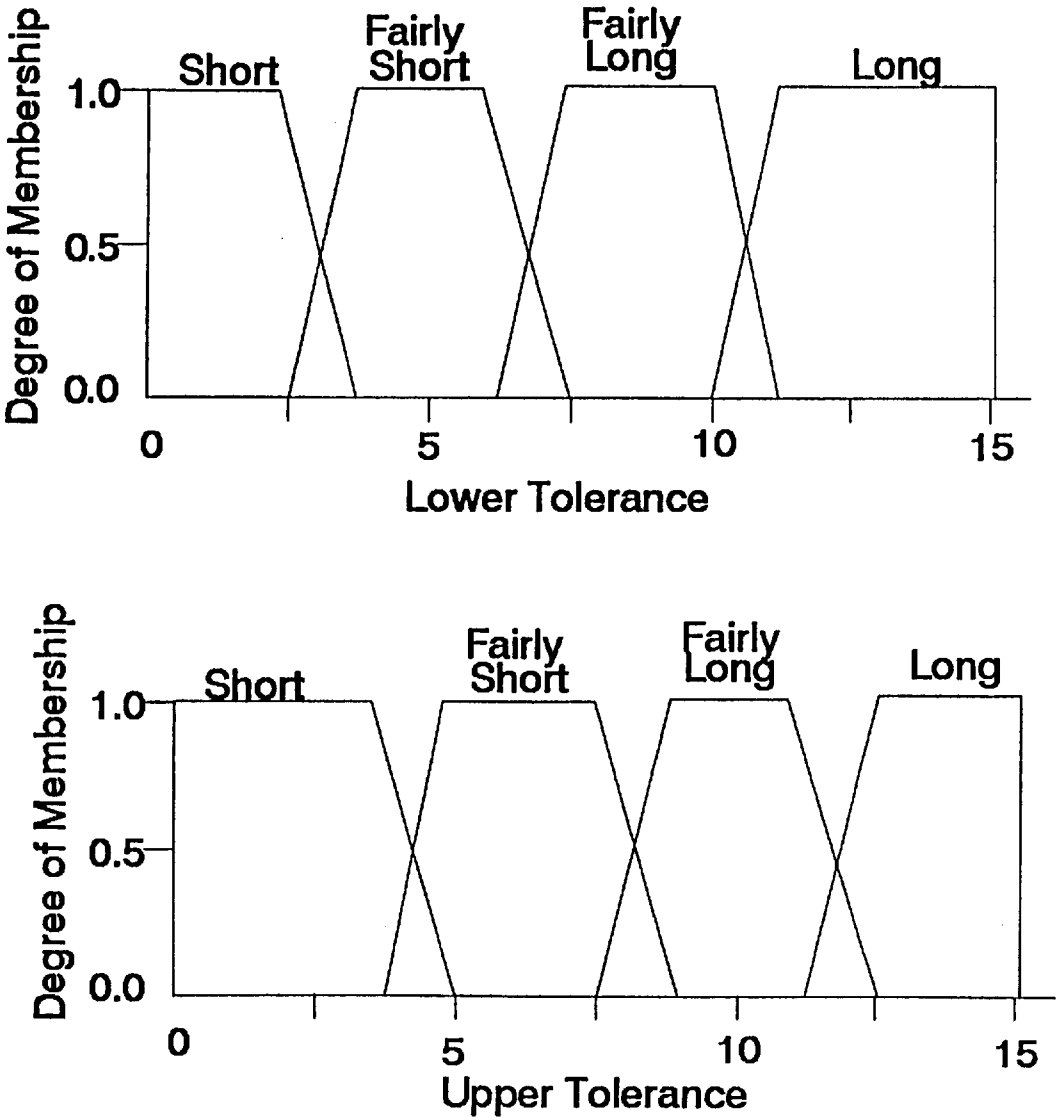
FIG. 39 is a graphical illustration showing fuzzy sets and membership function for schedule window tolerances.

The control parameters, lower schedule tolerance and upper schedule tolerance, vary in the range of 0 to 20 seconds in one embodiment. Typically the lower tolerance is shorter than the upper tolerance. These tolerances are categorized using the fuzzy sets of very short, short, fairly short and fairly long. FIG. 39 shows the fuzzy sets used to categorize the lower and upper schedule tolerances.

Table 29 shows the method of selecting the lower and upper schedule tolerances using fizzy estimates of lobby traffic and traffic rate and fuzzy sets of total predicted non-lobby hall calls and the predicted highest registration time of secondary direction hall calls.

Fuzzy logic rules are written using the row entries in Table 29, connecting input and output variables of the fuzzy logic controller. These fuzzy logic rules are compiled into C code and integrated with dispatcher software. The schedule tolerances can be selected in real time, whenever a car leaves the lobby in the primary direction and when the system makes three minute predictions of non-lobby hall calls and the secondary direction hall call highest registration times. This controller uses the set degree method of inference and the centroid method of defuzzification, to arrive at the schedule tolerances from the rule outputs, similar to the controller in the previous section.

4. Closed loop adaptive fuzzy logic controller.

Figure 40:
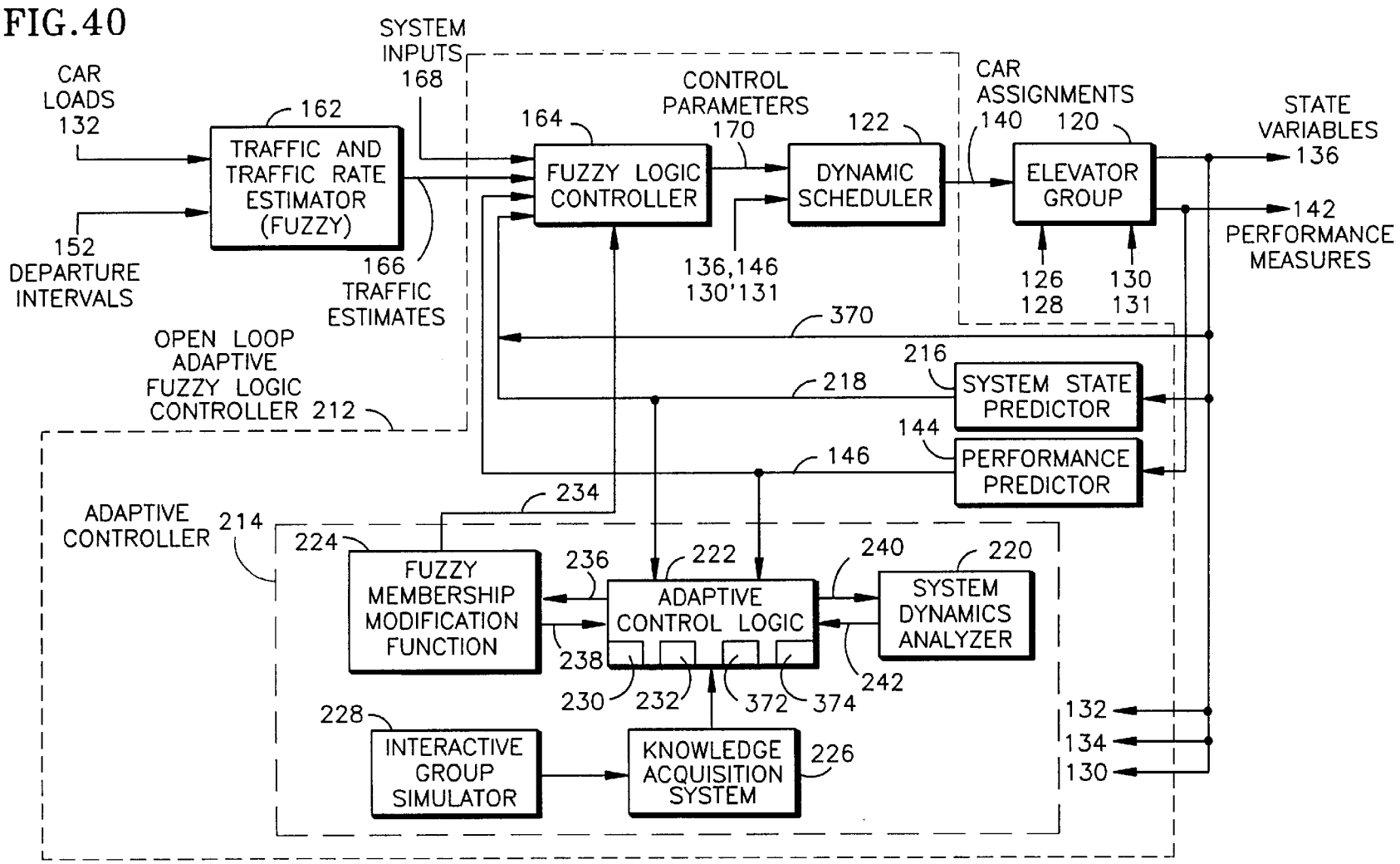
FIG. 40 is a simplified block diagram of a closed loop adaptive fuzzy logic controller.

Referring to FIG. 40, block diagram for a closed loop adaptive fuzzy logic controller is shown. The closed loop adaptive fuzzy logic controller 376 includes the closed loop fuzzy logic controller 164 described in the previous section and an adaptive controller 214 to change the membership functions of the fuzzy sets of the inputs and outputs used in the closed loop fuzzy logic controller.

The closed loop adaptive fuzzy logic controller uses the elevator control system inputs and outputs as controller inputs to select the control parameters. Additionally, the closed loop adaptive fuzzy logic controller has rules in the adaptive controller to modify the fuzzy set membership functions of controlled parameters, elevator control system inputs, and elevator control system outputs based on real time measurement of performance measures and monitoring of elevator control system state variables. While the closed loop control operates using short time frames to select the values of the control parameters, the adaptive control is exercised using longer time cycles. Thus, the closed loop adaptive controller can adapt to different building and traffic conditions.

The closed loop adaptive fuzzy logic controller 214 is also provided with a state predictor 216 and a performance

TABLE 29

Method of Selecting Lobby Schedule Tolerances Using Lobby Traffic, Traffic Rate, Total Non-lobby Hall Calls and Secondary Direction Hall Call Registration Times

| Lobby Traffic | Lobby Traffic Rate | Total Hall Calls | Secondary Direction Hall Call Registration Time | Schedule Tolerances Lower | Schedule Tolerances Upper |
|---|---|---|---|---|---|
| Not Any | Steady | — | — | N/A | N/A |
| Light | Steady | — | — | N/A | N/A |
| Light | Slowly increasing | — | — | N/A | N/A |
| Moderate | Slowly decreasing | — | — | N/A | N/A |
| Moderate | Steady | — | — | N/A | N/A |
| Moderate | Slowly Increasing | Few or Some | Short or F. Short | Short | Short |
| Moderate | Slowly Increasing | Few or Some | F. Long or Long | Short | Fairly Short |
| Moderate | Slowly Increasing | Several or Many | Short or F. Short | F. Short | Fairly Short |
| Moderate | Slowly Increasing | Several or Many | F. Long or Long | F. Short | F. Long |
| Moderate | Fast Increasing | Few or Some | Short or F. Short | Short | Short |
| Moderate | Fast Increasing | Few or Some | F. Long or Long | Short | F. Short |
| Moderate | Fast Increasing | Several or Many | Short or F. Short | F. Short | F. Short |
| Moderate | Fast Increasing | Several or Many | F. Long or Long | F. Short | F. Long |
| Peak | Steady or Slowly Increasing | Few or Some | Short or F. Short | Short | Short |
| | Steady or Slowly Increasing | Few or Some | F. Long or Long | Short | Short |
| | Steady or Slowly Increasing | Several or Many | Short or F. Short | F. Short | F. Short |
| | Steady or Slowly Increasing | Several or Many | F. Long or Long | F. Short | F. Short |
| Peak | Fast Increasing | Few or Some | Short or F. Short | V. Short | Short |
| | Fast Increasing | Few or Some | F. Long or Long | Short | Short |
| | Fast Increasing | Several or Many | Short or F. Short | Short | F. Short |
| | Fast Increasing | Several or Many | F. Long or Long | F. Short | F. Short |
| Full | Steady or Slowly Increasing | Few or Some | Short or F. Short | V. Short | V. Short |
| | Steady or Slowly Increasing | Few or Some | F. Long or Long | V. Short | Short |
| | Steady or Slowly Increasing | Several or Many | Short or F. Short | Short | Short |
| | Steady or Slowly Increasing | Several or Many | F. Long or Long | Short | F. Short |

predictor 144. The elevator control system states are input to the state predictor 216. Various system states are predicted for use by the closed loop fuzzy logic controller. Additionally, several system states are predicted for use by the closed loop adaptive controller's system dynamics analyzer. Thus, the state predictor used with the closed loop fuzzy logic controller is more complex than that used with open loop adaptive fuzzy logic controller. For example, this predictor predicts the car loads of the car arriving at the lobby during the next three minute period, from the car load measurements made when the cars reach the lobby from non-lobby floors. Similarly, it predicts the number of car calls registered in the cars when the cars leave the lobby. The average number of hall stops made by the car during the secondary direction trip is another state variable predicted. These are examples of parameters used by the adaptive control logic.

The performance measures 142 are input to the performance predictor 144. This predictor predicts several performance measures for use by the fuzzy logic controller and several others for use by the system dynamics analyzer of the closed loop adaptive controller. This predictor has the capabilities of the predictor used with the open loop adaptive fuzzy logic controller and the closed loop fuzzy logic controller.

The state predicted data 218 and the performance predicted data 146 are input to adaptive control logic which passes them to the system dynamics analyzer 220. The system dynamics analyzer is used to evaluate changes in several performance measures and several system state variables. The operation of the system dynamics analyzer is same as previously explained with FIG. 27. This analyzer is supplied with one set of two performance measures at a time to determine their percentage changes with time, their relative changes and their changes from determined maximum limits. The system dynamics analyzer is provided with combinations of performance measures and state variables. For example, the car loads of the cars arriving at the lobby and the highest secondary direction hall call registration time may be analyzed using this analyzer. If the percentage increase in the highest hall call registration time is proportional to the percentage increase in car loads, the performance is acceptable. If not, it will indicate degradation in secondary direction hall call service. This will require reducing the number of cars assigned to the lobby and the lobby schedule interval.

The outputs of the system dynamics analyzer 220 are received as parameter change type signals by the closed loop adaptive control logic 222. This adaptive control logic 222 is different from the open loop adaptive control logic. The closed loop adaptive control logic has the capability to compute and summarize the required changes to the fuzzy set membership functions of the controlled parameter, those of the elevator control system input variable used as fuzzy logic controller's input, those of the elevator control system's state variable and those of the elevator control system's performance measures using Tables similar to Table 20, 21, 22, 23 and 24. Thus, the inputs and the outputs of this adaptive control logic are more than those used by the open loop adaptive control logic.

The closed loop adaptive control logic sends requests for specific membership function modifications to the fuzzy set membership function modification function 224. The fuzzy set membership modification function makes the necessary modifications to the membership functions and computes the defined degrees of memberships for rule output fuzzy sets. These are written through memory writes 234, to the fuzzy logic controller's memory.

Figure 41:
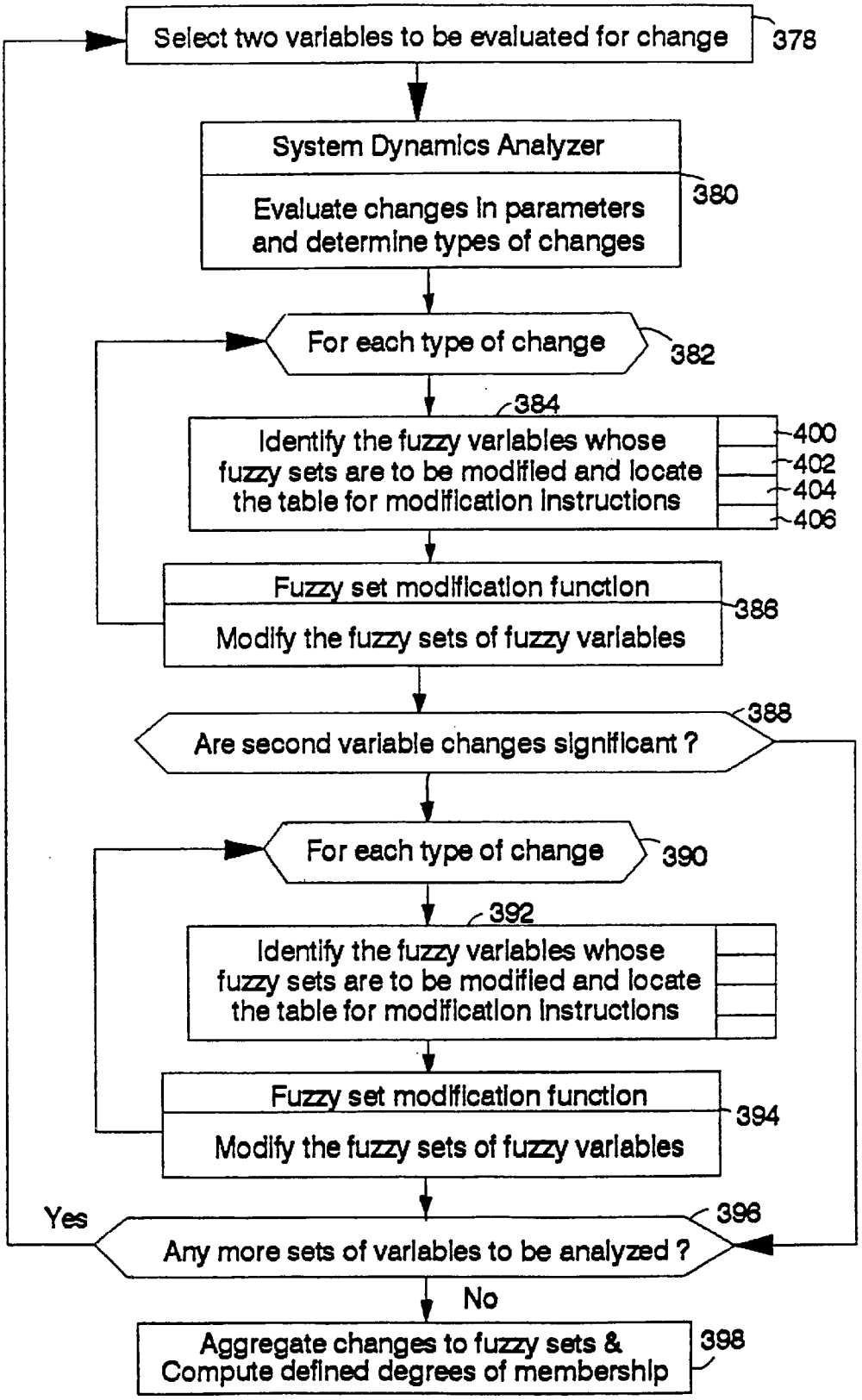
FIG. 41 is a flow diagram of an adaptive control logic used in the closed loop adaptive fuzzy logic controller.

Referring to FIG. 41, a flow chart of the closed loop adaptive control logic in the closed loop adaptive controller is shown. The adaptive control logic 222 selects in step 378, the set of two parameters to be evaluated for changes and sends them to the system dynamics analyzer 220. The system dynamics analyzer evaluates changes in the values of the state variables and performance measures in step 380. Then the changes are sent to the adaptive control logic as change signals 212. These are Type 1, Type 2 and Type 3 changes in the two variables evaluated. Then each type of change is considered in step 382, one at a time. In step 384, the adaptive control logic determines the location of the fuzzy set change Table and the fuzzy set modification instructions Table. The fuzzy sets of four types of variables, namely, the fuzzy logic controller outputs, the elevator control system inputs, the elevator control system state variables and the elevator control system performance measures can be changed using fuzzy set change tables and fuzzy set modification instruction tables. This is indicated by subblocks 400, 402, 404 and 406 of block 384. The fuzzy set modification table address is sent to fuzzy set modification function 224. In step 386, the fuzzy set modification function effects those changes. The process of changing fuzzy sets for each type of change in the first monitored variable is done in a loop from step 382 to 386.

In step 388 to 394, the changes in fuzzy sets done to changes in the second variable of the set of two elevator control system output variables are effected. Then, at step 394, it is determined if other sets of two variables are to be evaluated. If so, steps 378 to 394 are performed for other sets of two variables. When all sets of two variables have been thus analyzed, all required changes to each fuzzy set are aggregated in step 398. Then the fuzzy set modification function is executed to develop the defined degrees of membership for controlled parameters and write the new fuzzy set definitions and defined degrees of membership to the fuzzy logic controller's part of memory.

The correlation tables similar to Tables 21, 22 and 23, the fuzzy set change Table similar to Table 24 and the fuzzy set modification instruction table similar to Table 20 are generated for this adaptive controller, 214, using the interactive group simulator 228 and the knowledge acquisition system 226, as explained in the open loop adaptive fuzzy logic controller's description.

The operation of the closed loop adaptive fuzzy logic controller is described with an example below.

A. A closed loop adaptive fuzzy logic controller to select the schedule interval for single source traffic conditions.

This adaptive control logic in this adaptive fuzzy logic controller uses the non-lobby hall call registration time in the secondary direction and the predicted car loads of cars arriving at the lobby in the secondary direction as one set of variables for changing the fuzzy set membership functions of the fuzzy logic controller. The adaptive control logic also uses the highest of the non-lobby hall call registration time and the highest lobby hall call registration time as another set of variables for changing the fuzzy set membership functions. The system dynamics analyzer analyzes the changes in the variables and determines if type 1, type 2 and type 3 changes for the variables are significant requiring changes in the fuzzy sets.

Figure 42:
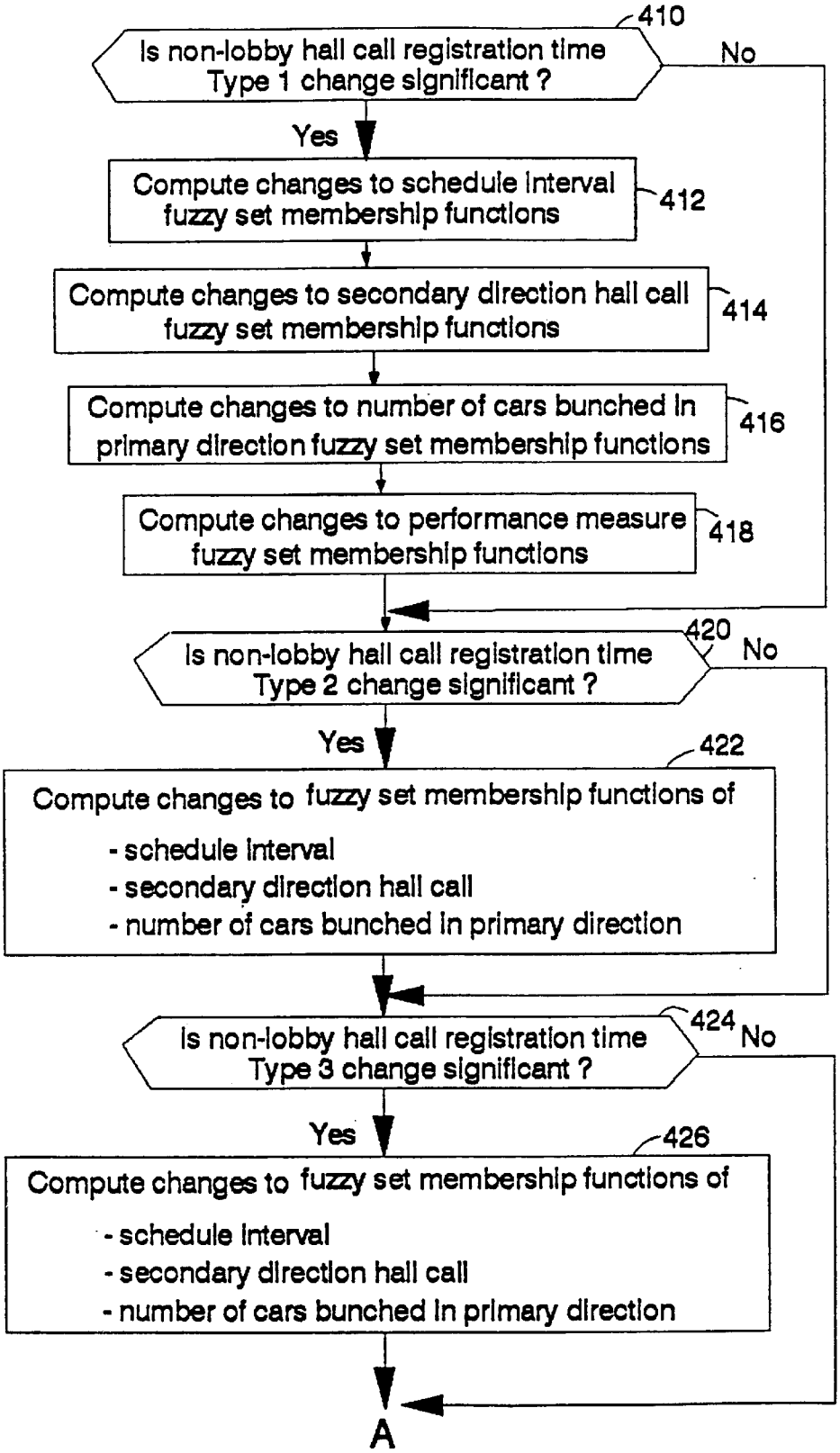
FIGS. 42 and 42*a* are a flow diagram of the adaptive control logic used in the closed loop adaptive fuzzy logic controller.

Referring to FIG. 42, a flow diagram of the first part of closed loop adaptive control logic used in the closed loop adaptive fuzzy logic controller is shown. This part concerns the determination of required changes to the fuzzy sets, based on the analyses of the non-lobby hall call registration time compared to the car loads of car arriving at the lobby in the secondary direction.

In Step 410, it is determined if the non-lobby hall call registration time type 1 change is significant requiring fuzzy set membership function modifications. If so, in Step 412, the required changes to the rule output fuzzy set membership functions are made. In this example, these changes are the changes to the schedule interval fuzzy set membership function. Then, in Step 414, the required changes to the fuzzy set membership functions of elevator control system inputs used as controller inputs are made. The predicted number of secondary direction hall calls is one of the controller inputs in this example. Thus, the changes to the membership functions of the fuzzy sets of the predicted secondary direction hall calls are computed in this step. In Step 416, the required changes to the membership functions of the fuzzy sets of the state variables used as inputs are determined. In this example, the number of cars bunched in the primary direction (as defined in Section 3D, hereinbefore) is one of the inputs; this is the observed value and not the predicted value. The changes to the membership functions of the fuzzy sets of the number of cars bunched in the primary direction are computed. This controller does not use any of the elevator control system performance measures as one of the controller inputs. Therefore, step 418 produces no outputs.

In Step 420, the adaptive control logic determines if the type 2 changes of the non-lobby hall call registration times are significant. If so, the required changes to the fuzzy sets of the schedule interval, those of the predicted secondary direction hall calls and those of the number of cars bunched in the primary direction, are made in Step 422. Then, in Steps 424 and 426, the required changes to the fuzzy sets resulting from type 3 changes of the non-lobby hall call registration time are made.

Figure 42A:
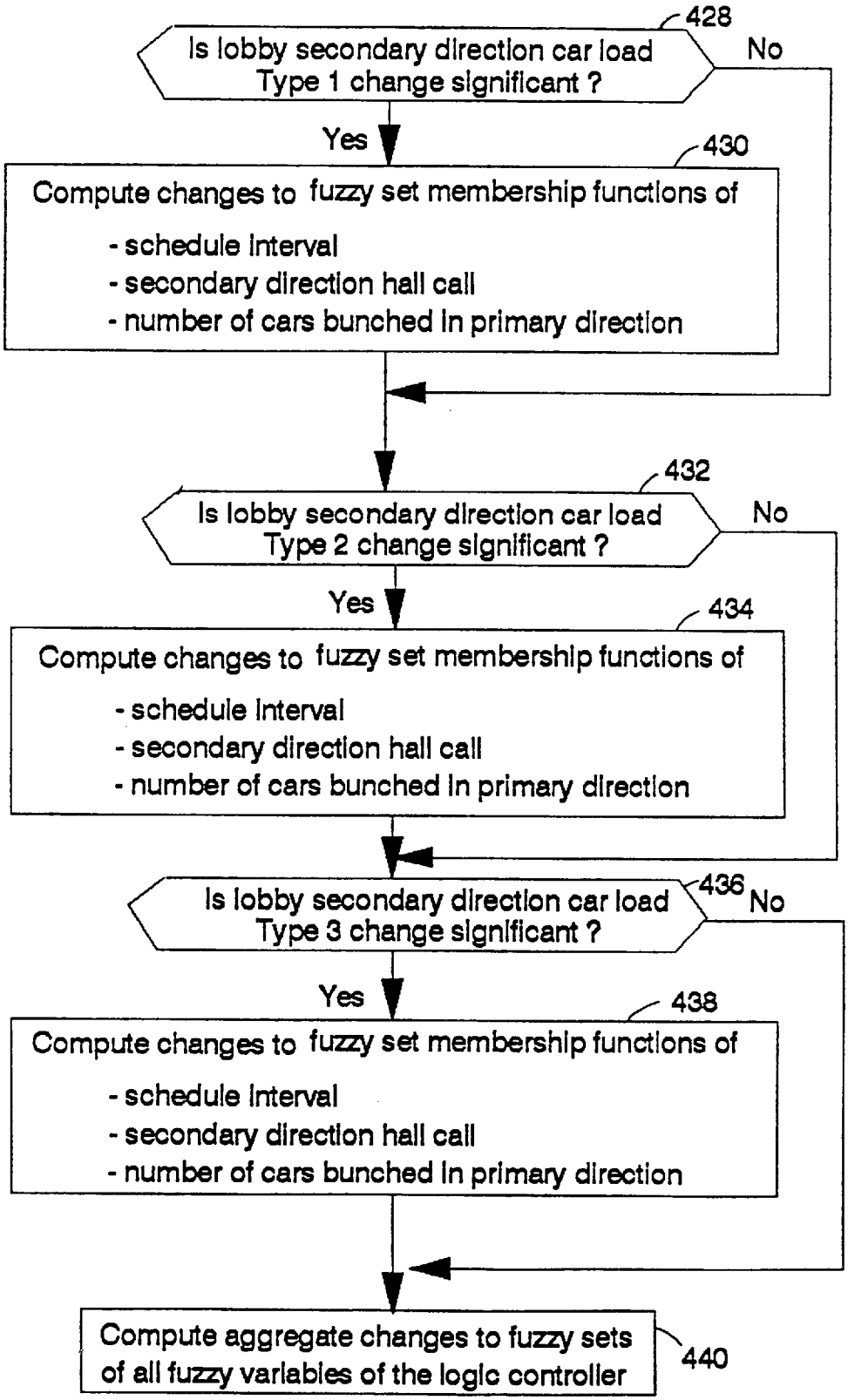

In Steps 428 and 430 (FIG. 42*a*), the required changes to the fuzzy set membership functions resulting from the type 1 changes of the car loads of the cars arriving at the lobby in the secondary direction are made. In Steps 432 and 434, the required changes resulting from type 2 changes in the car loads of the cars arriving at the lobby in the secondary direction are made. In Steps 436 and 438, the required changes to the fuzzy set membership functions resulting from type 3 changes of the car load variable are made.

The process of making the required changes to the fuzzy set membership functions because of the various types of changes when the lobby hall call registration time and the non-lobby hall call registration time are compared are then performed. All required changes to the fuzzy set membership functions are stored in arrays in terms of fuzzy set defining points.

The changes to the fuzzy set membership functions are aggregated (step 440) and analyzed to arrive at the final change requests for fuzzy set membership function modifications. Then these changes are effected in the fuzzy set membership modification function 224. The defined degrees of membership values at various discrete points are calculated for the schedule interval and written in the controller's memory. The membership functions for the controller inputs are also written to the controllers memory.

Thus, this adaptive controller is capable of changing the membership functions of various fuzzy sets in real time, so it can select the schedule intervals accurately in buildings with significant traffic variations during peak period and noon time.

5. Fuzzy logic controllers with adaptive constraints

A constraint establishes limits on some variables and parameters, which should not be violated during dispatcher operation, except in extreme conditions. Whereas, a control parameter is used to control the dispatching function closely, a constraint variable controls the dispatching to a lesser extent and in an indirect method. The allowable maximum lobby hall call registration time is an example of a constraint variable. The allowable maximum schedule interval is another example. Thus, a constraint variable can limit an elevator control system output variable or a control parameter.

A fuzzy logic controller with adaptive constraints is implemented with one of the above four fuzzy logic controllers. It has a function to compute the various constraint variables used by the dynamic scheduler adaptively, by analyzing the trends in the performance of the elevator control system.

If fuzzy logic controllers are used with the dynamic scheduler, the control parameters are selected using fuzzy logic controllers. Then, the fuzzy sets used in the fuzzy logic controllers can be changed based on traffic conditions by the adaptive controllers. The constraint variables are selected for the elevator control system and stored in the GCSS's memory. These constraint variables are changed by the adaptive constraint generator.

The dynamic scheduler may have several fuzzy logic controllers, some of the open loop type and others of the closed loop type, to select the values of the control parameters. The adaptive controllers used with the dynamic scheduler can change the fuzzy set membership functions of some of these fuzzy logic controllers. The dynamic scheduler, however, requires only one adaptive constraint generator, to adaptively modify all of the constraint variables.

Figure 43:
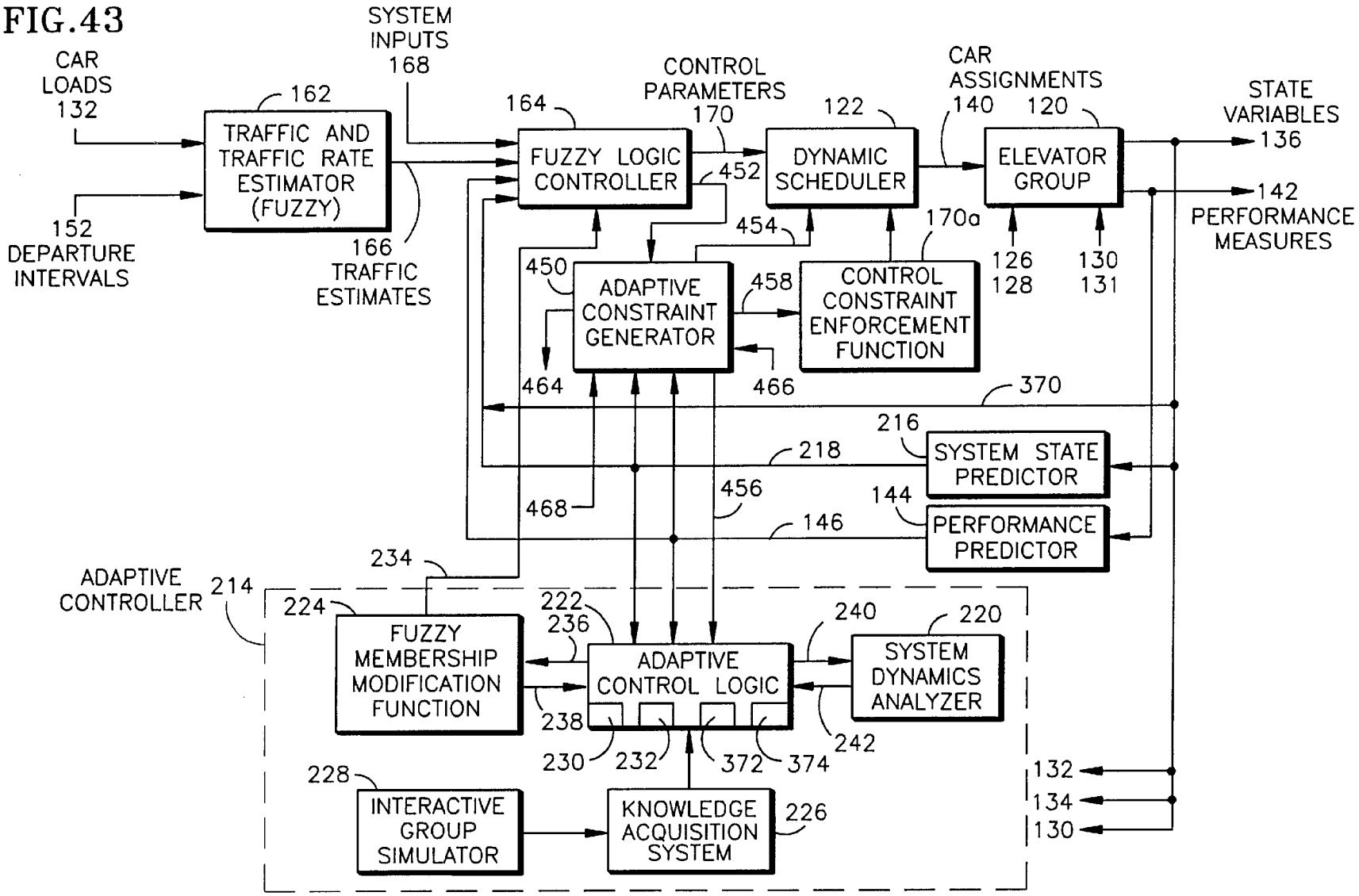
FIG. 43 is a simplified block diagram of a group controller with an adaptive constraint generator.

Referring to FIG. 43, the block diagram of a controller, in which the adaptive constraint generator 450 is used with the dynamic scheduler, is shown.

Three types of constraint variables are used with the dynamic scheduler. The first set 454 is used directly by the dynamic scheduling dispatcher to control dispatching; the second set 456 is used by the adaptive control logic to modify the fuzzy set membership functions; the third set 458 is used by the control constraint enforcement function for directly constraining the control parameter values generated by the fuzzy logic controller. The constraint variables may be given as crisp values or fuzzy values for limiting the values of the control parameters. The constraint variables on control parameters are implemented by control constraint enforcement function 462. If the constraint variables are fuzzy, another stage of control parameter estimation is performed for implementing various fuzzy constraint variables.

The adaptive constraint generator 450, uses the system state and performance data predicted by the corresponding predictors as inputs. It sends these data to the system dynamic analyzer 220, to identify significant changes in the predicted values of some of the state variables and performance measures. These changes are identified by analyzing a set of two elevator control system output variables at a time, as explained in the previous section. Thus, various types of changes are identified, together with the magnitudes of those changes. The adaptive constraint generator 450 uses several sets of two elevator control system output variables, to obtain the significance of these changes and determine the requirement to change the values of the constraint variables.

Figure 44:
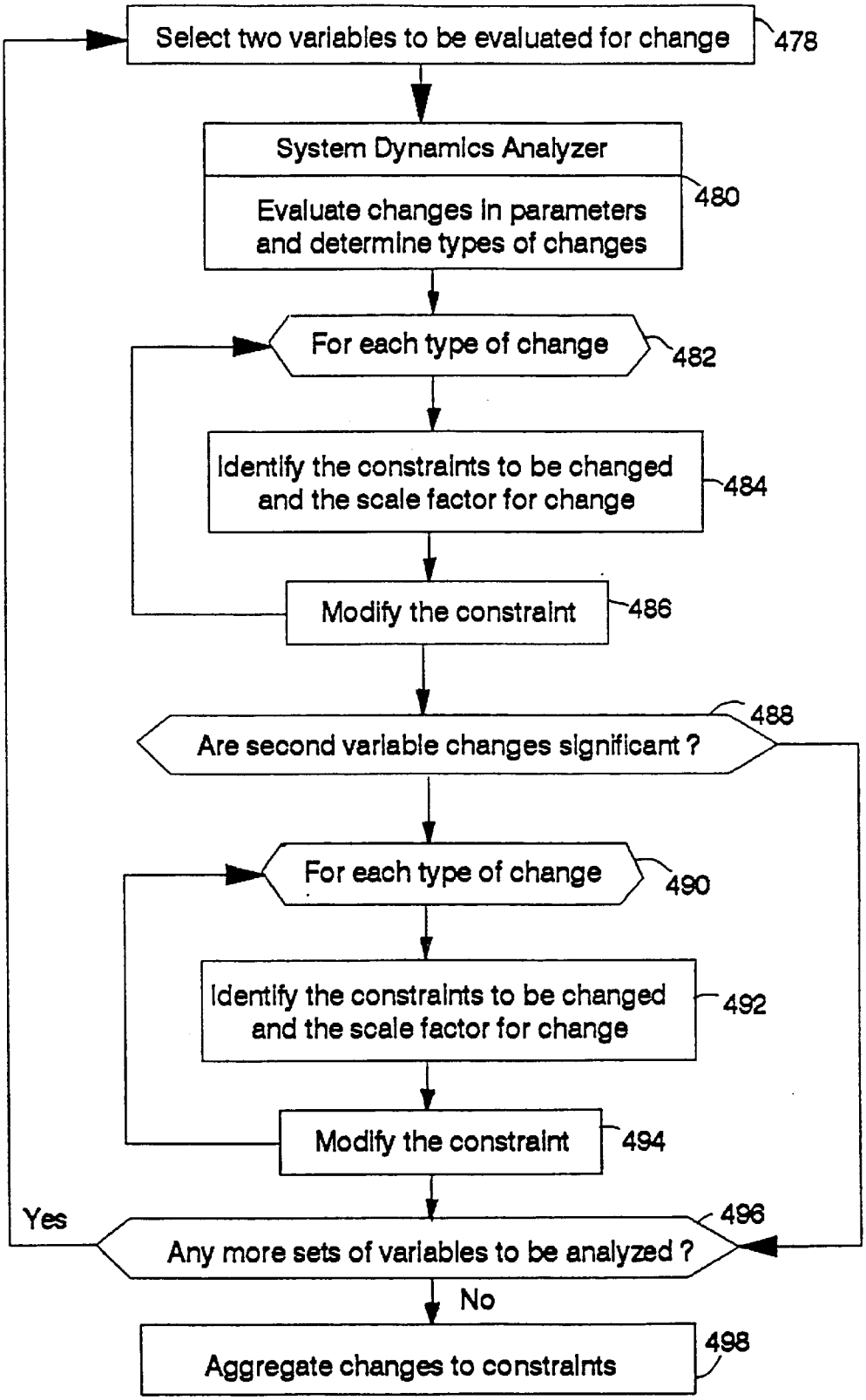
FIG. 44 is the flow diagram of the adaptive constraint generator's logic.

Referring to FIG. 44, a flow diagram for the adaptive constraint generator is shown. In Step 478, the adaptive constraint generator selects a set of two system state and performance data and sends them to the system dynamics analyzer. The system dynamics analyzer analyzes the changes in these elevator control system output variables and identifies them as Type 1, Type 2 and Type 3 changes, in step 480. Then, in step 482, the adaptive constraint generator selects one type of a change at a time. In Step 484, the adaptive constraint generator obtains the changes in the values of the variables using the constraint change address table and the constraint change instructions table. The constraint change address table is similar to Table 21 and it stores the address where the constraint change instruction table is stored for given levels of changes in the value of the variables-at given values of the variable. The constraint instructions table is similar to Table 24 and lists the constraint variables to be changed and the scale factors for multiplying the constraint variables. The changes are then made in step 486 and stored in GCSS's memory. The constraint change can also be effected by setting it to a preset value. This is indicated by the negative scale factor. The magnitude of scale factor then shows the value to be used.

The steps 482 to 486 are repeated for each type of change in the first elevator control system output variable of the two variable set evaluated. Then in step 488, an evaluation is made as if the second elevator control system output variable of the set of two variables had significant changes. If so, then in step 490, each type of change is considered. In step 492, the location of the constraint change instruction table is obtained. Then, the constraint variables to be changed and the scale factors for changing are obtained. In step 494, the constraint value is changed and saved in GCSS's memory.

In step 496, it is determined if all sets of two elevator control system output variable specified have been checked for magnitude of change. If not, the process from step 478 to 494 is repeated with other sets of two elevator control system output variables. Then, in step 498, all required changes to constraint are aggregated and stored in memory.

The constraint modification instructions table for different types of variable changes are learned by the system, during interactive simulation. When these simulations are run using various abnormal traffic profiles, the various sets of variables to be evaluated for change are input by the skilled person. The changes are evaluated and if significant are displayed on the screen. The skilled person can select the constraint variables to be modified and the scale factor. So the simulator will modify the constraint and perform simulations. After a determined period, for example five minutes, if the performance is acceptable, the constraint modification instructions can be accepted. The skilled person can indicate this acceptance or it may be accepted automatically upon the expiration of the determined period. The knowledge acquisition system stores the address of corresponding modification instruction table, at the cross correlation table in an address location corresponding to that change level and variable level. By repeating the simulations with various traffic profiles, the skilled person can be presented with various variable change conditions. The input constraint modification instructions can be evaluated and an option to accept the instructions indicated. When the instructions are accepted, the knowledge acquisition system will save the instructions with proper entries in appropriate tables.

Figure 45:
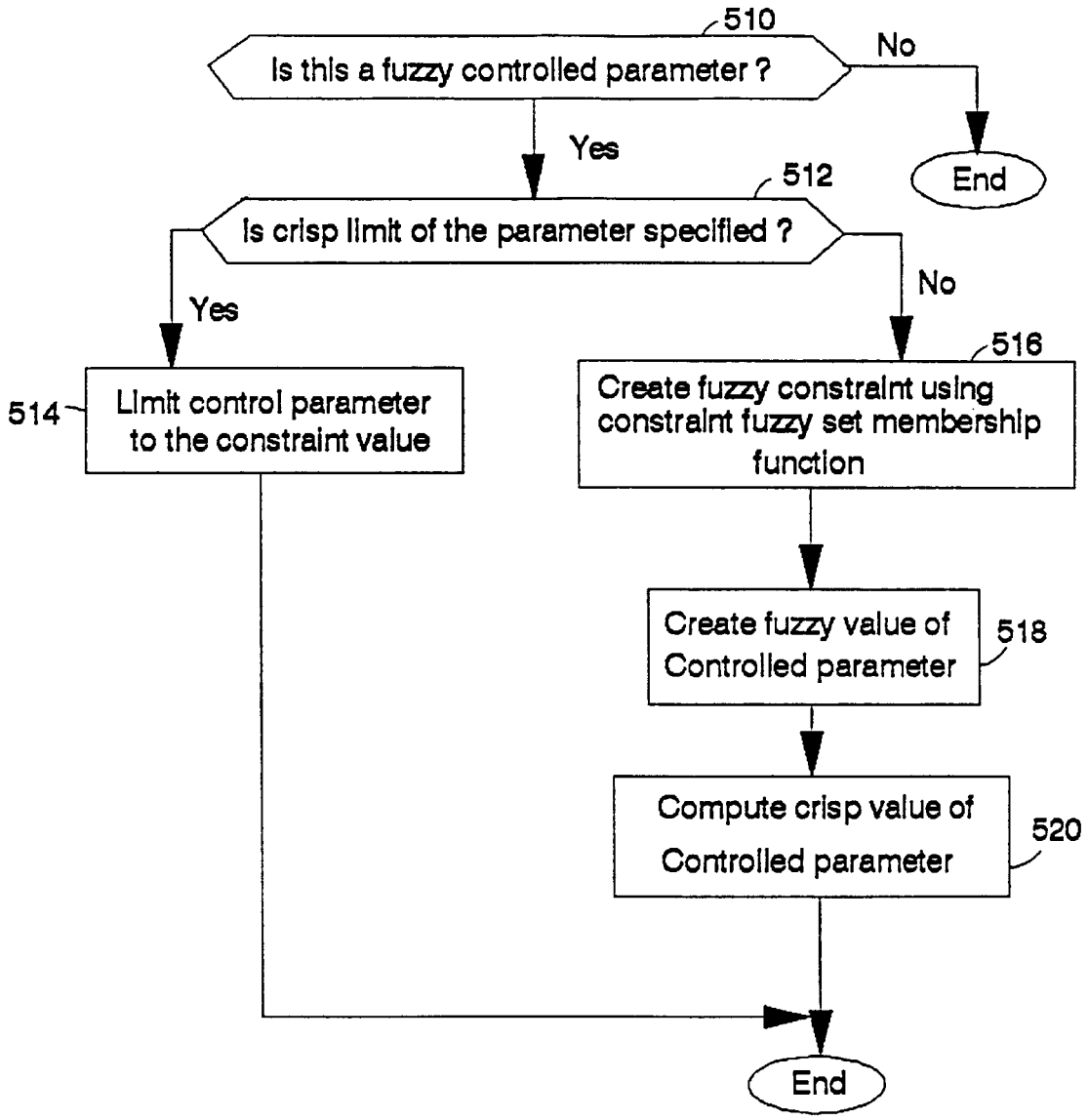
FIG. 45 is the flow diagram of a control constraint enforcement function.

FIG. 45 shows a flow diagram for the control constraint enforcement function. At step 510, the control parameter is determined to be controlled by the fuzzy logic controller or not. If it is controlled by the fuzzy logic controller, at step 512 it is determined if a crisp limit is to be used. If so, the control parameter is limited to the maximum or minimum specified by the constraint variable. If on the other hand, a fuzzy limit is specified for the constraint, the fuzzy set for the constraint variable is produced, using a defined function for the constraint in step 516. For example, a maximum non-lobby secondary direction hall call registration time constraint variable may be selected to be 60 seconds. The constraint variable may be declared fuzzy. Then the maximum constraint may be specified by a triangular function D1, D2, D3. The degrees of membership at D1 and D3 are zero, while that at D2 is maximum. D2 is 60 seconds in this example; D1 and D2 may be specified as D1=aD2; D2=bD2 where a and b are constraint variables; a is less than 1.0 and b is greater than 1.0.

For example a=0.8 and b=1.25. So D1=48 seconds, D3=75 seconds. This defines the fuzzy constraint.

Using this method, a control parameter such as schedule interval may have a maximum constraint of 50 seconds. The control parameter may be specified using a fuzzy constraint with constraint variables a=0.8; b=1.25. So the limits are 40 seconds to 62.5 seconds for the maximum schedule interval.

The fuzzy value of the controlled parameter is then obtained in step 518, using the output degrees of membership at discrete points, as explained in the fuzzy logic controller example for this parameter, and the above maximum schedule interval constraint. Thus, the degree of membership values are limited to the minimum of that at the discrete points for schedule interval output of the fuzzy logic controller and that along the descending line when the schedule interval is between 50 seconds and 62.5 seconds. This modified output degrees of member is then used to compute a crisp value of the schedule interval in step 520. The operation of the adaptive constraint generator is described with an example below.

a. An adaptive constraint generator for use with dynamic scheduler for single source traffic conditions.

Figure 46:
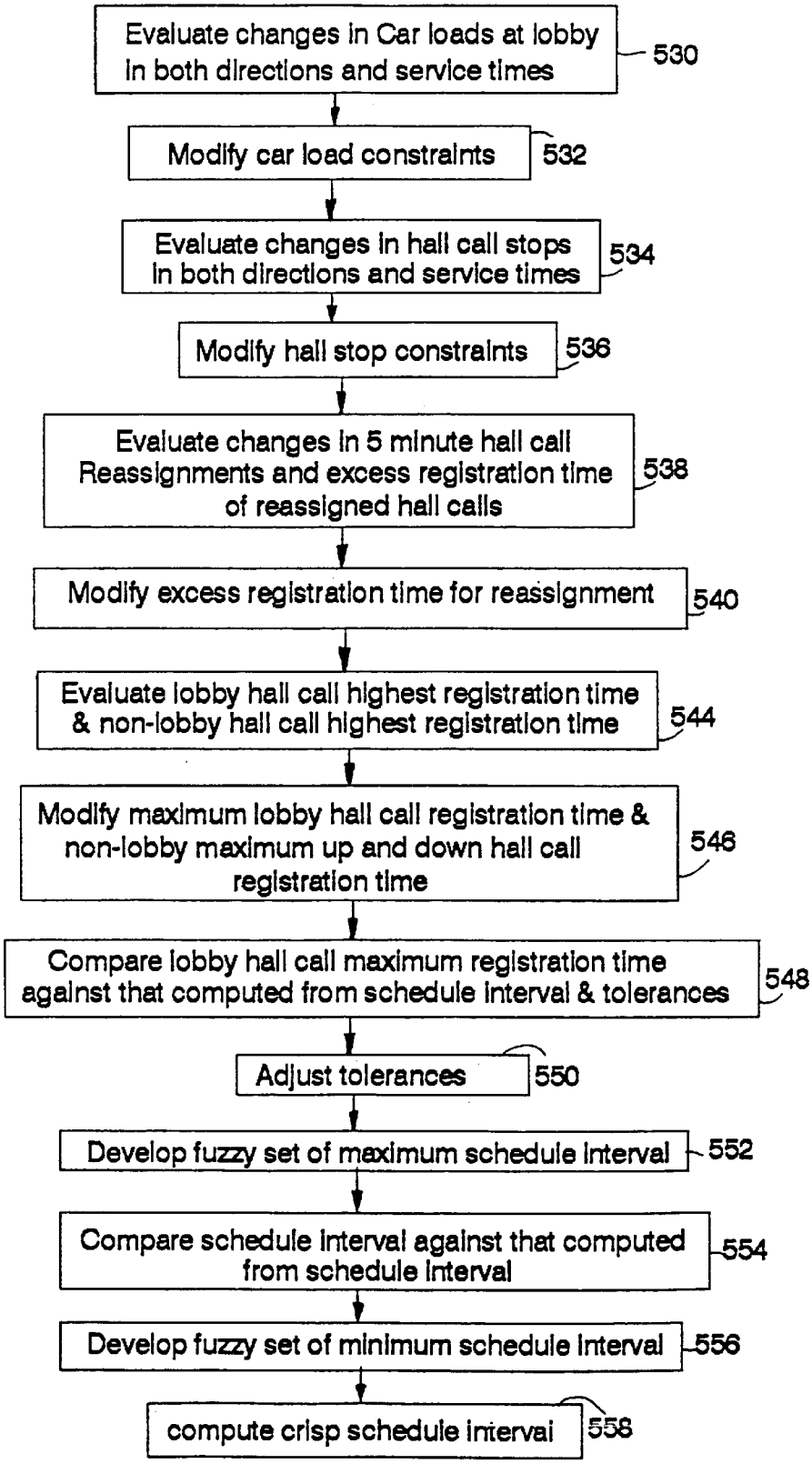
FIG. 46 is the flow diagram of the adaptive constraint generator used with the dynamic scheduler for single source traffic conditions.

Referring to FIG. 46, a flow diagram for the detailed implementation of the adaptive constraint generator used with the dynamic scheduler is shown. In Step 530, the predicted car loads and the predicted three minute service times are sent to the system dynamics analyzer. The system dynamics analyzer compares these two predicted values with the predictions made at the end of the previous minute to determine the percentage changes over time. The system dynamics analyzer also compare the two predicted values, to identify if the changes in the two elevator control system output variables are linear, and within acceptable variations. The two predicted values are also compared against the allowable maximum values, to determine the deviations from the allowable maximums. These are communicated in terms of type 1, type 2, type 3 changes and magnitude of changes to the adaptive constraint generator. Based on these analyses, the requirements for changing allowable car maximum loads before the car can be assigned to answer a hall call and the allowable maximum car loads after the car answers the hall call are determined and sent to the adaptive constraint generator.

In Step 532, the adaptive constraint generator then uses this change information and prestored constraint modification instructions tables to determine the allowable maximum car loads before the car can be assigned to a hall call, and the allowable maximum car loads after the car answers the hall call. These variables are determined separately for the primary and the secondary directions.

In Step 534, the predicted hall call stops in the secondary direction and the predicted service time are sent to the system dynamics analyzer and the changes in these elevator control system output variables are evaluated. Then, in Step 536, the allowable maximum secondary direction hall calls that can be assigned to a car during the round trip are determined. In Step 538, the previous five minute hall call reassignments and the excess registration time of the reassigned hall calls are sent to the system dynamics analyzer and the changes in these elevator control system output variables evaluated. In Step 540, the allowable excess registration time for reassignment are determined using cross correlation and constraint modification instructions tables.

The above three sets of variables are examples of variables directly used by the dynamic scheduler for dispatching. These variables could be used in any other type of dispatcher as well.

In Step 544, the predicted values of the lobby hall call highest registration time and the non-lobby hall call highest registration time are sent to the system dynamics analyzer and the changes in these elevator control system output variables are evaluated. In Step 546, the allowable maximum lobby hall call registration time and the allowable maximum non-lobby hall call registration time are determined using proper cross correlations and constraint modification instructions tables. These variables are used by the adaptive controller to select the membership functions for the fuzzy sets used with various fuzzy logic controllers.

The method of selecting and implementing the third set of constraint variables is described with reference to Steps 548 through 558 of FIG. 46. In Step 548, the maximum lobby hall call registration time is compared against the maximum possible hall call registration time, for the selected schedule interval and schedule tolerances. Based on this comparison, the schedule tolerances are adjusted using a defined function. Then in Step 552, the allowable maximum schedule interval is determined and a fuzzy set is defined for this allowable maximum interval. In Step 554, the schedule interval selected is compared against the predicted round trip time. From this the minimum schedule interval allowable is computed. Then, in Step 556, a fuzzy set is defined for the allowable minimum interval.

The constraint variables for the control parameters are sent to the control constraint enforcement function 462. If the constraint variables are crisp, the crisp values of the constraint variables selected by the fuzzy logic controller are modified, if necessary, to meet the constraint variables, by the control constraint enforcement function. If on the other hand, the constraints are fuzzy, then the constraint enforcement function generates fuzzy constraint variables using defined triangular membership functions. The constraint enforcement function uses the fuzzy constraint variables and the defined degrees of membership of the control parameter output by the fuzzy logic controller to limit the fuzzy control parameter value. Then this fuzzy control parameter value is used to get the crisp value of the control output.

The selection of dynamic scheduling control parameters using the above described fuzzy logic controllers results in rapid response to lobby traffic, traffic rate, other elevator control system state and performance conditions. The dynamic scheduler control parameters are selected using proper control loops and are provided with adaptive control features. Thus, the lobby hall call registration time, waiting time, lobby crowd and duration of crowd are reduced. Additionally, improved service is provided to hall calls made at all floors, resulting in reduced hall call registration times and hall call reassignments.

Single Source Traffic in Two Way Traffic Conditions

Figure 47:
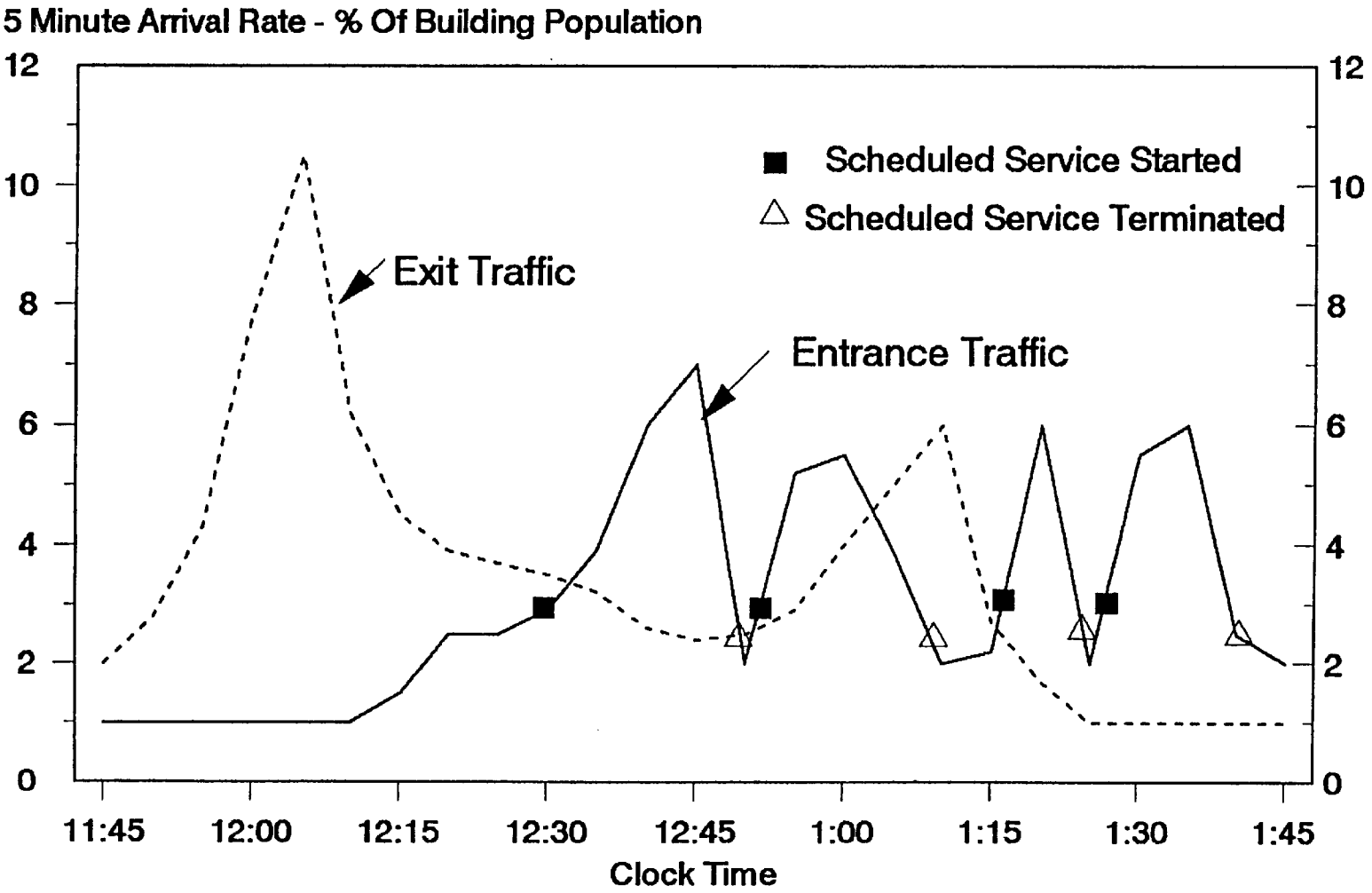
FIG. 47 is a graphical illustration showing scheduled service activation and deactivation for lobby single source traffic during noon time.

The single source traffic dynamic scheduling can be used whenever the lobby generated single source traffic is significant. FIG. 47 shows scheduled service activation and deactivation during noon time two way traffic conditions, based on predicted boarding counts.

What is claimed is:

1. A system for controlling elevator cars in a building having a plurality of floors, said system comprising a group controller for controlling operation of the elevator cars, said group controller assigning at least one of the elevator cars to be available for passenger boarding within a schedule window, wherein said schedule window comprises an upper and a lower tolerance and said upper tolerance is equal to said lower tolerance.

2. A system for controlling elevator cars in a building having a plurality of floors, said system comprising a group controller for controlling operation of the elevator cars, said group controller assigning at least one of the elevator cars to be available for passenger boarding within a schedule window, wherein said schedule window comprises an upper and a lower tolerance and said upper and lower tolerances are selected in response to a difference between an allowable maximum hall call registration time and a predicted highest hall call registration time.

3. A system for controlling elevator cars in a building having a plurality of floors as recited in claim 2 wherein if a determined number of hall call registration times exceed said allowable maximum hall call registration time, said allowable maximum hall call registration time is increased.

4. A system for controlling elevator cars in a building having a plurality of floors as recited in claim 2 wherein said upper and lower tolerances increase as the difference between the allowable maximum hall call registration time and the predicted highest hall call registration time increases.

5. A system for controlling elevator cars in a building having a plurality of floors, said system comprising a group controller for controlling operation of the elevator cars, said group controller assigning at least one of the elevator cars to be available for passenger boarding within a schedule window, wherein said schedule window comprises an upper and a lower tolerance and said upper and lower tolerances are seven seconds and five seconds respectively if a difference between and an allowable maximum hall call registration time and a predicted highest hall call registration time is less than a threshold.

6. A system for controlling elevator cars in a building having a plurality of floors as recited in claim 5 wherein said threshold is ten seconds.

7. A system for controlling elevator cars in a building having a plurality of floors, said system comprising a group controller for controlling operation of the elevator cars, said group controller assigning at least one of the elevator cars to be available for passenger boarding within a schedule window, wherein said schedule window comprises an upper and a lower tolerance and said upper and lower tolerances are ten seconds and seven seconds respectively if a difference between an allowable maximum hall call registration time and a predicted highest hall call registration time is greater than a threshold.

8. A system for controlling elevator cars in a building having a plurality of floors as recited in claim 7 wherein said threshold is ten seconds.

9. A method for dispatching elevator cars in a building having a plurality of floors, said method comprising the steps of:

assigning at least one of the elevator cars to be available for passenger boarding within a schedule window said schedule window comprising an upper and a lower tolerance selected around a scheduled time; and determining a next scheduled time in response to the scheduled time.

10. A method for dispatching elevator cars in a building having a plurality of floors as recited in claim 9 wherein the next scheduled time is determined by adding a schedule interval to a time that an elevator car is available for passenger boarding.

11. A method for dispatching elevator cars in a building having a plurality of floors as recited in claim 9, further comprising the step of updating successive scheduled times in response to determining the next scheduled time.

12. A method for dispatching elevator cars in a building having a plurality of floors, said method comprising the steps of:

assigning at least one of the elevator cars to be available for passenger boarding within a schedule window; and selecting upper and lower tolerances for said schedule window, in response to a difference between the allowable maximum hall call registration time and the predicted highest hall call registration time.

13. A method for dispatching elevator cars in a building having a plurality of floors, said method comprising the steps of:

assigning at least one of the elevator cars to be available for passenger boarding within a schedule window;

selecting upper and lower tolerances for said schedule window, in response to an allowable maximum registration hall call time and a predicted highest hall call registration time; and increasing the allowable maximum registration time if a determined number of hall call registration times exceed the allowable maximum hall call registration time.

14. A method for dispatching elevator cars in a building having a plurality of floors, said method comprising the steps of:

assigning at least one of the elevator cars to be available for passenger boarding within a schedule window;

selecting upper and lower tolerances for said schedule window, in response to an allowable maximum registration hall call time and a predicted highest hall call registration time; and increasing the upper and lower tolerances if the difference between the allowable maximum hall call registration time and the predicted highest hall call registration time increases.

15. A method for dispatching elevator cars in a building having a plurality of floors, said method comprising the steps of:

assigning at least one of the elevator cars to be available for passenger boarding within a schedule window;

selecting upper and lower tolerances for said schedule window, in response to an allowable maximum registration hall call time and a predicted highest hall call registration time; and setting a predicted traffic level as a threshold for increasing the number of elevator cars assigned to the lobby if, for more than one lobby hall call out of a predetermined number of lobby hall calls, an elevator car is not available at the lobby for assignment to the hall call.

16. A method for dispatching elevator cars in a building having a plurality of floors, said method comprising the steps of:

assigning at least one of the elevator cars to be available for passenger boarding within a schedule window;

selecting upper and lower tolerances for said schedule window, in response to an allowable maximum registration hall call time and a predicted highest hall call registration time; and setting a predicted traffic as a threshold for decreasing the number of elevator cars assigned to the lobby if two elevator cars are stopped at the lobby for more than a determined time and a hall call at the lobby does not occur during the determined time.

17. A system, including a group controller, for controlling a plurality of elevator cars serving a plurality of floors in a building, said group controller repetitively, in each of a continuous series of time periods, determining the level of passenger traffic entering the elevators at a lobby floor, and if the level of traffic is above a first threshold level, without regard to whether a hall call is currently registered at the lobby floor or not, successively assigning a series of cars to travel to the lobby floor and open their doors within corresponding ones of a succession of time windows.

18. A system according to claim 17 wherein said time windows each comprise a lower tolerance time interval ending at a schedule time and an upper tolerance time interval beginning at said schedule time, said schedule time being in a sequence of schedule times separated by a time interval.

19. A system according to claim 18 wherein the schedule time for one assigned car is defined by adding said time interval to the time when a previous car, next ahead of said one car in said series of assigned cars, opened its door at the lobby floor.

20. A system according to claim 18 wherein said lower tolerance time interval is the same as said upper tolerance time interval.

21. A system according to claim 18 wherein said lower tolerance time interval is different from said upper tolerance time interval.

22. A system according to claim 21 wherein said lower tolerance time interval is smaller than said upper tolerance time interval.

23. A system according to claim 18 wherein said group controller determines the length of time that a hall call at a floor other than said lobby floor remains unanswered, and if any remains unanswered for longer than a threshold period of time, the duration of one of said tolerance time intervals is increased.

24. A system according to claim 17 wherein said group controller selects, for assignment to said lobby floor, only a car that can reach said lobby floor and open its door within said time window.

25. A system according to claim 17 wherein said group controller, in response to the level of traffic being below said first threshold level, assigns a car to respond to a hall call at said lobby floor only in response to a hall call being registered at said lobby floor.

26. A method of controlling a plurality of elevator cars serving a plurality of floors in a building, comprising:

repetitively, in each of a continuous series of time periods, determining the level of passenger traffic entering the elevators at a lobby floor; and if the level of traffic is above a first threshold level, without regard to whether a hall call is currently registered at the lobby floor or not, successively assigning a series of cars to travel to the lobby floor and open their doors within corresponding ones of a succession of time windows.

27. A method according to claim 26 wherein said time windows each comprise a lower tolerance time interval ending at a schedule time and an upper tolerance time interval beginning at said schedule time, said schedule time being in a sequence of schedule times separated by a time interval.

28. A method according to claim 27 wherein the schedule time for one assigned car is defined by adding said time interval to the time when a previous car, next ahead of said one car in said series of assigned cars, opened its door at the lobby floor.

29. A method according to claim 27 wherein said lower tolerance time interval is the same as said upper tolerance time interval.

30. A method according to claim 27 wherein said lower tolerance time interval is different from said upper tolerance time interval.

31. A method according to claim 30 wherein said lower tolerance time interval is smaller than said upper tolerance time interval.

32. A method according to claim 27 further comprising:

determining the length of time that a hall at a floor other than said lobby floor remains unanswered, and if any remains unanswered for longer than a threshold period of time, increasing the duration of one of said tolerance time intervals.

33. A method according to claim 26 in which said series of cars includes only cars that can reach said lobby floor and open their doors within said time window.

34. A method according to claim 26 further comprising:

in response to the level of traffic being below said first threshold level, assigning a car to respond to a hall call at said lobby floor only in response to a hall call being registered at said lobby floor.

35. A system for controlling elevator cars in a building having a plurality of floors, said system comprising a group controller for controlling operation of the elevator cars, said group controller assigning at least one of the elevator cars to be available at a lobby for passenger boarding within said schedule window, wherein, if for more than one lobby hall call out of a predetermined number of lobby hall calls, an elevator car is not available at the lobby for assignment to the hall call, the system sets a predicted traffic level as a threshold for increasing the number of elevator cars assigned to the lobby.

* * * * *